US007965274B2

(12) United States Patent
Okada et al.

(10) Patent No.: US 7,965,274 B2
(45) Date of Patent: Jun. 21, 2011

(54) DISPLAY APPARATUS USING ELECTROPHORETIC ELEMENT

(75) Inventors: Atsushi Okada, Kanagawa (JP); Shin Aoki, Kanagawa (JP); Takao Inoue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 986 days.

(21) Appl. No.: 11/835,873

(22) Filed: Aug. 8, 2007

(65) Prior Publication Data

US 2008/0048968 A1 Feb. 28, 2008

(30) Foreign Application Priority Data

Aug. 23, 2006 (JP) ..... 2006-226523
Dec. 27, 2006 (JP) ..... 2006-352517

(51) Int. Cl.
*G09G 3/34* (2006.01)

(52) U.S. Cl. ..... 345/107; 345/84

(58) Field of Classification Search ..... 345/107
See application file for complete search history.

(56) References Cited

U.S. PATENT DOCUMENTS 4,414,580 A * 11/1983 Johnsen et al. ..... 358/426.11
7,679,593 B2 * 3/2010 Nakai et al. ..... 345/94
7,705,823 B2 * 4/2010 Nihei et al. ..... 345/107
7,868,947 B2 * 1/2011 Takeuchi et al. ..... 348/441
2003/0120365 A1 * 6/2003 Asano et al. ..... 700/86
2003/0137704 A1 * 7/2003 Ferriere ..... 358/909.1
2003/0202780 A1 * 10/2003 Dumm et al. ..... 386/112
2005/0265620 A1 * 12/2005 Hung ..... 382/254
2006/0279478 A1 * 12/2006 Ikegami ..... 345/30
2007/0097260 A1 * 5/2007 Takeuchi et al. ..... 348/441
2007/0110332 A1 * 5/2007 Asano et al. ..... 382/275

FOREIGN PATENT DOCUMENTS

JP 7-20823 1/1995
JP 2002-62853 2/2002
JP 2004-258125 9/2004
JP 3762412 1/2006

OTHER PUBLICATIONS

U.S. Appl. No. 12/259,558, filed Oct. 28, 2008, Okada, et al.

* cited by examiner

*Primary Examiner* — Richard Hjerpe
*Assistant Examiner* — Gregory J Tryder
(74) *Attorney, Agent, or Firm* — Oblon, Spivak, McClelland, Maier & Neustadt, L.L.P.

(57) ABSTRACT

A display apparatus is disclosed that includes two opposing substrates, an electrophoretic element arranged between the substrates; pixel electrodes that are arranged on one of the substrates and are divided into pixel groups including at least a first pixel group and a second pixel group, a common electrode that is arranged on the other substrate, and a control unit that controls frame display operations of the pixel groups. The control unit controls the first pixel group to start frame display operations for displaying a frame and then controls the second pixel group to start frame display operations for displaying another frame before the frame display operations of the first pixel group are completed.

15 Claims, 35 Drawing Sheets

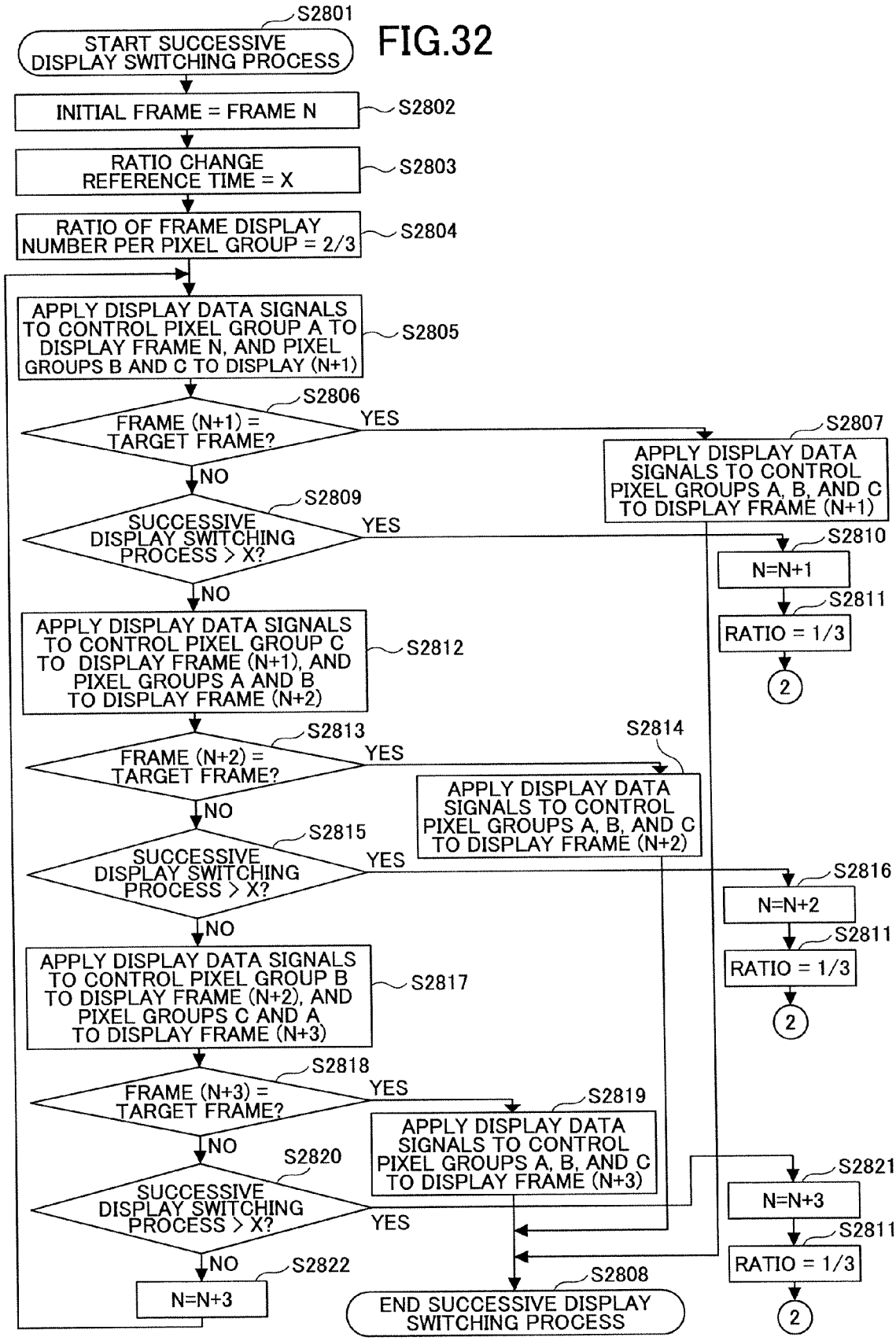
FIG.32
S2801
START SUCCESSIVE DISPLAY SWITCHING PROCESS
INITIAL FRAME = FRAME N
S2802
RATIO CHANGE REFERENCE TIME = X
S2803
RATIO OF FRAME DISPLAY NUMBER PER PIXEL GROUP = 2/3
S2804
APPLY DISPLAY DATA SIGNALS TO CONTROL PIXEL GROUP A TO DISPLAY FRAME N, AND PIXEL GROUPS B AND C TO DISPLAY (N+1)
S2805
S2806
FRAME (N+1) = TARGET FRAME?
YES
NO
S2807
APPLY DISPLAY DATA SIGNALS TO CONTROL PIXEL GROUPS A, B, AND C TO DISPLAY FRAME (N+1)
S2809
SUCCESSIVE DISPLAY SWITCHING PROCESS > X?
YES
NO
S2810
N=N+1
S2811
RATIO = 1/3
2
APPLY DISPLAY DATA SIGNALS TO CONTROL PIXEL GROUP C TO DISPLAY FRAME (N+1), AND PIXEL GROUPS A AND B TO DISPLAY FRAME (N+2)
S2812
S2813
FRAME (N+2) = TARGET FRAME?
YES
NO
S2814
APPLY DISPLAY DATA SIGNALS TO CONTROL PIXEL GROUPS A, B, AND C TO DISPLAY FRAME (N+2)
S2815
SUCCESSIVE DISPLAY SWITCHING PROCESS > X?
YES
NO
S2816
N=N+2
S2811
RATIO = 1/3
2
APPLY DISPLAY DATA SIGNALS TO CONTROL PIXEL GROUP B TO DISPLAY FRAME (N+2), AND PIXEL GROUPS C AND A TO DISPLAY FRAME (N+3)
S2817
S2818
FRAME (N+3) = TARGET FRAME?
YES
NO
S2819
APPLY DISPLAY DATA SIGNALS TO CONTROL PIXEL GROUPS A, B, AND C TO DISPLAY FRAME (N+3)
S2820
SUCCESSIVE DISPLAY SWITCHING PROCESS > X?
YES
NO
S2821
N=N+3
S2811
RATIO = 1/3
2
S2822
N=N+3
S2808
END SUCCESSIVE DISPLAY SWITCHING PROCESS

DISPLAY APPARATUS USING ELECTROPHORETIC ELEMENT

BACKGROUND OF THE INVENTION

1. Field of the Invention

The present invention relates to a display apparatus that uses electrophoretic elements.

2. Description of the Related Art

It is noted that various forms of paper-type display apparatuses are recently being developed. Such display apparatus technology may be applied to an electronic book that is configured to display an image of one page (frame) of a document on a display unit at one time and successively switch the pages (frames) being displayed to enable a user to virtually turn the pages of the document at a desired speed in a manner similar to turning the pages of an actual book, for example. A display apparatus that uses electrophoretic elements is known as one form of such paper-type display apparatus. FIGS. 1-3 are diagrams illustrating a configuration of a display apparatus that uses electrophoretic elements according one prior art example.

FIG. 1 is a first diagram illustrating a configuration of a display apparatus 100 according to the prior art. FIG. 2 is a second diagram illustrating a configuration of the display apparatus 100. FIG. 3 is an enlarged view of a thin film transistor (TFT) 105 of the display apparatus 100.

As is shown in FIG. 1, the display apparatus 100 includes a display unit 120 and a drive circuit 130 that drives the display unit 120.

In the following, the display unit 120 is described with reference to FIGS. 1 and 2.

The display unit 120 includes an electrode substrate 101A and a circuit substrate 102A that oppose each other (see FIG. 2). The electrode substrate 101A includes a transparent common electrode 101; and the circuit substrate 102A includes thin film transistors (TFT) 105, scanning lines 106, and signal lines 107. The circuit substrate 102A also includes pixel electrodes 102 that are arranged into a matrix pattern on top of the thin film transistors (TFT) 105, the scanning lines 106, and the signal lines 107.

As is shown in FIG. 2, a liquid having positively or negatively charged white electrophoretic particles (elements) 103 and black electrophoretic particles (elements) 104 scattered within is sealed between the common electrode 101 and the pixel electrode 102. It is noted that the white electrophoretic elements 103 and the black electrophoretic elements 104 are charged by differing electrical charges. Also, a fixed voltage is applied to the common electrode 101 arranged on the electrode substrate 101A. The pixel electrodes 102 arranged on the circuit substrate 102A are each conductively connected to source electrodes of the TFT 105 arranged on the circuit substrate 102A (see FIG. 3).

With respect to the TFTs 105 arranged on the circuit substrate 102A, when the TFTs 105 are arranged in the line directions, their gate electrodes 112 are connected to the scanning lines 106 (see FIG. 3). On the other hand, when the TFTs 105 are arranged in the row directions, their gate electrodes 112 are connected to the signal lines 107 of the circuit substrate 102A (not shown).

The TFT 105 controls the amount of current flowing between a source electrode 113 and a drain electrode 114 with the voltage applied to its gate electrode 112. It is noted that when the source-drain current of the TFT 105 is large, a switch of the TFT 105 is turned on, and when the source-drain current of the TFT 105 is small, the switch of the TFT 105 is turned off.

The drive circuit 130 includes a controller 108, a memory 109, a scanning line driver 110, and a signal line driver 111. The controller 108 controls display operations of the display apparatus 100. The memory 109 stores display data for each pixel forming a pattern of plural frames to be displayed on the display apparatus 100.

In the following, operations of the display apparatus 100 are described with reference to FIG. 1.

In the case of displaying a new frame on the display apparatus 100, a scanning command signal 10B is transmitted from the controller 108 to the scanning driver 110. In response to receiving the scanning command signal 10B, the scanning line driver 110 applies corresponding voltages to the gate electrodes 112 of the TFTs 105 via the scanning lines 106 to control the switching operations of the TFTs 105. It is noted that the scanning command signal 10B from the controller 108 includes a control signal for determining the TFTs that are to be turned on, and a control signal for determining the output timing of the voltages to be output from the scanning line driver 110.

Also, the controller 108 transmits an addressing signal 10A to the memory 109 and a display command signal 10C to the signal line driver 111. At the memory 109, display data 10D of each pixel forming a pattern of the frame to be displayed are extracted based on the addressing signal 10A. Then, the extracted display data 10D are transmitted to the signal line driver 111.

The signal line driver 111 applies corresponding voltages to the gate electrodes 112 of the TFTs 105 via the signal line 107 based on the display command signal 10C and the display data 10D. It is noted that the display command signal 10C from the controller 108 includes a control signal for determining the timing at which the voltage is to be output from the signal line driver 111.

When the TFT is turned on, the voltage applied to the gate electrode 120 of the TFT 105 is applied to the pixel electrode 102. The pixel electrode 102 is applied a positive voltage or a negative voltage. In turn, an electric field is generated by the difference in potential between the pixel electrode 102 and the common electrode 101 so that the white electrophoretic elements 103 or the black electrophoretic elements 104 move to the common electrode 101 side. In this way, a pattern may be displayed on the common electrode 101 side.

As can be appreciated, displaying a frame on the display apparatus 100 involves successively turning on TFTs 105 that are connected to the scanning lines 106 based on the scanning command signal 10B, and the frame display operations may be completed at the time desired patterns are displayed by all the pixel electrodes 102 connected to the TFTs 105. In the following descriptions, the process of successively turning on the TFTs 105 is referred to as scanning.

In the following, frame switching operations performed at the display apparatus 100 are described with reference to FIGS. 4 and 5. FIG. 4 is a diagram illustrating an exemplary display unit of the display apparatus 100. FIG. 5 is a timing chart illustrating frame switching operations of the display apparatus 100.

The illustrated display unit A01 of FIG. 4 has scanning lines X1-X6 and signal lines Y1-Y8. It is noted that scanning lines X1-Xm of the timing chart of FIG. 5 corresponds to the scanning lines X1-X6 of the display unit A01, and the signal lines Y1-Yn of the timing chart of FIG. 5 corresponds to the signal lines Y1-Y8 of the display unit A01. Also, it is assumed in the following descriptions that the display status of the display unit A01 at an initial stage corresponds to the display status A of FIG. 5, and the display status of the display unit A01 is switched from display status A to display status B and then from display status B to display apparatus C of FIG. 5.

In the display apparatus 100, the scanning lines X1-X6 of the display unit A01 are successively scanned from scanning line X1 to scanning line X6. Specifically, switching control operations are performed for successively turning on the TFTs 105 connected to the scanning lines X1 through X6. It is noted that in the present case, when the source-drain current of the TFT 105 is at high level (H level), the TFT 105 is turned off, and when the source-drain current of the TFT 105 is at low level L level), the TFT 105 is turned on.

In the display unit A01, after the elapse of scanning time B02 corresponding to the time required for completing one scanning process, voltages for displaying patterns representing the display status B of FIG. 5 are applied to the pixel electrodes 102.

Then, the white electrophoretic elements 103 and the black electrophoretic elements 104 are moved as a result of the generation of an electric field between the pixel electrodes 102 and the common electrode 101, and the pixel electrodes 102 are switched from one color pattern to another color pattern. After the elapse of pixel pattern switching time B01 corresponding to the time required for the pixel electrodes 102 to be switched to a different color pattern, the display status of the display unit A01 is switched from the display status A to the display status B of FIG. 5.

As can be appreciated from the above descriptions, in switching the frame displayed on the display unit A01 of the display apparatus 100, the display switching time required for switching a display of one frame is equal to the total of the scanning time and the pixel pattern switching time.

The scanning time of the display apparatus 100 corresponds to the process time required for scanning the scanning lines 106 and applying voltages to the pixel electrodes 102. It is noted that only a very short time is required for applying voltages to the pixel electrodes 102 so that the scanning time is substantially shorter than the pixel pattern switching time. Therefore, the required time for displaying one frame relies largely on the pixel pattern switching time.

The pixel pattern switching time of the display apparatus 100 is around several dozen to several hundred milliseconds (ms) which time is substantially longer than the display switching time for other types of display apparatuses such as the liquid crystal display. It is noted that the pixel pattern switching time depends on characteristics of the electrophoretic elements and is fixed regardless of the display method used. Accordingly, it is difficult to reduce the display switching time for switching the displayed frame by reducing the pixel pattern switching time.

Also, the display apparatus may successively switch and display plural frames in order to display a desired frame. For example, with respect to an electronic document including plural pages (frames), a user may turn the pages of the electronic document one page at a time and check the contents of each page to search a desired page. In such a case, since a relatively long display switching time is required in the conventional display apparatus using electronphoretic elements, a relatively long period of time may be required before the desired page may be displayed.

Also, it is noted that in the conventional display apparatus that uses electrophoretic elements, the speed at which the pages are turned cannot be adjusted. Therefore, it may take a long period of time before a desired page is displayed when a large number of pages have to be turned to reach the desired page, for example.

SUMMARY OF THE INVENTION

According to one aspect of the present invention, a technique is provided for reducing the display switching time for successively switching and displaying plural frames in a display apparatus.

According to another aspect of the present invention, a technique is provided for enabling adjustment of the display switching speed of a display apparatus in the case of successively switching and displaying plural frames so that a desired page may be promptly displayed.

According to one embodiment of the present invention, a display apparatus is provided that includes two opposing substrates, an electrophoretic element arranged between the substrates; pixel electrodes that are arranged on one of the substrates and are divided into pixel groups including at least a first pixel group and a second pixel group, a common electrode that is arranged on the other substrate, and a control unit that controls frame display operations of the pixel groups. The control unit controls the first pixel group to start frame display operations for displaying a frame and then controls the second pixel group to start frame display operations for displaying another frame before the frame display operations of the first pixel group are completed.

In one preferred embodiment, the display apparatus according to the above embodiment may include a change unit that changes the number of pixel groups into which the pixel electrodes are divided when a predetermined condition is satisfied during the frame display operations.

In another preferred embodiment, the display apparatus according to the above embodiment may include a ratio setting unit that sets information on a ratio of the number of frames to be displayed by each of the pixel groups to the total number of frames to be displayed by the display apparatus, and a ratio change unit that changes the ratio set by the ratio setting unit when a predetermined condition is satisfied during the frame display operations.

BRIEF DESCRIPTION OF THE DRAWINGS

FIG. 32 is a flowchart illustrating operations for changing the ratio in the display apparatus according to the fifth embodiment;

DESCRIPTION OF THE PREFERRED EMBODIMENTS

In the following, preferred embodiments of the present invention are described with reference to the accompanying drawings.

According to one aspect of the present invention, pixel electrodes of a display apparatus are divided into plural pixel groups where a first pixel group performs display operations for displaying a given frame and a second pixel group starts display operations for displaying another frame before frame display operations by the first pixel group are completed. In this way, the frame display switching time may be reduced in the case of successively switching and displaying plural frames. According to another aspect of the present invention, the display switching speed may be adjusted by changing the number of pixel groups so that a desired frame may be promptly displayed. According to another aspect of the present invention, the display switching speed may be adjusted by changing the ratio of the number of frames to be displayed by each of the pixel groups with respect to the total number of frames to be displayed so that a desired frame may be promptly displayed.

First Embodiment

Figure 6:
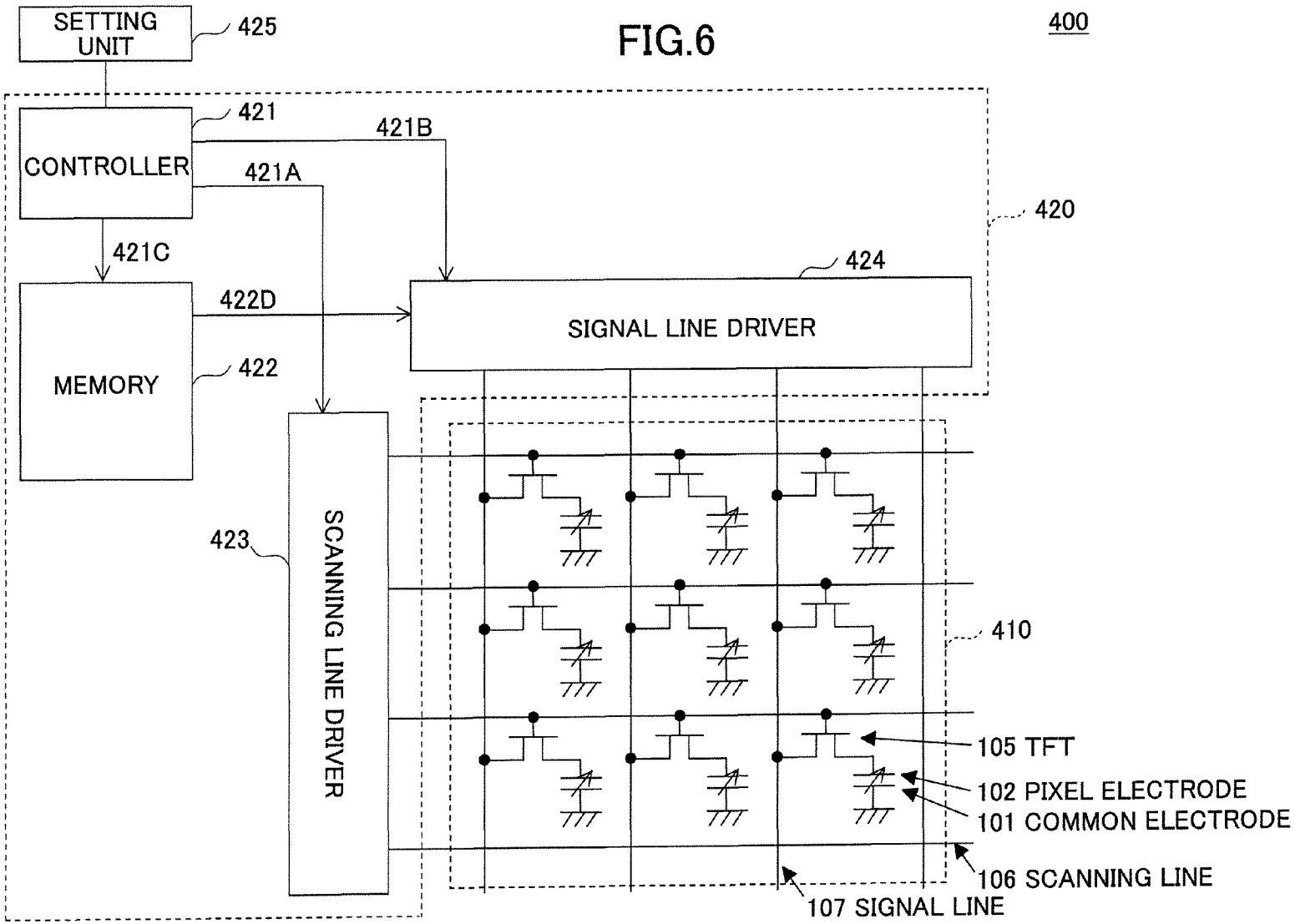
FIG. 6 is a block diagram showing a configuration of a display apparatus according to a first embodiment of the present invention.

FIG. 6 is a block diagram showing a configuration of a display apparatus 400 according to a first embodiment of the present invention.

The illustrated display apparatus 400 includes a display unit 410 that uses electrophoretic elements and a drive unit 420 that drives the display unit 410. The display apparatus 400 according to the present embodiment may be used for displaying plural pages of an electronic book, for example. The display apparatus 400 may successively switch the page being displayed on the display unit 410 as if to turn the pages of a book, for example. In the following descriptions, a still image that is displayed on the display unit 410 such as the image of a page of the electronic book as described above is referred to as a frame.

Figure 1:
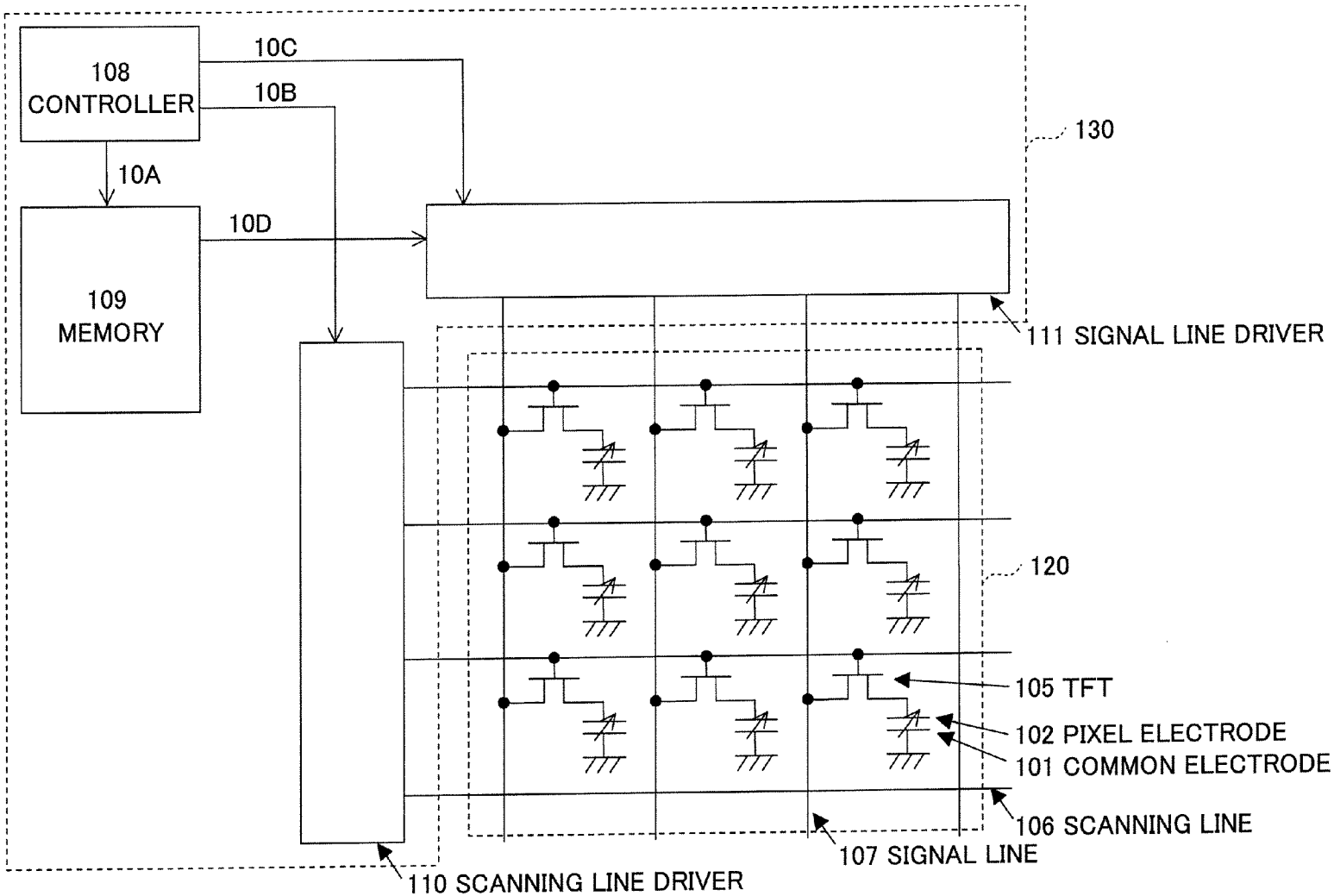
FIG. 1 is a block diagram showing a configuration of a display apparatus according to the prior art.
Figure 2:
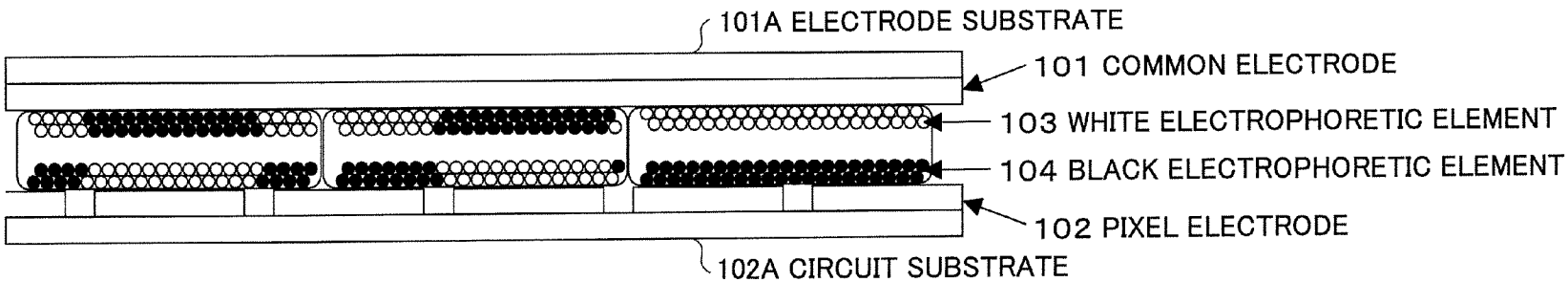
FIG. 2 is another diagram showing a configuration of the display apparatus according to the prior art.
Figure 3:
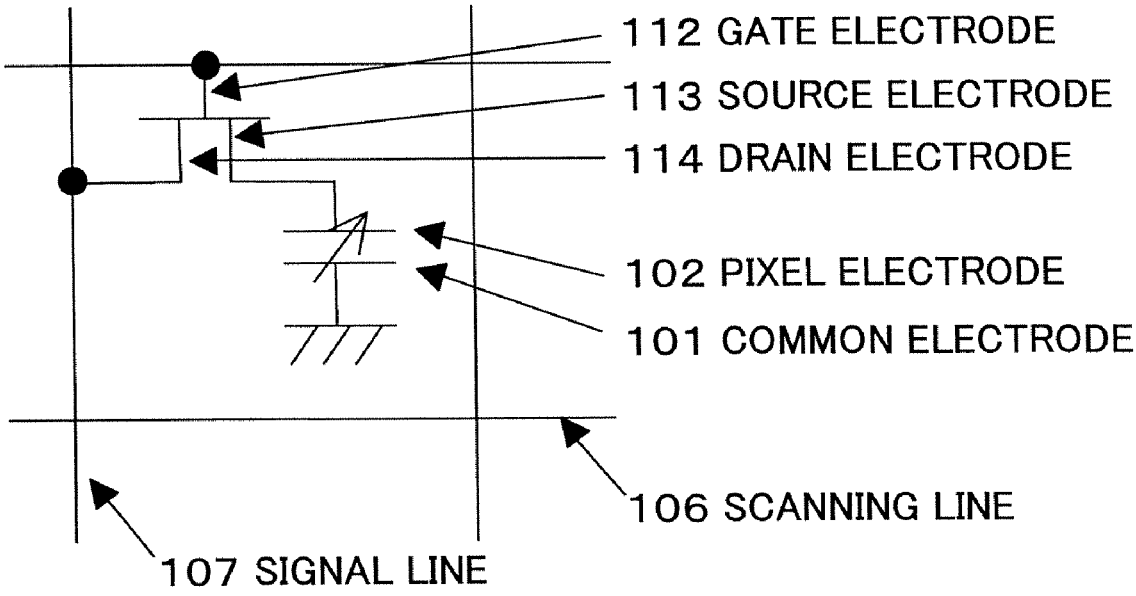
FIG. 3 is an enlarged view of a thin film transistor of the display apparatus according to the prior art.
Figure 4:
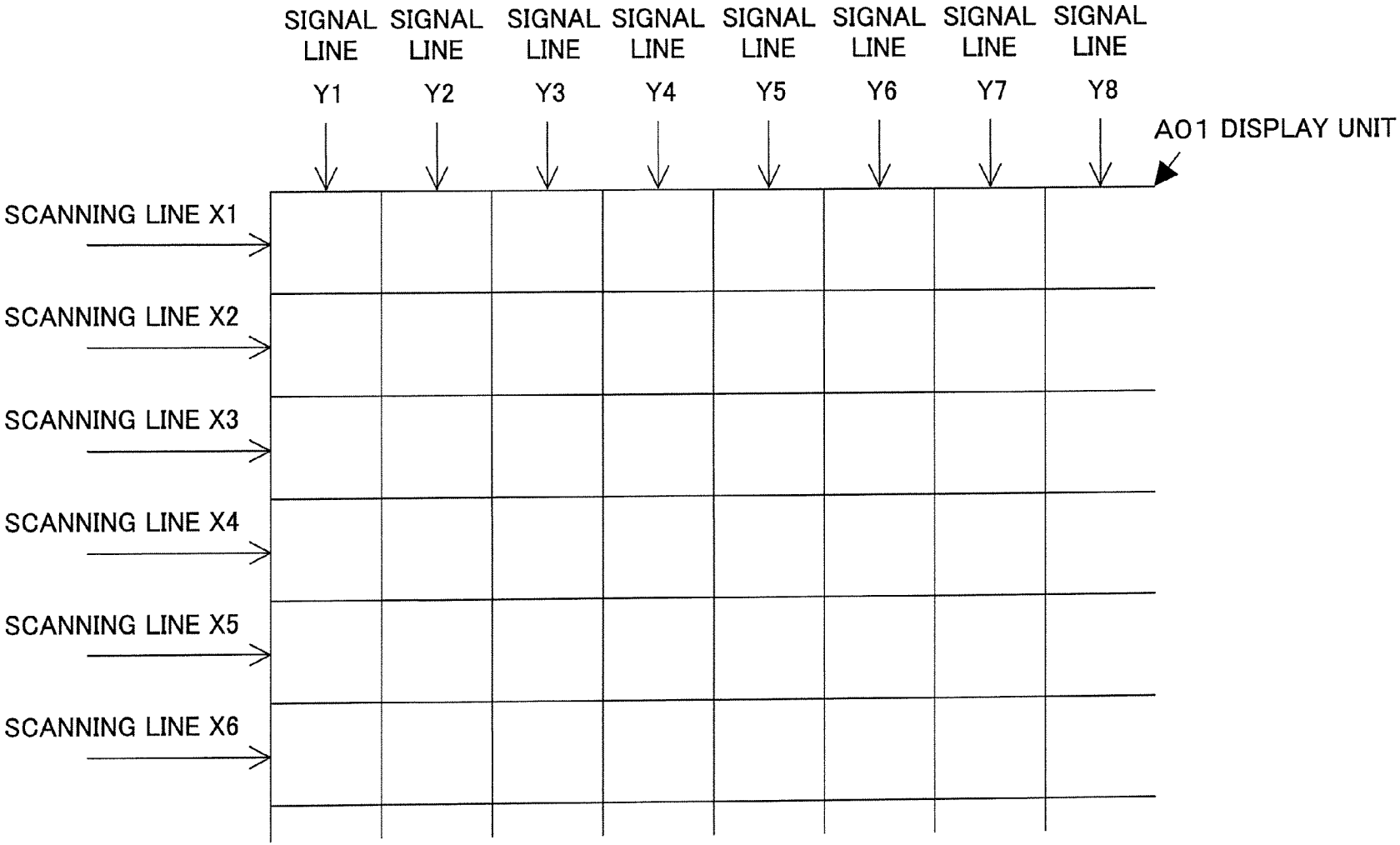
FIG. 4 is a diagram showing an exemplary configuration of a display unit of the display apparatus according to the prior art.
Figure 5:
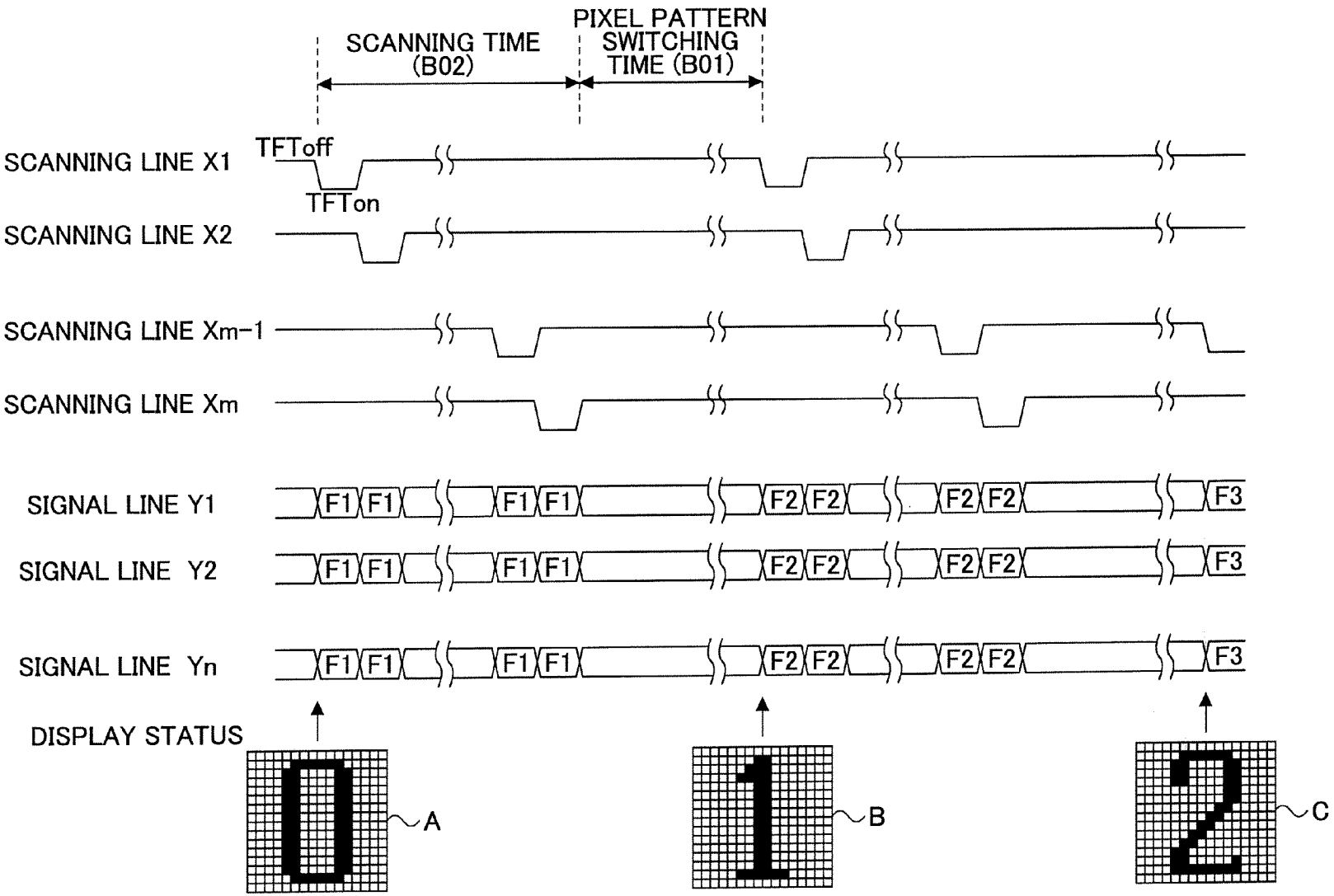
FIG. 5 is a timing chart illustrating frame display switching operations of the display apparatus according to the prior art.

It is noted that component elements of the display unit 410 that are identical to those of the display unit 120 shown in FIG. 1 are given the same reference numerals and their descriptions are omitted.

The drive unit 420 includes a controller 421, a memory 422, a scanning line driver 423, a signal line driver 424, and a setting unit 425.

The controller 421 administers overall display control operations of the display unit 410. The memory 422 may store information of plural frames to be displayed on the display unit 410, display data for each pixel electrode forming the pattern of each frame, and identification information for identifying the frame currently being displayed on the display unit 410 of the plural frames, for example.

The scanning line driver 423 scans the scanning lines 106 based on a scanning command signal output from the controller 421. The signal line driver 424 outputs display data to the pixel electrodes 102 connected to the TFT 105 that are turned on based on a display command signal output from the controller 421. The setting unit 425 performs various setting operations within the display apparatus 400.

In the following, operations of the display apparatus 400 are described.

When a display command is issued by a user at the display apparatus 400, the controller 421 outputs a scanning command signal 421A to the scanning line driver 423. The scanning line driver 423 receives the scanning command signal 421A and successively applies voltages to the scanning lines 106 to apply voltages to the TFTs 105 connected to the scanning lines 106.

Also, the controller 421 outputs a display command signal 421B to the signal line driver 423 and an addressing signal 421C to the memory 422 in response to the user display command. Upon receiving the addressing signal 421C, the memory 422 extracts display data 422D for the pixels forming the patterns of the frames to be displayed based on the addressing signal 421C, and outputs the extracted display data 422D for the pixels to the signal line driver 423.

The signal line driver 424 receives the display command signal 421B from the controller 421 and applies voltages to the signal lines 107 to have the display data received from the memory 422 displayed by the pixel electrodes 102 connected to the TFTs 105 that are turned on.

Figure 7:
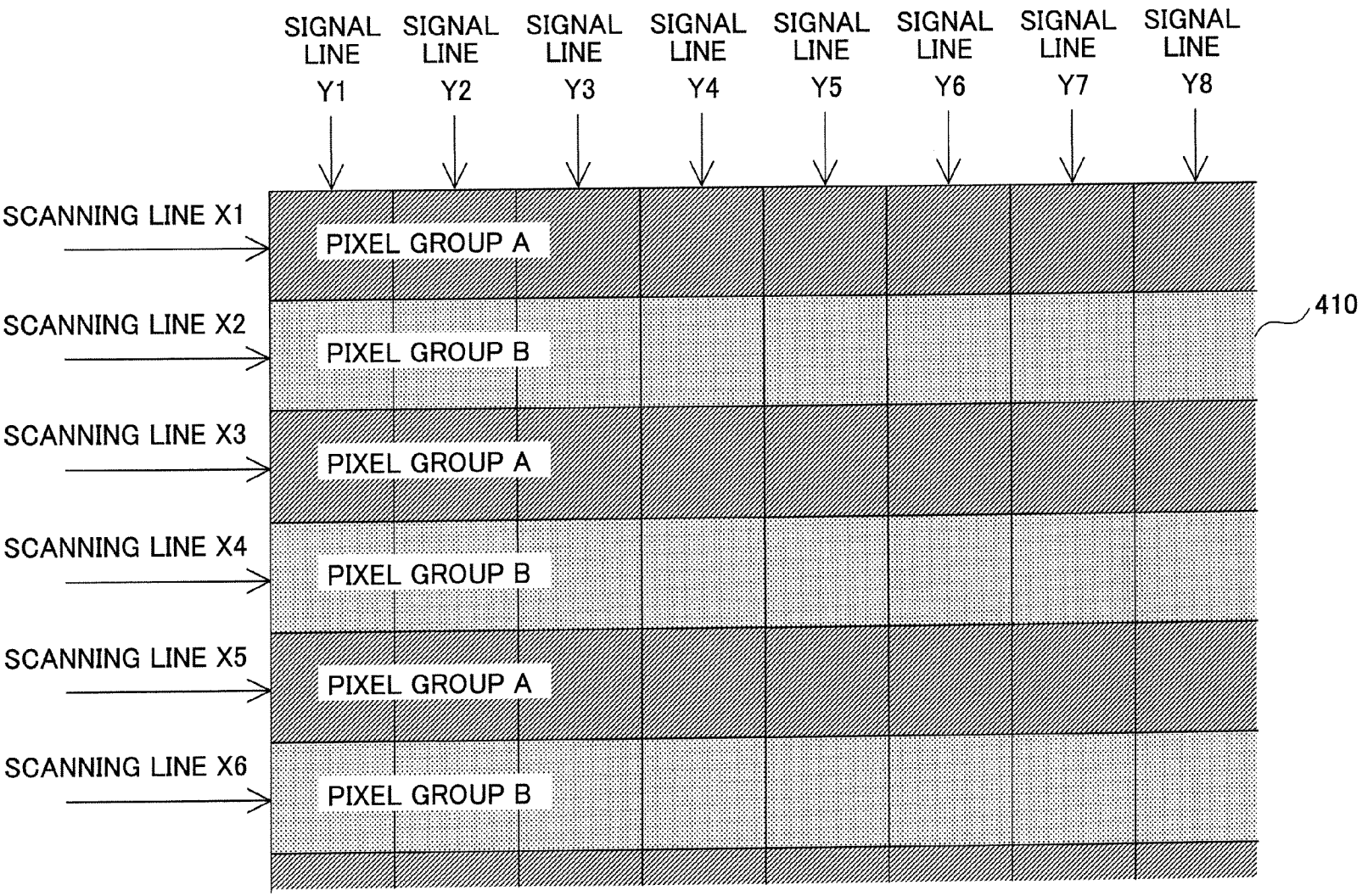
FIG. 7 is a diagram showing a configuration of a display unit of the display apparatus according to the first embodiment.

In the following, display operations by the display unit 410 are described with reference to FIG. 7. FIG. 7 is a diagram illustrating the display unit 410 of the display apparatus 400 according to the present embodiment.

The display unit 410 has pixel electrodes 102 that are divided into two groups, pixel group A and pixel group B, according to the scanning lines 106 to which they are connected. Specifically, in the present example, the scanning lines 106 of the display unit 410 are denoted as X1-X6, and the pixel electrodes connected to the odd-numbered scanning lines X1, X3, and X5 belong to the pixel group A, whereas the pixel electrodes 102 connected to the even-numbered scanning lines X2, X4, and X6 belong to the pixel group B.

By dividing the pixel electrodes 102 into those belonging to pixel group A and those belonging to pixel group B as is described above, and having the pixel groups display differing display data for representing patterns of differing frames, two different frames may be displayed by the display unit 410 at the same time.

It is noted that display control of the pixel groups may be performed by the controller 421 based on information set by the setting unit 425, for example.

The setting unit 425 may set information specifying the pixel group that is to display a given frame of the plural frames stored in the memory 422, for example. The controller 421 may control operations for outputting display data to be displayed by the pixel electrodes 102 of the pixel groups based on the information set by the setting unit 425, for example.

In one specific example, the setting unit 425 may set information specifying that even-numbered frames of the plural frames stored in the memory 422 are to be displayed by the pixel group A and odd-numbered frames of the plural frames are to be displayed by the pixel group B. In this case, the controller 421 controls operations so that display data for representing an even-numbered frame are output to and displayed by the pixel electrodes 102 belonging to the pixel group A that are connected to the TFTs 105 turned on by the scanning operations of the scanning line driver 423. Also, the controller 421 controls operations so that display data for representing an odd-numbered frame are output to and displayed by the pixel electrodes 102 belonging to the pixel group B that are connected to the TFTs 105 turned on by the scanning operations.

It is noted that in the above-illustrated example, the pixel electrodes 102 are divided into pixel groups according to their corresponding scanning lines 106; however, the manner in which the pixel electrodes 102 are divided is not limited to the above example. In alternative examples, the pixel electrodes 102 may be divided according to their corresponding signal lines 107, or the pixel electrode 102 belonging to different pixel groups may be randomly divided and scattered across the display unit 410 regardless of their corresponding scanning lines 106 or signal lines 107. In one embodiment, the manner in which the pixel electrodes 102 are divided may also be set by the setting unit 425.

Also, in the display apparatus 400 according to the present embodiment, output timings for outputting display data to be displayed by the pixel electrodes 102 belonging to the different groups may be independently controlled so that the start timings of display operations for displaying two frames may be independently controlled.

For example, operations for displaying a given frame by the pixel group A (as a first pixel group) are started first after which operations for displaying another frame by the pixel group B (as a second pixel group) are started before the frame display operations of the pixel group A are completed. In this way, the display switching time required for completing frame display operations for displaying plural frames from the first frame to the last frame may be reduced in the case of successively switching and displaying the plural frames on the display unit 410, for example. In the following descriptions, the process of successively switching and displaying plural frames on the display unit 410 from the first frame to the last frame is referred to as a successive display switching process.

The successive display switching process for displaying plural frames on the display unit 410 is described below with reference to FIGS. 8-10.

Figure 8:
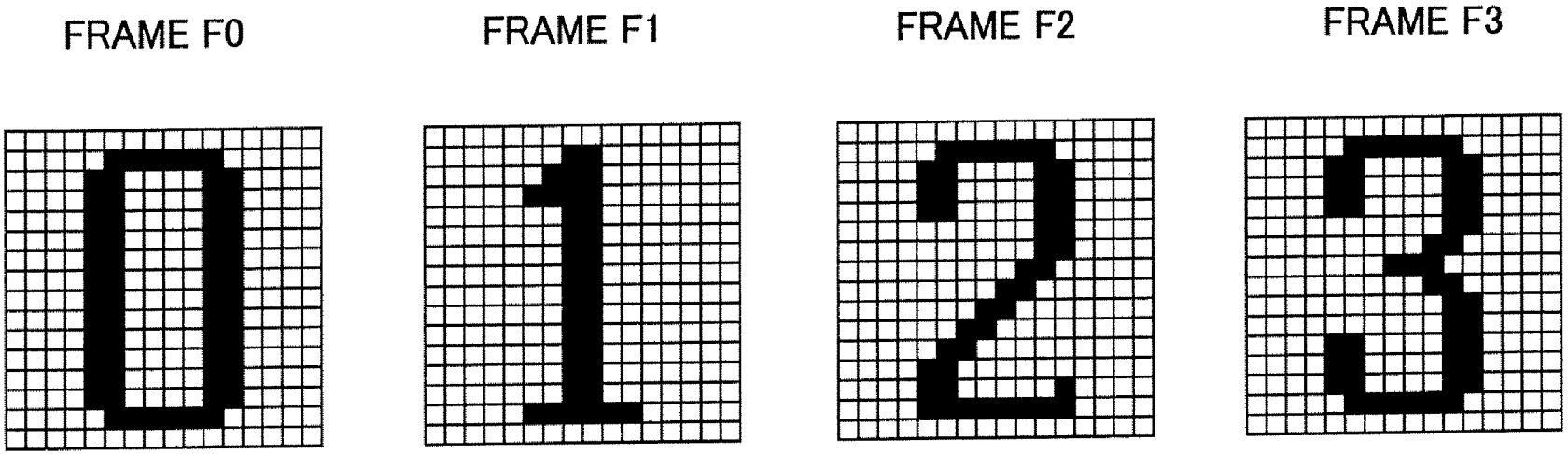
FIG. 8 is a diagram showing exemplary frames that may be displayed by the display unit.

FIG. 8 is a diagram showing exemplary frame patterns to be displayed on the display unit 410. FIG. 9 is a timing chart illustrating a process of displaying the frame patterns using two pixel groups. FIG. 10 is a diagram illustrating input signals input to the scanning lines and signal lines and the display statuses of the display unit 410 in accordance with the timing chart of FIG. 9.

Figure 9:
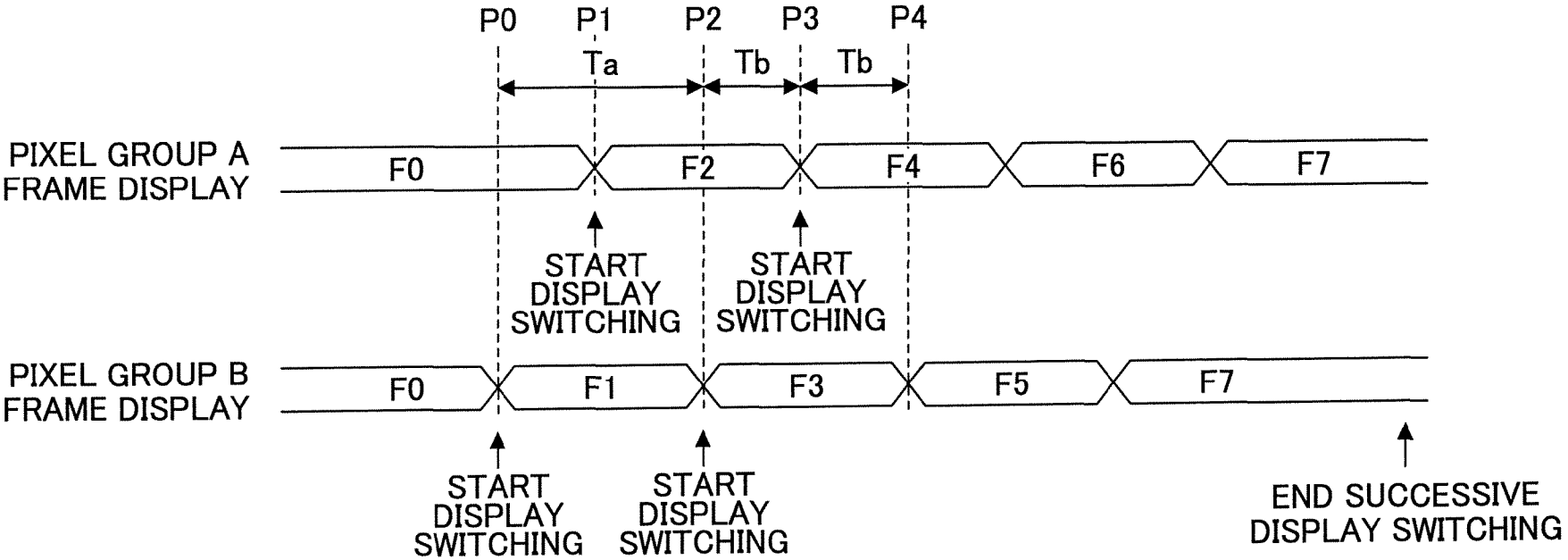
FIG. 9 is a timing chart illustrating frame display switching operations of the display apparatus according to the first embodiment.
Figure 10:
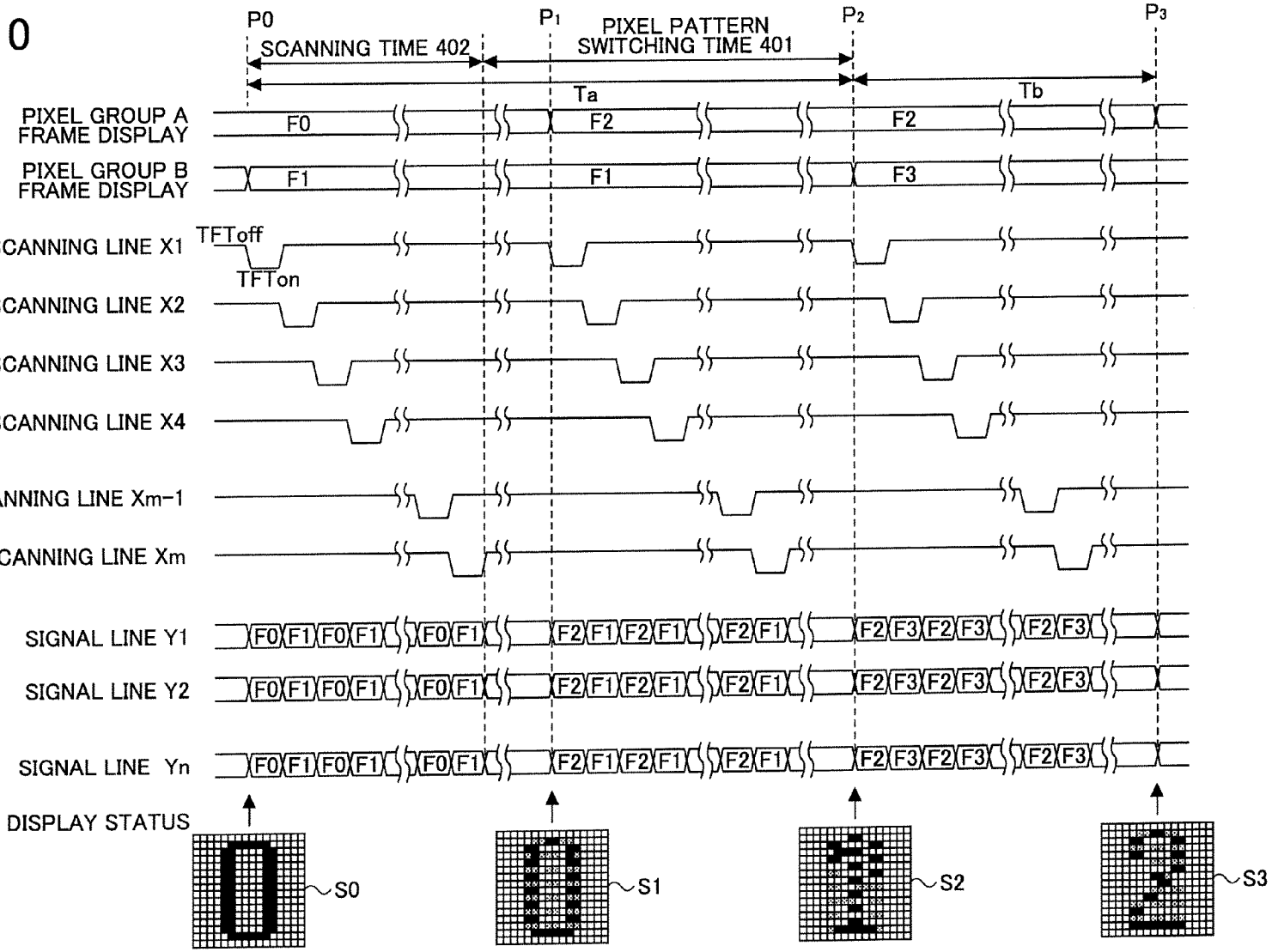
FIG. 10 is a diagram illustrating input signals input to scanning lines and signal lines of the display unit and the display statuses of the display unit corresponding to the timing chart of FIG. 9.

It is noted that in FIGS. 9 and 10, the plural frames to be successively displayed are denoted as Fx where x is a number indicating the display order of the plural frames.

Also, it is noted that F0 corresponds to an initial frame (first frame) to be displayed on the display unit 410 at an initial stage before the successive display switching process is started and F7 corresponds to a target frame (last frame) that is to be displayed at the end of the successive display switching process. In the following descriptions, the frame to be displayed at the time the display switching process is ended (such as frame F7 in the illustrated example) is referred to as a target frame.

Referring to FIG. 9, when the display apparatus 400 receives a display switching command at time point P0, display switching operations are started for switching the frame displayed on the display unit 410 from frame F0 to frame F1.

In the present example, it is assumed that the initial frame F0, the target frame F7, and the even-numbered frames F2, F4, and F6 are to be displayed by the pixel group A; and the initial frame F0, the target frame F7, and the odd-numbered frames F1, F3, and F5 are to be displayed by the pixel group B. In the display unit 410, the timings at which voltages are applied to the pixel electrodes 102 belonging to the pixel groups are varied based on the scanning timings. When the timings at which voltages are applied to the pixel electrodes 102 vary, the timings at which the white electrophoretic elements and the black electrophoretic elements start moving in the pixel electrodes may vary depending on each pixel electrode. Therefore, the timings at which moving operations of the white electrophoretic elements and the black electrophoretic elements are completed and the timings at which display data display operations are completed may vary depending on each pixel electrode. The display apparatus 400 according to the present invention uses such timing variations to have the pixel group A display a frame pattern and the pixel group B display another frame pattern at alternating timings so that the overall display switching time for displaying frames from frame F0 to F7 may be reduced, for example.

In FIG. 9, when the display apparatus 400 receives a display switching command at time point P0, display switching operations are started by scanning for a scanning time period 402 as is shown in FIG. 10.

In the following, the display status of the display unit 410 at time point P0 is described.

At time point P0, the initial frame F0 is displayed at the display unit 410. Such a display status of the display unit 410 is denoted as S0 in FIG. 10. The display unit 410 starts switching operations for switching the frame display from the initial frame F0 to the next frame F1. In this case, since the next frame F1 coming after the initial frame F0 is to be displayed by the pixel group B, the only the frame displayed by the pixel group B is switched at time point P0.

Specifically, when display switching operations are started at time point P0, display data for forming the pattern of frame F1 are input to the pixel electrodes 102 belonging to the pixel group B over the scanning time period 402 and display operations for displaying the pattern of frame F1 are started by the pixel group B. It is noted that switching operations for switching the frame displayed by the pixel group A are not yet started during the scanning operations performed over the scanning time period 402. Thus, display data for forming the pattern of the initial frame F0 continues to be input to the pixel group A during the scanning time period 402.

In the following, the display status of the display unit 410 at time point P1 is described.

It is noted that the display status of the display unit 410 at time point P1 is denoted as S1 in FIG. 10. At time point P1, display switching operations for switching the frame display of the pixel group A from the pattern of frame F0 to the pattern of frame F2 are to be started. At this point the pattern of frame F0 is still displayed by the pixel group A in a visually recognizable manner. Also, it is noted that the pixel group B is in the process of switching its frame display from the pattern of frame F0 to the pattern of frame F1 at time point P1. At this point, neither frame F0 nor frame F1 is displayed by the pixel group B in a visually recognizable manner. Thus, at time point P1, the pattern of frame F0 is still displayed on the display unit 410 in a visually recognizable manner.

In the following, the display status of the display unit 410 at time point P2 is described.

It is noted that the display status of the display unit 410 at time point P2 is denoted as S2 in FIG. 10. At time point P2, the pixel group A is in the process of switching its frame display from the pattern of frame F0 to the pattern of frame F2, where neither of the frames is displayed in a visually recognizable manner. Also, at time point P2, the display switching operations for switching the frame display of the pixel group B from the pattern of frame F0 to the pattern of frame F1 are completed so that the pattern of frame F1 is displayed in a visually recognizable manner by the pixel group B.

Thus, at time point P2, the pattern of frame F1 is displayed on the display unit 410 in a visually recognizable manner. In other words, display switching operations for switching the frame display of the display unit 410 from the pattern of the initial frame F0 to the pattern of the next frame F1 are completed at time point P2. It is noted that the display switching time for switching the frame display from the pattern of frame F0 to the pattern of frame F1 is denoted as Ta in FIG. 10. Also, it is noted that at this point, a residual image resulting from the display switching operations of the pixel group A may be displayed in the background of the frame display of the pattern of frame F1 displayed by the pixel group B of the display unit 410. However, such a residual image may not constitute a substantial factor hampering the visibility of the display of frame F1.

In the following, the display status of the display unit 410 at time point P3 is described.

It is noted that the display status of the display unit 410 at time point P3 is denoted as S3 in FIG. 10. At time point P3, the display switching operations started at time point P1 for switching the frame display of the pixel group A from the pattern of frame F0 to the pattern of frame F2 are completed so that the pattern of frame F2 is displayed by the pixel group A in a visually recognizable manner. Also, at time point P3, the pixel group B is in the process of switching its frame display from the pattern of frame F1 to the pattern of frame F3 which display switching operations are started at time point P2, and at this point, neither frame F1 nor frame F3 is displayed in a visually recognizable manner.

Thus, at time point P3, the pattern of frame F2 is displayed on the display unit 410 in a visually recognizable manner. In other words, the display switching operations for switching the frame display of the display unit 410 from the pattern of frame F1 to the pattern of frame F2 are completed at time point P3. It is noted that the display switching time for switching the frame display from the pattern of frame F1 to the pattern of frame F2 is denoted as Tb in FIG. 10.

In the following, the display status of the display unit 410 at time point P4 is described.

At time point P4, the pixel group A is in the process of switching its frame display from the pattern of frame F2 to the pattern on frame F4 which display switching operations are started at time point P3, and at this point neither the pattern of frame F2 nor the pattern of frame F4 is displayed in a visually recognizable manner. Also, at time point P4, the display switching operations of the pixel group B for switching the frame display from the pattern of frame F1 to the pattern of frame F3 are completed so that the pattern of frame F3 is displayed in a visually recognizable manner.

Thus, at time point P4, the pattern of frame F3 is displayed on the display unit 410 in a visually recognizable manner. In other words, the display switching operations of the display unit 410 for switching the frame display from the pattern of frame F2 to the pattern of frame F3 are completed at time point P4.

As can be appreciated from FIG. 10, the display switching time Tb is approximately half the length of the display switching time Ta. It is noted that the display switching time Ta is equal to a total of the scanning time and the pixel pattern switching time and corresponds to the display switching time of the display apparatus 100 according to the prior art.

In the display apparatus 400 according to the present embodiment, aside from the case of switching the frame display from the initial frame to the next frame, the display switching time for switching from one frame to another may be reduced to half the length of the display switching time of the display apparatus 100. In this way, the overall display switching time required for successively switching and displaying plural pages to display a target frame in the display apparatus 400 may be substantially reduced compared to the display apparatus 100 of the prior art.

In the following, the process of successively switching the frame display from the initial frame to the target frame in the display apparatus 400 is described with reference to FIG. 11.

Figure 11:
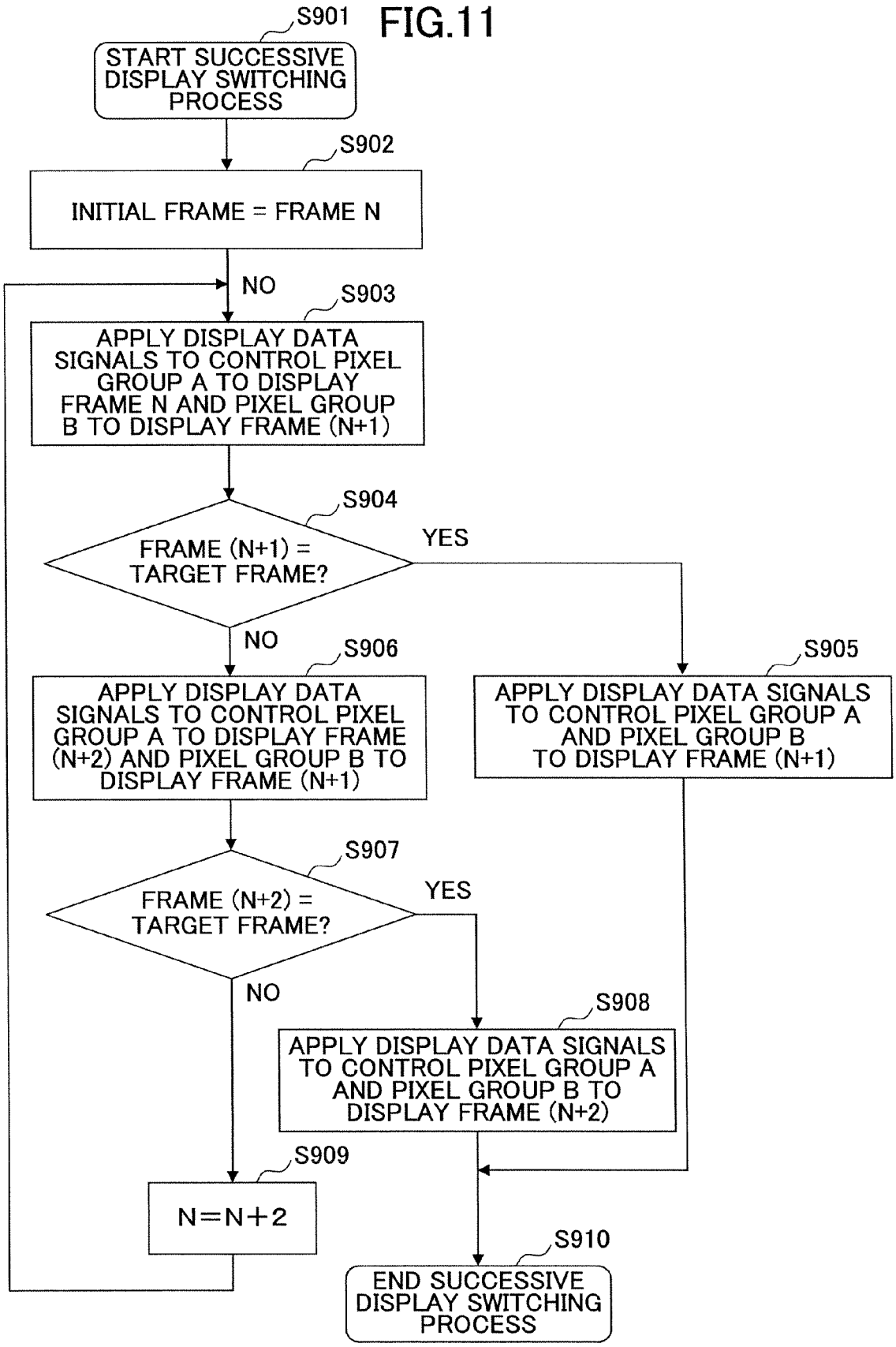
FIG. 11 is a flowchart illustrating a successive display switching process of the display apparatus according to the first embodiment.
Figure 12:
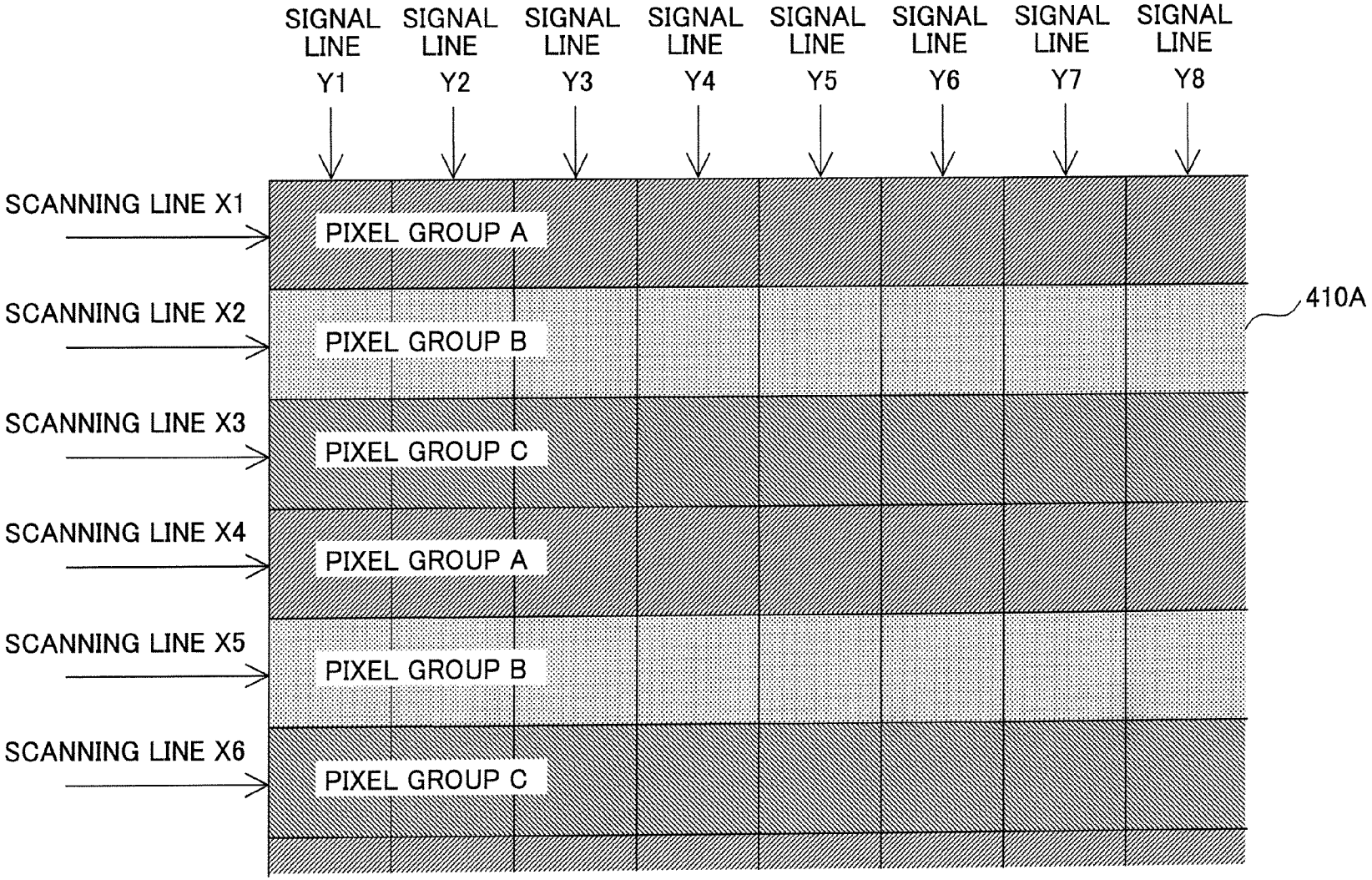
FIG. 12 is a diagram showing a configuration of a display unit of a display apparatus according to a second embodiment of the present invention.

FIG. 11 is a flowchart illustrating a successive display switching process that is performed in the display apparatus 400 of the present embodiment.

According to FIG. 11, the controller 421 of the display apparatus 400 receives a frame display switching command (step S901). In turn, the controller 421 identifies the initial frame that is displayed before successive display switching operations are started as frame N (step S902). Specifically, the controller 421 reads identification information from the memory 422 for identifying the frame order of the frame being displayed before successive display switching operations are started.

Then, the controller 421 applies signals to the scanning lines 106 and the signal lines 107 to control the pixel group A to display the pattern of frame N, and the pixel group B to display the pattern of frame (N+1) (step S903). Specifically, in a case where pixel electrodes 102 positioned on a given scanning line 106 that has its TFTs 105 turned on belongs to the pixel group A, display data signals for displaying frame N are applied to the signal lines 107. On the other hand, in a case where pixel electrodes 102 positioned on a given scanning line 106 that has its TFTs 105 turned on belongs to the pixel group B, display data signals for displaying frame (N+1) are applied to the signal lines 107.

Then, the controller 421 determines whether frame (N+1) corresponds to the target frame (step S904). It is noted that a user may designate one of the plural frames to be displayed as the target frame beforehand via the setting unit 425, for example. In another example, a user may designate the target frame while the successive display switching operations are being performed in which case the frame displayed at the time an interruption command signal for interrupting the display switching operations is input may be determined to be the target frame, for example.

If the frame (N+1) is determined to be the target frame in step S904, the controller 421 applies signals to the scanning lines 106 and the signal lines 107 to control both the pixel groups A and B to display the pattern of frame (N+1) (step S905), and then ends the successive display switching process (step S910). In one embodiment, upon ending the successive display switching process after the display unit 410 reaches the target frame, the control unit 421 may store information indicating the frame that has been determined as the target frame in the memory 422, for example.

On the other hand, if it is determined that the frame (N+1) does not correspond to the target frame in step S904, the controller 421 applies signals to the scanning lines 106 and the signal lines 107 to control the pixel group A to display the pattern of frame (N+2) and the pixel group B to display the pattern of frame (N+1) (step S906).

Then, the controller 421 determines whether the frame (N+2) corresponds to the target frame (step S907). If it is determined in step S907 that the frame (N+2) corresponds to the target frame, the controller 421 applies signals to the scanning lines 106 and the signal lines 107 to control both the pixel groups A and B to display the pattern of frame (N+2) (step S908), and then ends the successive display switching process (step S910).

On the other hand, if it is determined in step S907 that the frame (N+2) does not correspond to the target frame, the controller 421 applies signals to the scanning lines 106 and the signal lines 107 to control the pixel groups A to display the pattern of frame (N+2) and the pixel group B to display the pattern of frame (N+3) (step S909).

In the illustrated process of FIG. 11, steps S903 through S909 are repeated until the target frame is displayed on the display unit 410 of the display apparatus 400.

Second Embodiment

In the following, a display apparatus according to a second embodiment of the present invention is described with reference to the accompanying drawings. It is noted that the display apparatus according to the second embodiment is substantially identical to the above-described display apparatus 400 according to the first embodiment other than the fact that the display apparatus according to the second embodiment has pixel electrodes divided into three different groups rather than two different groups. Thus, in the following descriptions, component elements of the display apparatus according to the second embodiment that are identical to those of the first embodiment are given the same reference numerals and their descriptions are omitted. It is noted that the number of pixel groups into which pixel electrodes are to be divided may be designated beforehand as is described below.

FIG. 10 is a diagram illustrating a display unit 410A of the display apparatus according to the second embodiment.

In the illustrated display unit 410A, the pixel electrodes 102 are divided into three pixel groups, pixel group A, pixel group B, and pixel group C, according to their corresponding scanning lines 106. According to the present embodiment, provided that the scanning lines 106 of the display unit 410A are denoted by Xn (where n is an integer indicating the order of the scanning line), the pixel electrodes 102 positioned on the scanning lines Xn of which n=1+3(k−1) (where k=1, 2, 3, . . . ) belong to the pixel group A. The pixel electrodes 102 positioned on the scanning lines Xn of which n=2+3(k−1) belong to the pixel group B. The pixel electrodes 102 positioned on the scanning lines Xn of which n=3+3(k−1) belong to the pixel group C.

It is noted that by dividing the pixel electrodes 102 of the display unit 410A into pixel groups A, B, and C according to the scanning lines to which they are connected, and controlling the pixel electrodes 102 belonging to the different pixel groups to display differing display data for forming patterns of differing frames, three different frames may be displayed on the display unit 410A at the same time.

Figure 13:
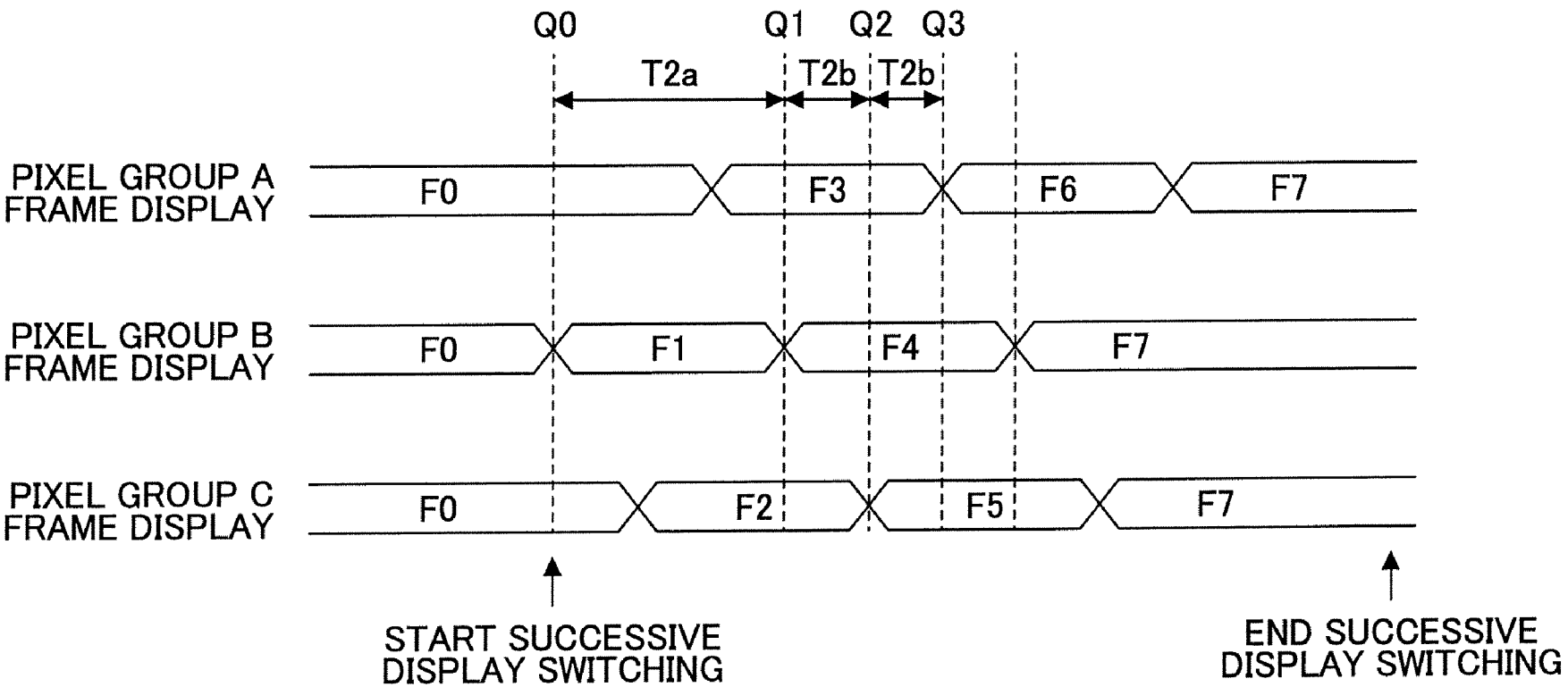
FIG. 13 is a timing chart illustrating display switching operations of the display apparatus according to the second embodiment.
Figure 14:
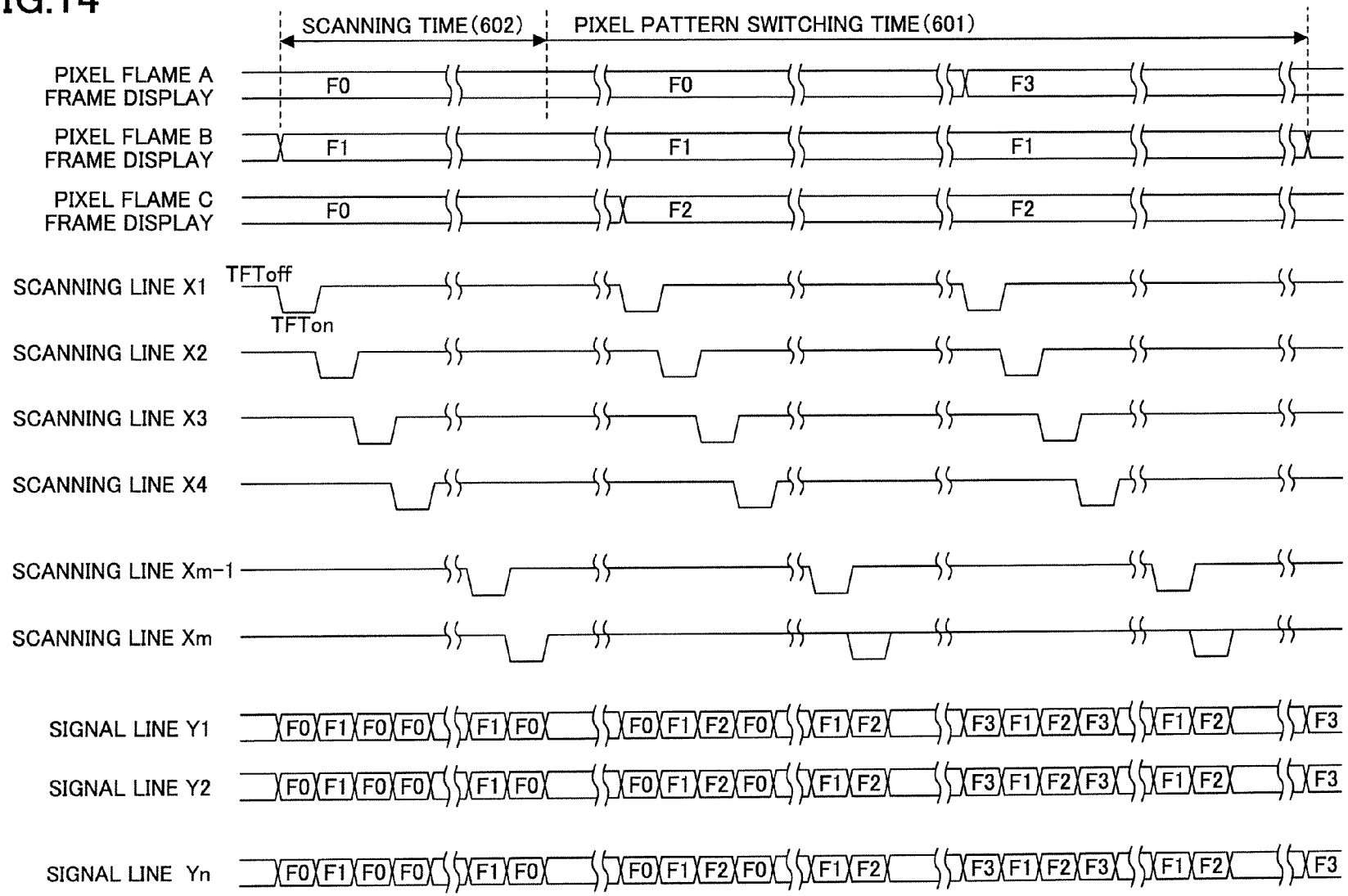
FIG. 14 is a diagram illustrating input signals input to scanning lines and signal lines of the display unit and the display statuses of the display unit corresponding to the timing chart of FIG. 13.

In the following, frame display operations of the display unit 410A are described with reference to FIGS. 13 and 14. FIG. 13 is a timing chart illustrating successive frame display operations by the three pixel groups of the present embodiment. FIG. 14 is a diagram illustrating input signals input to the scanning lines and the signal lines and the display statuses of the display unit according to the timing chart of FIG. 13.

In the following, the display status of the display unit 410A at time point Q0 is described.

At time point Q0, an initial frame F0 is displayed by the display unit 410A. The display unit 410A starts display switching operations for switching the frame display from the initial frame F0 to the next frame F1. In the present example, since the next frame F1 coming after the initial frame F0 is to be displayed by the pixel group B, only the pattern of the frame displayed by the pixel group B is switched at time point Q0.

When display switching operations of the pixel group B are started, display data for forming the pattern of frame F1 are input to the pixel electrodes belonging to pixel group B during a scanning time period 602 as is shown in FIG. 14. In this way display operations for displaying the pattern of frame F1 are started by the pixel electrodes of the pixel group B. It is noted that frame display switching operations for switching the frame display of the pixel groups A and C are not yet started during the scanning time period 602. Thus, display data for forming the pattern of the initial frame F0 continue to be input to the pixel electrodes belonging to pixel groups A and C in the scanning operations performed during the scanning time period 602.

In the following, the display status of the display unit 410A at time point Q1 is described.

At time point Q1, the pixel group A is in the process of switching its frame display from the pattern of frame F0 to the pattern of frame F3. Thus, at this point neither the pattern of frame F0 nor the pattern of frame F3 is displayed by the pixel group A in a visibly recognizable manner. It is noted that the pixel group C is also in the process of switching its frame display from the pattern of frame F0 to the pattern of frame F2 at time point Q1. Thus, neither the pattern of frame F0 nor the pattern of frame F2 is displayed by the pixel group C in a visibly recognizable manner.

On the other hand, at time point Q1, display switching operations for switching the frame display of the pixel group B from the pattern of frame F0 to the pattern of frame F1 are completed so that the pattern of frame F1 is displayed by the pixel group B in a visibly recognizable manner.

Thus, at time point Q1, the pattern of frame F1 is displayed on the display unit 410A in a visibly recognizable manner. In other words, the display switching operations for switching the frame display of the display unit 410A from the pattern of the initial frame F0 to the pattern of the next frame F1 are completed at time point Q1. It is noted that the display switching time for switching the frame display from the pattern of frame F0 to the pattern of frame F1 is denoted by T2*a* in FIG. 13. Also, it is noted that a residual image resulting from the display switching operations of the pixel groups A and C may be displayed in the background of the frame display of frame F1 that is displayed by the pixel group B of the display unit 410A; however, such a residual image may not constitute a substantial factor hampering the visibility of the frame display of frame F1.

In the following, the display status of the display unit 410A at time point Q2 is described.

At time point Q2, the pixel group A is in the process of switching its frame display from the pattern of frame F0 to the pattern of frame F3. Thus, neither frame F0 nor frame F3 is displayed by the pixel group A in a visibly recognizable manner. Also, at time point Q2, the pixel group B is in the process of switching its frame display from the pattern of frame F1 to the pattern of frame F4. Thus, neither frame F1 nor frame F4 is displayed by the pixel group B in a visibly recognizable manner.

On the other hand, at time point Q2, display switching operations for switching the frame display of the pixel group C from the pattern of frame F0 to the pattern of frame F2 are completed so that the pattern of frame F2 is displayed by the pixel group C in a visibly recognizable manner.

Thus, at time point Q2, the pattern of frame F2 is displayed on the display unit 410A in a visibly recognizable manner. In other words, display switching operations for switching the frame display of the display unit 410A from the pattern of frame F1 to the pattern of frame F2 are completed at time point Q2. It is noted that the display switching time for switching the frame display from frame F1 to frame F2 is denoted by T2*b* in FIG. 13.

In the following, the display status of the display unit 410A at time point Q3 is described.

At time point Q3, the pixel group B is in the process of switching its frame display from the pattern of frame F1 to the pattern of frame F4. Thus, at this point, neither frame F1 nor frame F4 is displayed by the pixel group B in a visibly recognizable manner. Also, at time point Q3, the pixel group C is in the process of switching its frame display from the pattern of frame F2 to the pattern of frame F5. Thus, at this point, neither frame F2 nor frame F5 is displayed by the pixel group C in a visibly recognizable manner.

On the other hand, at time point Q3, display switching operations for switching the frame display of the pixel group A from the pattern of frame F0 to the pattern of frame F3 are completed so that the pattern of frame F3 is displayed by the pixel group A in a visibly recognizable manner.

Thus, at time point Q3, the pattern of frame F3 is displayed on the display unit 410A in a visibly recognizable manner. In other words, the display switching operations for switching the frame display of the display unit 410A from the pattern of frame F2 to the pattern of frame F3 are completed at time point Q3.

In the present embodiment, the display switching time T2*b* is approximately one third of the length of the display switching time T2*a*. The display switching time T2*a* is equal to a total of the scanning time and the pixel pattern switching time and corresponds to the display switching time of the display apparatus 100 according to the prior art.

In the display apparatus according to the second embodiment, the display switching time for switching from one frame to another aside from the case of switching from the initial frame to the next frame may be reduced to approximately one third of the length of the display switching time of the display apparatus 100 according to the prior art. In this way, the overall display switching time for the display apparatus of the present embodiment to successively switch plural frames (pages) to display a target frame may be substantially reduced.

Figure 15:
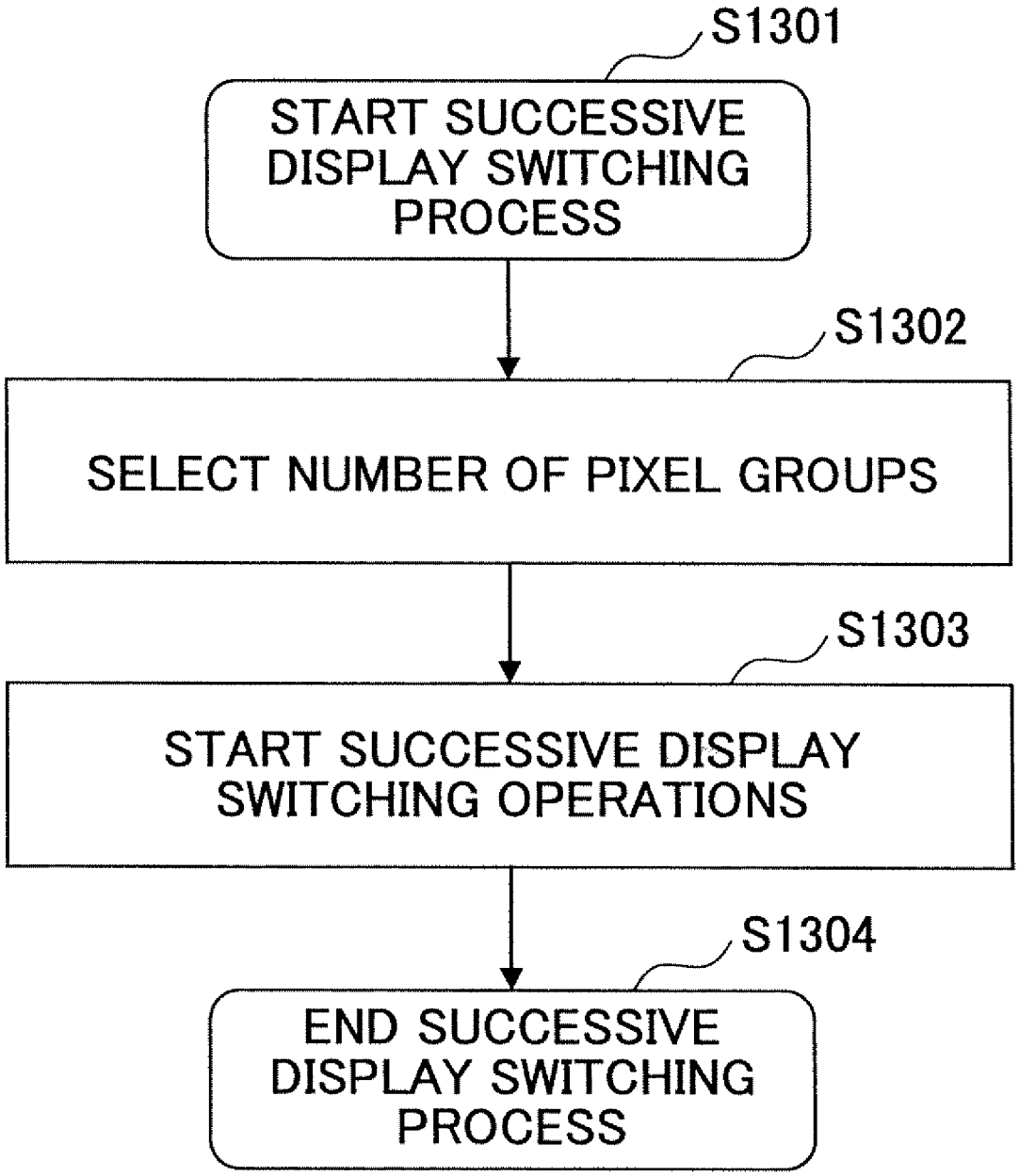
FIG. 15 is a flowchart illustrating operations for determining the number of pixel groups into which pixel electrodes of the display unit are to be divided.

In the following, operations for successively switching and displaying plural frames from an initial frame to a target frame according to the second embodiment are described with reference to FIGS. 15 and 16. FIG. 15 is a flowchart illustrating operations for determining the number of pixel groups into which pixel electrodes are to be divided.

According to FIG. 15, when the display apparatus according to the second embodiment receives a successive display switching process start command signal (step S1301), the number of pixel groups into which the pixel electrodes of the display unit 410A are to be divided may be selected (step S1302).

For example, when the display apparatus according to the present embodiment receives a display switching process start command signal in step S1301, the controller 421 may display a display screen for enabling a user to select the number of pixel groups into which the pixel electrodes of the display unit 410A are to be divided, and the user may select an arbitrary number via the display screen. In another example, plural ways of dividing the pixel electrodes of the display unit 410A may be set by the setting unit 425 beforehand and the setting information may be stored in the memory 422. In this case, the controller 421 may select the number of pixel groups based on the setting information before the display switching process start command signal is input to the display apparatus. It is noted that the display switching time may be reduced as the number of pixel groups is increased.

When the number of pixel groups into which the pixel electrodes are to be divided is selected in step S1302, the display apparatus starts a successive display switching process according to the selected number of pixel groups (step S1303). Then, the display apparatus ends the successive display switching process upon reaching a target frame through successively switching and displaying plural frames (step S1304).

In the following, the successive display switching process of step S1303 is described in detail with reference to FIG. 16. FIG. 16 is a flowchart illustrating the successive display switching process performed by the display apparatus according to the second embodiment.

Figure 16:
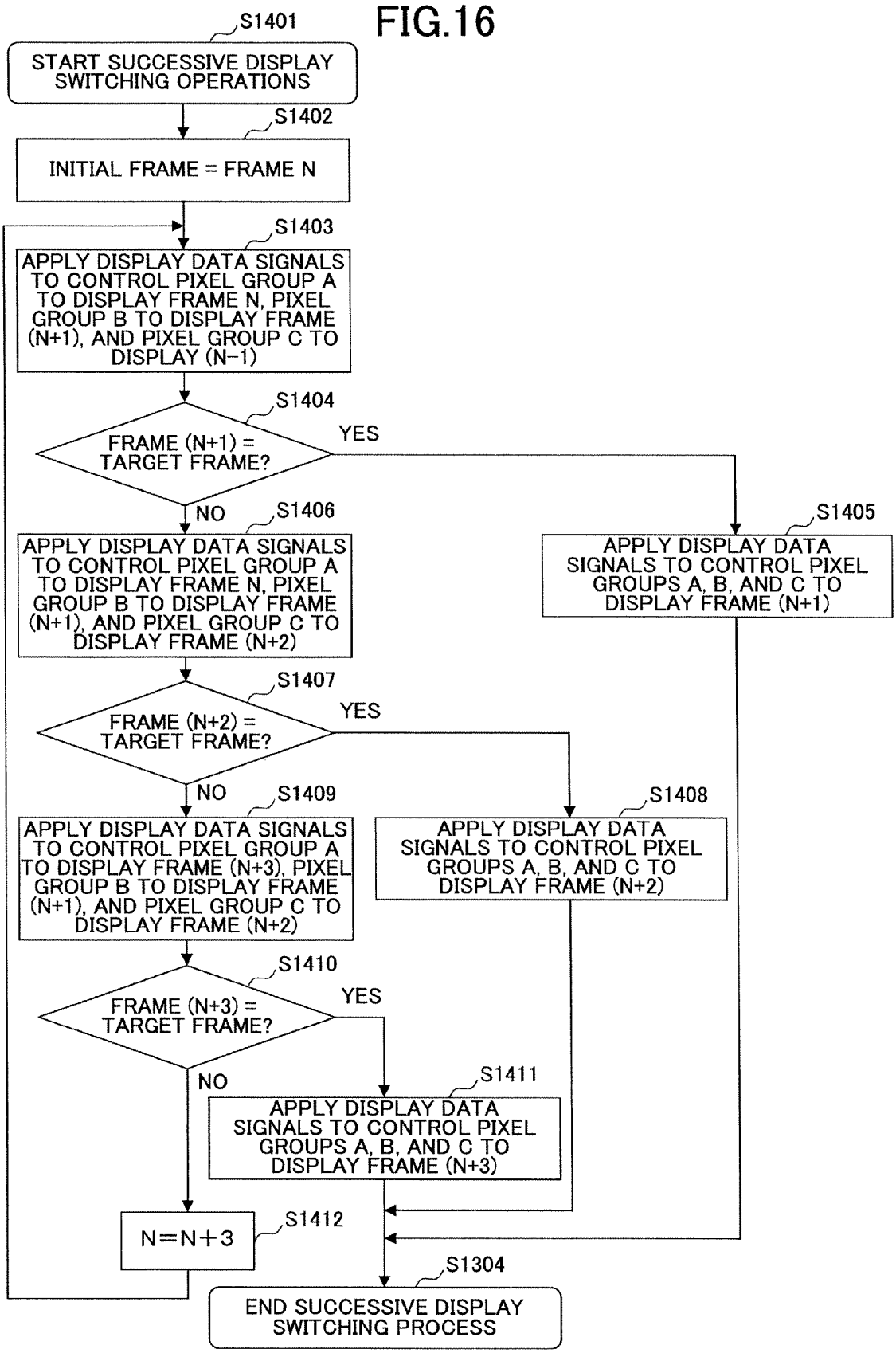
FIG. 16 is a flowchart illustrating a successive display switching process of the display apparatus according to the second embodiment.

According to FIG. 16, the controller 421 of the display apparatus according to the present embodiment starts the successive display switching process upon receiving a successive display switching process start command signal (step S1401). In this case, the controller 421 identifies the initial frame that is displayed before the successive display switching process operations are performed as frame N (step S1402).

The controller 421 applies signals to the scanning lines 106 and the signal lines 107 to control the pixel group A to display the pattern of frame N, the pixel group B to display the pattern of frame (N+1), and the pixel group C to display the pattern of frame (N−1) (step S1403). Specifically, in a case where pixel electrodes 102 positioned on a given scanning line 106 that has its TFTs 105 turned on belongs to the pixel group A, display data signals for displaying frame N are applied to the signal lines 107. In a case where pixel electrodes 102 positioned on a given scanning line 106 that has its TFTs 105 turned on belongs to the pixel group B, display data signals for displaying frame (N+1) are applied to the signal lines 107. In a case where pixel electrodes 102 positioned on a given scanning line 106 that has its TFTs 105 turned on belongs to the pixel group C, display data signals for displaying frame (N−1) are applied to the signal lines 107.

Then, the controller 421 determines whether the frame (N+1) corresponds to a target frame (step S1404). It is noted that a user may designate one of the plural frames to be displayed as the target frame beforehand via the setting unit 425, for example. In another example, a user may designate the target frame while the successive display switching operations are being performed in which case the frame displayed at the time an interruption command signal for interrupting the display switching operations is input may be determined to be the target frame, for example.

If the frame (N+1) is determined to be the target frame in step S1404, the controller 421 applies signals to the scanning lines 106 and the signal lines 107 to control the pixel groups A, B, and C to display the pattern of frame (N+1) (step S1405). In turn, the frame (N+1) is displayed on the display unit 410A, and the successive display switching process is ended (step S1304). In one embodiment, upon ending the successive display switching process after the display unit 410A reaches the target frame, the control unit 421 may store information indicating the frame that has been determined as the target frame in the memory 422, for example.

On the other hand, if it is determined that the frame (N+1) does not correspond to the target frame in step S1404, the controller 421 applies signals to the scanning lines 106 and the signal lines 107 to control the pixel group A to display the pattern of frame N, the pixel group B to display the pattern of frame (N+1), and the pixel group C to display the pattern of frame (N+2) (step S1406).

Then, the controller 421 determines whether the frame (N+2) corresponds to the target frame (step S1407). If it is determined in step S1407 that the frame (N+2) corresponds to the target frame, the controller 421 applies signals to the scanning lines 106 and the signal lines 107 to control the pixel groups A, B, and C to display the pattern of frame (N+2) (step S1408). In turn, the frame (N+2) is displayed on the display unit 410A, and the successive display switching process is ended (step S1304).

On the other hand, if it is determined in step S1407 that the frame (N+2) does not correspond to the target frame, the controller 421 applies signals to the scanning lines 106 and the signal lines 107 to control the pixel group A to display the pattern of frame (N+3), the pixel group B to display the pattern of frame (N+1), and the pixel group C to display the pattern of frame (N+2) (step S1409).

Then, the controller 421 determines whether the frame (N+3) corresponds to the target frame (step S1410). If it is determined in step S1410 that the frame (N+3) corresponds to the target frame, the controller 421 applies signals to the scanning lines 106 and the signal lines 107 to control the pixel groups A, B, and C to display the pattern of frame (N+3) (step S1411). In turn, the frame (N+3) is displayed on the display unit 410A, and the successive display switching process is ended (step S1304).

On the other hand, if it is determined in step S1410 that the frame (N+3) does not correspond to the target frame, the controller 421 sets frame (N+3) as the initial frame (step S1412) and the process goes back to step S1403.

In the illustrated process of FIG. 16, steps S1403 through S1412 are repeated until the target frame is displayed on the display unit 410A.

Third Embodiment

In the following, a third embodiment of the present invention is described with reference to the accompanying drawings. It is noted that a display apparatus according to the third embodiment is identical in configuration to the display apparatus according to the second embodiment, and includes a display unit 410A that divides pixel electrodes into three pixel groups. However, in the third embodiment, the ratio of the number of frames to be displayed by each of the pixel groups to the total number of frames to be displayed by the display unit differs from that of the second embodiment. It is noted that components of the display apparatus according to the third embodiment are given the same reference numerals as those of the display apparatus according to the second embodiment.

In the following, frame display operations of the display unit 410A according to the third embodiment are described.

Figure 17:
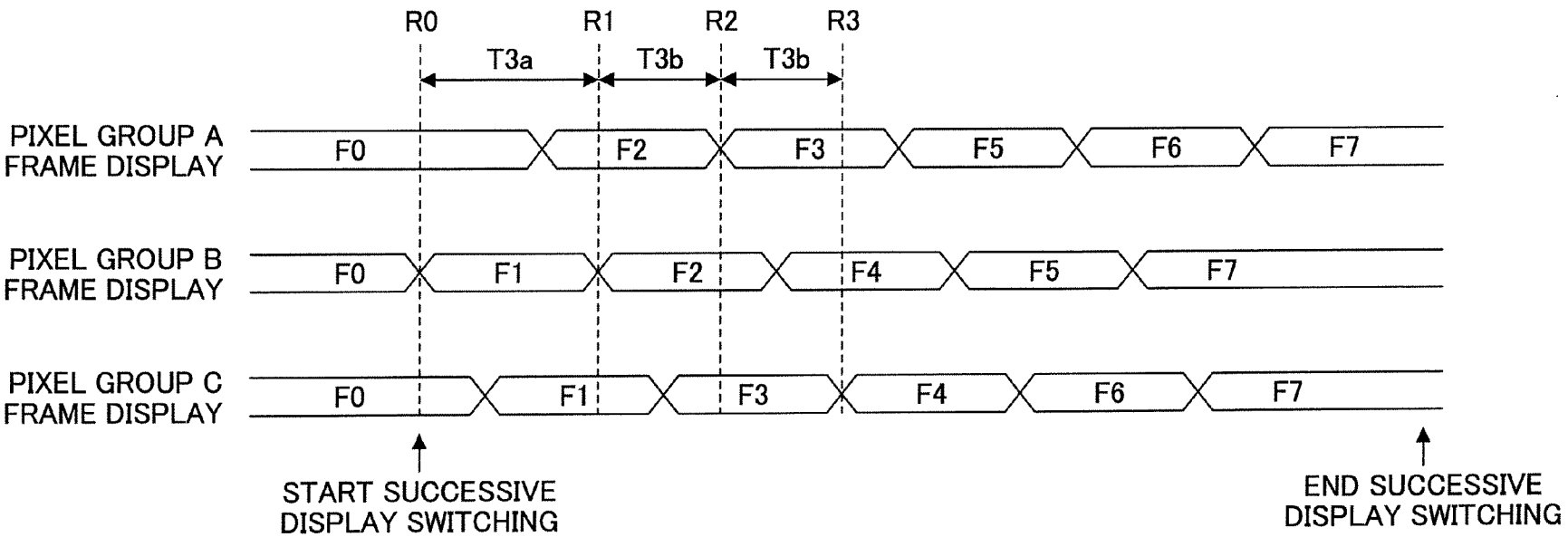
FIG. 17 is a timing chart illustrating display switching operations of a display apparatus according to a third embodiment of the present invention.

FIG. 17 is a timing chart illustrating a process of successively displaying frames using three pixel groups according to the third embodiment.

In the following, the display status of the display unit 410A at time point R0 is described.

At time point R0 of FIG. 17, an initial frame F0 is displayed by the display unit 410A, and the display unit 410A starts display switching operations for switching its frame display from the initial frame F0 to a next frame F1. Since the next frame F1 coming after the initial frame F0 is to be displayed by the pixel group B, only the frame pattern to be displayed by the pixel group B is switched at time point R0.

In the following, the display status of the display unit 410A at time point R1 is described.

At time point R1, the pixel group A is in the process of switching its frame display from the pattern of frame F0 to the pattern of frame F2. Thus, at this point neither frame F0 nor frame F2 is displayed by the pixel group A in a visibly recognizable manner. Also, at time point R1, the pixel group C is in the process of switching its frame display from the pattern of frame F0 to the pattern of frame F1.

On the other hand, at time point R1, display switching operations for switching the frame display of the pixel group B from the pattern of frame F0 to the pattern of frame F1 are completed so that the pattern of frame F1 is displayed by the pixel group B in a visibly recognizable manner. Thus, at time point R1, the pattern of frame F1 is displayed on the display unit 410A in a visibly recognizable manner. In other words, the display switching operations for switching the frame display of the display unit 410A from the pattern of the initial frame F0 to the pattern of the next frame F1 are completed at time point R1.

According to the present embodiment, at time point R1, the pattern of frame F1 is displayed by the pixel group B, and the pattern of frame F1 is about to be displayed by the pixel group C. Thus, the number of pixel electrodes displaying the pattern of frame F1 on the display unit 410A at time point R1 according to the present embodiment is greater than the number of pixel electrodes displaying the pattern of frame F1 on the display unit 410A at time point Q1 according to the second embodiment where the three different pixel groups are each arranged to display differing frame patterns.

Accordingly, the visibility of the pattern of frame F1 displayed by the display unit 410A at time point R1 according to the present embodiment may be improved with respect to the visibility of the pattern of frame F1 displayed by the display unit 410A at time point Q1 according to the second embodiment.

It is noted that the display switching time for switching the frame display from the pattern of frame F0 to the pattern of frame F1 is denoted by T3*a* in FIG. 17. Also, it is noted that a residual image resulting from the display switching operations of the pixel group A may be displayed in the background of the frame display of frame F1 displayed by the pixel group B of the display unit 410A; however, such a residual image may not constitute a substantial factor hampering the visibility of the frame display of frame F1.

In the following, the display status of the display unit 410A at time point R2 is described.

At time point R2, the pixel group B is in the process of switching its frame display from the pattern of frame F1 to the pattern of frame F2. Thus, at this point, neither frame F1 nor frame F2 is displayed by the pixel group B in a visibly recognizable manner. Also, at time point R2, the pixel group C is in the process of switching its frame display from the pattern of frame F1 to the pattern of frame F3. Thus, at this point neither frame F1 nor frame F3 is displayed by the pixel group C in a visibly recognizable manner.

On the other hand, at time point R2, display switching operations for switching the frame display of the pixel group A from the pattern of frame F0 to the pattern of frame F2 are completed so that the pattern of frame F2 is displayed by the pixel group A in a visibly recognizable manner.

According to the present embodiment, at time point R2, the pattern of frame F2 is displayed by the pixel group A, and the pattern of frame F2 is about to be displayed by the pixel group B. Thus, as with the display status of the display unit 410A at time point R1, the number of pixel electrodes displaying the pattern of frame F2 on the display unit 410A at time point R2 according to the present embodiment is greater than the number of pixel electrodes displaying the pattern of frame F2 on the display unit 410A at time point Q2 according to the second embodiment where the three different pixel groups are each arranged to display differing frame patterns.

Accordingly, the visibility of the pattern of frame F2 displayed by the display unit 410A at time point R2 according to the present embodiment may be improved with respect to the visibility of the pattern of frame F2 displayed by the display unit 410A at time point Q2 according to the second embodiment. It is noted that the display switching time for switching the frame display from the pattern of frame F1 to the pattern of frame F2 is denoted by T3*b* in FIG. 17.

In the following, the display status of the display unit 410A at time point R3 is described.

At time point R3, the pixel group A is in the process of switching its frame display from the pattern of frame F2 to the pattern of frame F3. Thus, at this point, neither frame F2 nor frame F3 is displayed by the pixel group A in a visibly recognizable manner. Also, at time point R3, the pixel group B is in the process of switching its frame display from the pattern of frame F2 to the pattern of frame F4. Thus, at this point, neither frame F2 nor frame F4 is displayed by the pixel group B in a visibly recognizable manner.

On the other hand, at time point R3, display switching operations for switching the frame display of the pixel group C from the pattern of frame F1 to the pattern of frame F3 are completed so that the pattern of frame F3 is displayed by the pixel group C in a visibly recognizable manner.

Thus, at time point R3, the pattern of frame F3 is displayed by the pixel group C, and the pattern of frame F3 is about to be displayed by the pixel group A. In other words, as with the display status of the display unit 410A at time point R1, the number of pixel electrodes displaying the pattern of frame F3 on the display unit 410A at time point R3 according to the present embodiment is greater than the number of pixel electrodes displaying the pattern of frame F3 on the display unit 410A at time point Q3 according to the second embodiment in which the three different pixel groups are each arranged to display differing frame patterns.

Accordingly, the visibility of the pattern of frame F3 displayed by the display unit 410A at time point R3 according to the present embodiment may be improved with respect to the visibility of the pattern of frame F3 displayed by the display unit 410A at time point Q3 according to the second embodiment. It is noted that the display switching time for switching the frame display from the pattern of frame F2 to the pattern of frame F3 is also denoted by T3*b* in FIG. 17.

In the present embodiment, the length of the display switching time T3*b* is equal to approximately two thirds of the length of the display switching time T3*a*. The display switching time T3*a* is equal to a total of the scanning time and the pixel pattern switching time and corresponds to the display switching time of the display apparatus 100 according to the prior art.

As can be appreciated from the above descriptions, in the present embodiment, the display switching time for switching from one frame to the next frame aside from the case of switching from the initial frame to the next frame may be reduced to approximately two thirds of the length of the display switching time of the display apparatus 100 according to the prior art. It is noted that although the display switching time in the present embodiment is longer than that of the second embodiment, visibility of the frame pattern being displayed by the display unit 410A may be improved.

In the following, the ratio of the number of frames to be displayed by each of the pixel groups to the total number of frames to be displayed by the display unit is described.

In the first embodiment, the pixel electrodes 102 are divided into two pixel groups, and the pixel groups are each arranged to display differing frame patterns (e.g., the pixel groups A is arranged to display even-numbered frames and the pixel group B is arranged to display odd-numbered frames in the above illustrated example). Therefore, the ratio of the number of frames to be displayed by each of the pixel groups to the total number of frames to be displayed by the display unit is equal to ½. In the second embodiment, the pixel electrodes 102 are divided into three pixel groups, and the three pixel groups are each arranged to display differing frame patterns. Therefore, the ratio of the number of frames to be displayed by each of the pixel groups to the total number of frames to be displayed by the display unit is equal to ⅓.

In the third embodiment, the pixel electrodes 102 are divided into three pixel groups, and two of the three pixel groups are arranged to display the same frame at the same time. Therefore, the ratio of the number of frames to be displayed by each of the pixel groups to the total number of frames to be displayed by the display unit is equal to ⅔. It is noted that the visibility of the frame pattern being displayed may be improved as the value of this ratio is increased.

Figure 18:
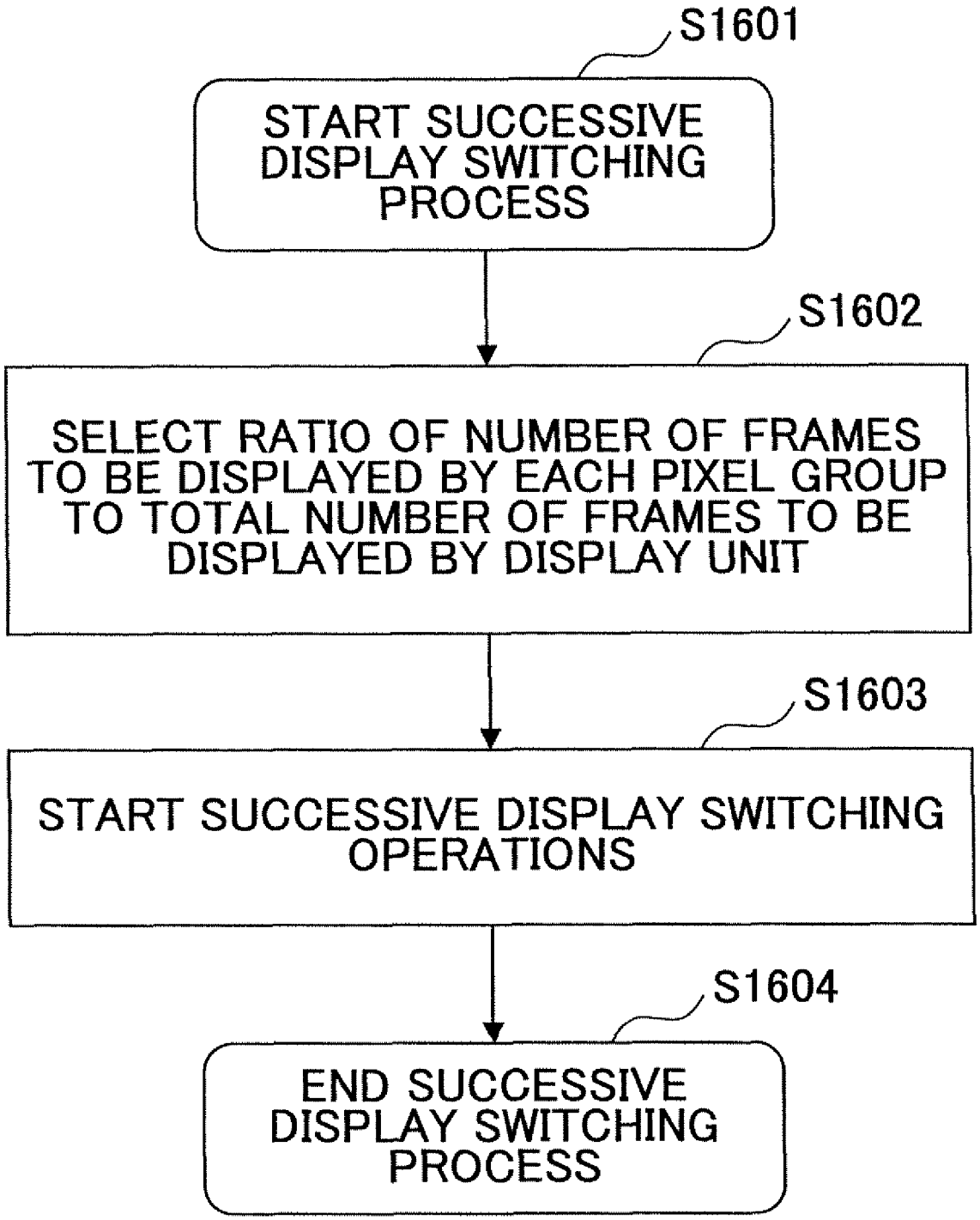
FIG. 18 is a flowchart illustrating operations for determining the ratio of the number of frames to be displayed by each pixel group to the total number of frames to be displayed by the display unit of the display apparatus according to the third embodiment.

In the following, operations for successively switching and displaying plural frames from an initial frame to a target frame according to the third embodiment are described with reference to FIGS. 18 and 19. FIG. 18 is a flowchart illustrating operations for determining the ratio of the number of frames to be displayed by each of the pixel groups to the total number of frames to be displayed by the display unit.

According to FIG. 18, when a successive display switching process start command signal is input to the display apparatus (step S1601), the ratio of the number of frames to be displayed by each of the pixel groups to the total number of frames to be displayed by the display unit is selected (step S1602).

For example, plural ratios may be stored in the memory 422 beforehand, and when a display switching process start command signal is input in step S1601, the controller 421 may display a display screen for enabling a user to select a preferred ratio, and the user may select an arbitrary number using the setting unit 425. In another example, plural ratios may be stored in the memory 422, and the controller 421 may be configured to select a suitable ratio.

When the ratio is selected in step S1602, the display apparatus starts a successive display switching process according to the selected ratio (step S1603). Then, the display apparatus ends the successive display switching process upon reaching a target frame through successively switching and displaying plural frames (step S1604).

In the following, the successive display switching process of step S1603 is described in detail with reference to FIG. 19. FIG. 19 is a flowchart illustrating the successive display switching process performed by the display apparatus according to the third embodiment.

Figure 19:
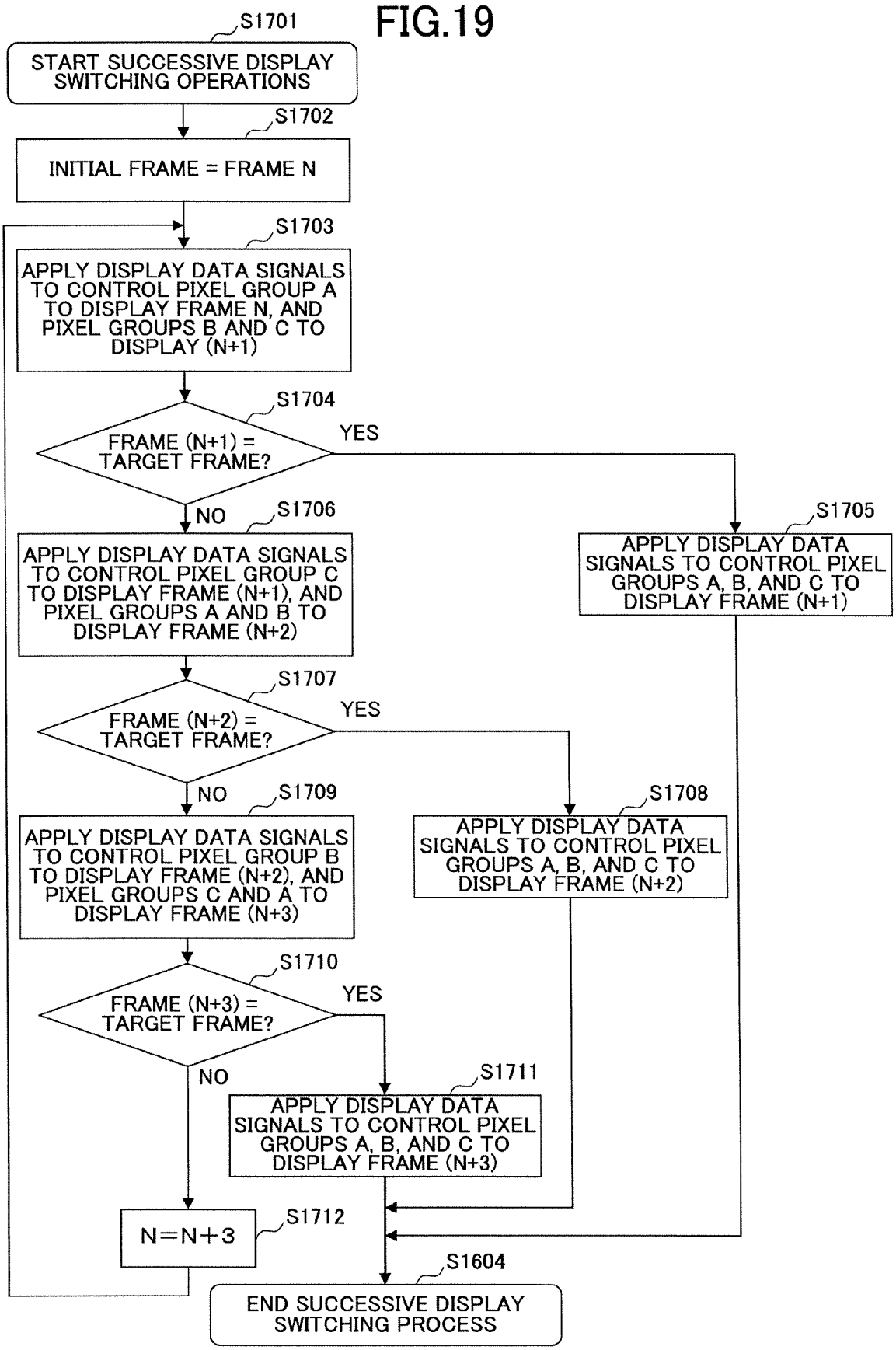
FIG. 19 is a flowchart illustrating a successive display switching process of the display apparatus according to the third embodiment.

According to FIG. 19, the controller 421 of the display apparatus according to the present embodiment starts the successive display switching process upon receiving a successive display switching process start command signal (step S1701). In this case, the controller 421 identifies the initial frame that is displayed before the successive display switching process operations are performed as frame N (step S1702).

Then, the controller 421 applies signals to the scanning lines 106 and the signal lines 107 to control the pixel group A to display the pattern of frame N, and the pixel groups B and C to display the pattern of frame (N+1) (step S1703). Specifically, in a case where pixel electrodes 102 positioned on a given scanning line 106 that has its TFTs 105 turned on belongs to the pixel group A, display data signals for displaying frame N are applied to the signal lines 107. In a case where pixel electrodes 102 positioned on a given scanning line 106 that has its TFTs 105 turned on belongs to the pixel group B or C, display data signals for displaying frame (N+1) are applied to the signal lines 107.

Then, the controller 421 determines whether the frame (N+1) corresponds to a target frame (step S1704). It is noted that a user may designate one of the plural frames to be displayed as the target frame beforehand via the setting unit 425, for example. In another example, a user may designate the target frame while the successive display switching operations are being performed in which case the frame displayed at the time an interruption command signal for interrupting the display switching operations is input may be determined to be the target frame, for example.

If the frame (N+1) is determined to be the target frame in step S1704, the controller 421 applies signals to the scanning lines 106 and the signal lines 107 to control the pixel groups A, B, and C to display the pattern of frame (N+1) (step S1705). In turn, the frame (N+1) is displayed on the display unit 410A, and the successive display switching process is ended (step S1604). In one embodiment, upon ending the successive display switching process after the display unit 410A reaches the target frame, the control unit 421 may store information indicating the frame that has been determined as the target frame in the memory 422, for example.

On the other hand, if it is determined that the frame (N+1) does not correspond to the target frame in step S1704, the controller 421 applies signals to the scanning lines 106 and the signal lines 107 to control the pixel groups A and B to display the pattern of frame (N+2) and the pixel group C to display the pattern of frame (N+1) (step S1706).

Then, the controller 421 determines whether the frame (N+2) corresponds to the target frame (step S1707). If it is determined in step S1407 that the frame (N+2) corresponds to the target frame, the controller 421 applies signals to the scanning lines 106 and the signal lines 107 to control the pixel groups A, B, and C to display the pattern of frame (N+2) (step S1708). In turn, the frame (N+2) is displayed on the display unit 410A, and the successive display switching process is ended (step S1604).

On the other hand, if it is determined in step S1707 that the frame (N+2) does not correspond to the target frame, the controller 421 applies signals to the scanning lines 106 and the signal lines 107 to control the pixel groups A and C to display the pattern of frame (N+3) and the pixel group B to display the pattern of frame (N+2) (step S1709).

Then, the controller 421 determines whether the frame (N+3) corresponds to the target frame (step S1710). If it is determined in step S1710 that the frame (N+3) corresponds to the target frame, the controller 421 applies signals to the scanning lines 106 and the signal lines 107 to control the pixel groups A, B, and C to display the pattern of frame (N+3) (step S1711). In turn, the frame (N+3) is displayed on the display unit 410A, and the successive display switching process is ended (step S1604).

On the other hand, if it is determined in step S1710 that the frame (N+3) does not correspond to the target frame, the controller 421 sets frame (N+3) as the initial frame (step S1712) and the process goes back to steps S1703.

In the illustrated process of FIG. 19, steps S1703 through S1712 are repeated until the target frame is displayed on the display unit 410A.

As can be appreciated from the above descriptions, according to the present embodiment, the display switching time may be reduced in the case of successively switching and displaying plural frames.

Fourth Embodiment

In the following a fourth embodiment of the present invention is described with reference to FIG. 20.

Figure 20:
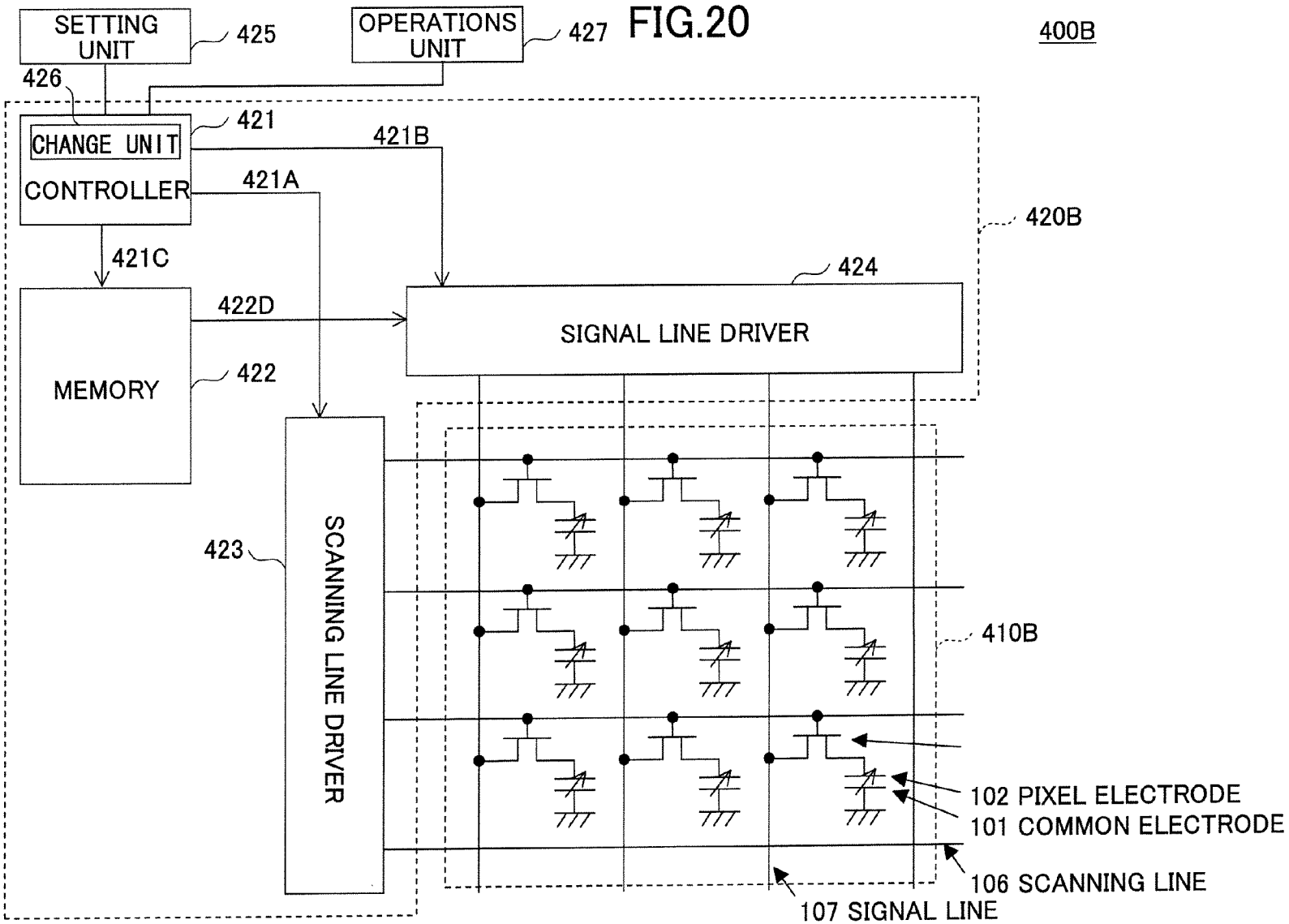
FIG. 20 is a block diagram showing a configuration of a display apparatus according to a fourth embodiment of the present invention.

FIG. 20 is a block diagram showing a configuration of a display apparatus 400B according to the fourth embodiment of the present invention. It is noted that components of the display apparatus 400B that are identical to those of the display apparatus according to the first embodiment are given the same reference numerals.

The illustrated display apparatus 400 includes a display unit 410B that uses electrophoretic elements and a drive unit 420B that drives the display unit 410B. The display apparatus 400B according to the present embodiment may be used for displaying plural pages of an electronic book, for example. The display apparatus 400B may successively switch a page being displayed on the display unit 410B as if to turn the pages of a book, for example.

The drive unit 420B includes a controller 421, a memory 422, a scanning line driver 423, a signal line driver 424, a setting unit 425, and an operations unit 427.

The controller 421 administers overall display control operations of the display unit 410B. Also, the controller 421 includes a change unit 426 for changing the number of pixel groups into which pixel electrodes 102 of the display unit 410B are divided. The memory 422 may store information of plural frames to be displayed on the display unit 410, display data for each pixel electrode forming the pattern of each frame, and identification information for identifying the frame currently being displayed on the display unit 410 of the plural frames, for example.

The scanning line driver 423 scans the scanning lines 106 based on a scanning command signal output from the controller 421. The signal line driver 424 outputs display data to the pixel electrodes 102 connected to the TFT 105 that are turned on based on a display command signal output from the controller 421. The setting unit 425 performs various setting operations within the display apparatus 400. Also, the display apparatus 400B may be operated using the operations unit 427.

In the following, operations of the display apparatus 400 are described.

When a user inputs a display command to the display apparatus 400B via the operations unit 427, the controller 421 outputs a scanning command signal 421A to the scanning line driver 423. The scanning line driver 423 receives the scanning command signal 421A and successively applies voltages to the scanning lines 106 in order to apply voltages to the TFTs 105 connected to the scanning lines 106.

Also, the controller 421 outputs a display command signal 421B to the signal line driver 423 and an addressing signal 421C to the memory 422 in response to the user display command. Upon receiving the addressing signal 421C, the memory 422 extracts display data 422D for the pixels forming the patterns of the frames to be displayed based on the addressing signal 421C, and outputs the extracted display data 422D for the pixels to the signal line driver 423.

The signal line driver 424 receives the display command signal 421B from the controller 421 and applies voltages to the signal lines 107 to have the display data received from the memory 422 displayed by the pixel electrodes 102 connected to the TFTs 105 that are turned on.

Figure 21:
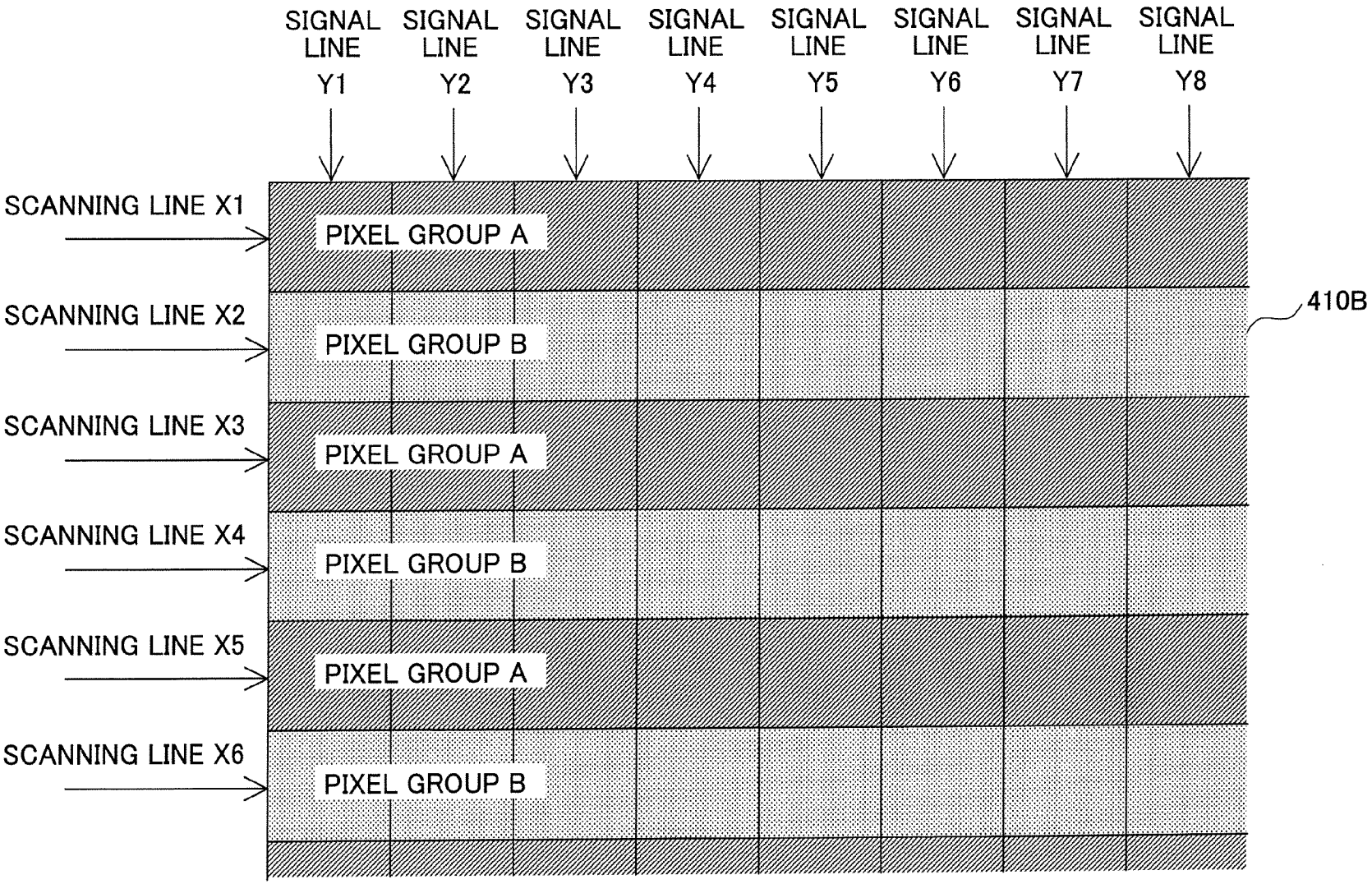
FIG. 21 is a diagram showing an exemplary manner in which pixel electrodes are divided into two pixel groups in a display unit of the display apparatus according to the fourth embodiment.

In the following, display operations by the display unit 410B are described with reference to FIG. 21. FIG. 21 is a diagram illustrating the display unit 410B of the display apparatus 400B according to the present embodiment.

The display unit 410B has pixel electrodes 102 that are divided into two groups, pixel group A and pixel group B, according to the scanning lines 106 to which they are connected. Specifically, in the present example, the scanning lines 106 of the display unit 410B are denoted as X1-X6, and the pixel electrodes 102 connected to the odd-numbered scanning lines X1, X3, and X5 belong to the pixel group A, whereas the pixel electrodes 102 connected to the even-numbered scanning lines X2, X4, and X6 belong to the pixel group B.

By dividing the pixel electrodes 102 into those belonging to pixel group A and those belonging to pixel group B as is described above, and having the pixel groups display differing display data for representing patterns of differing frames, two different frames may be displayed by the display unit 410B at the same time.

It is noted that display control of the pixel groups may be performed by the controller 421 based on information set by the setting unit 425, for example.

The setting unit 425 may set information specifying the pixel group that is to display a given frame of the plural frames stored in the memory 422, for example. The controller 421 may control operations for outputting display data to be displayed by the pixel electrodes 102 of the pixel groups based on the information set by the setting unit 425, for example.

In one specific example, the setting unit 425 may set information specifying that even-numbered frames of the plural frames stored in the memory 422 are to be displayed by the pixel group A and odd-numbered frames of the plural frames are to be displayed by the pixel group B. In this case, the controller 421 controls operations so that display data for representing an even-numbered frame are output to and displayed by the pixel electrodes 102 belonging to the pixel group A that are connected to the TFTs 105 turned on by the scanning operations of the scanning line driver 423. Also, the controller 421 controls operations so that display data for representing an odd-numbered frame are output to and displayed by the pixel electrodes 102 belonging to the pixel group B that are connected to the TFTs 105 turned on by the scanning operations.

It is noted that in the above-illustrated example, the pixel electrodes 102 are divided into pixel groups according to their corresponding scanning lines 106; however, the manner in which the pixel electrodes 102 are divided is not limited to the above example. In alternative examples, the pixel electrodes 102 may be divided according to their corresponding signal lines 107, or the pixel electrode 102 belonging to different pixel groups may be divided and scattered across the display unit 410 regardless of their corresponding scanning lines 106 or signal lines 107.

Figure 22A:
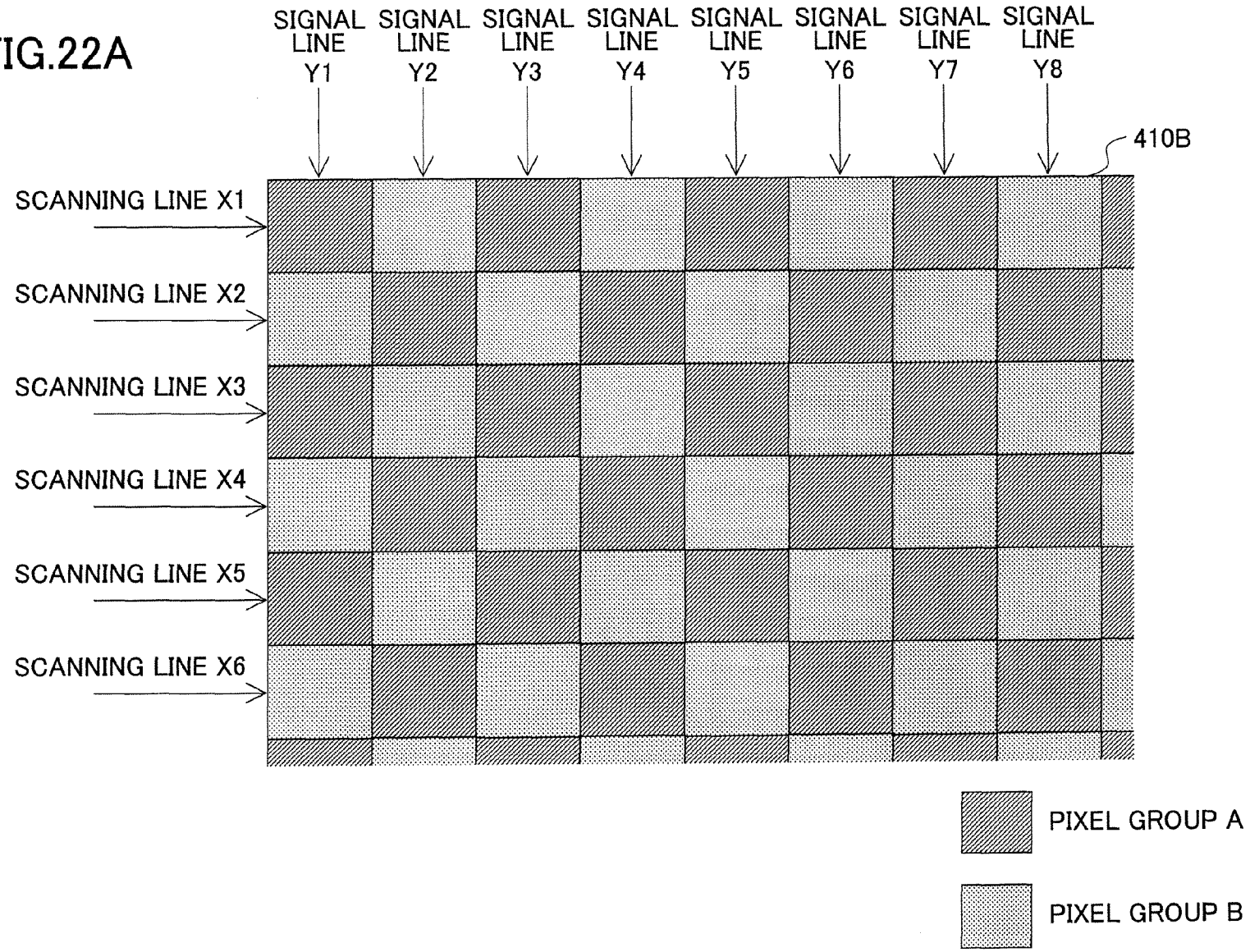
FIGS. 22A and 22B are diagrams showing other exemplary manners in which the pixel electrodes are divided into two pixel groups in the display unit according to the fourth embodiment.
Figure 22B:
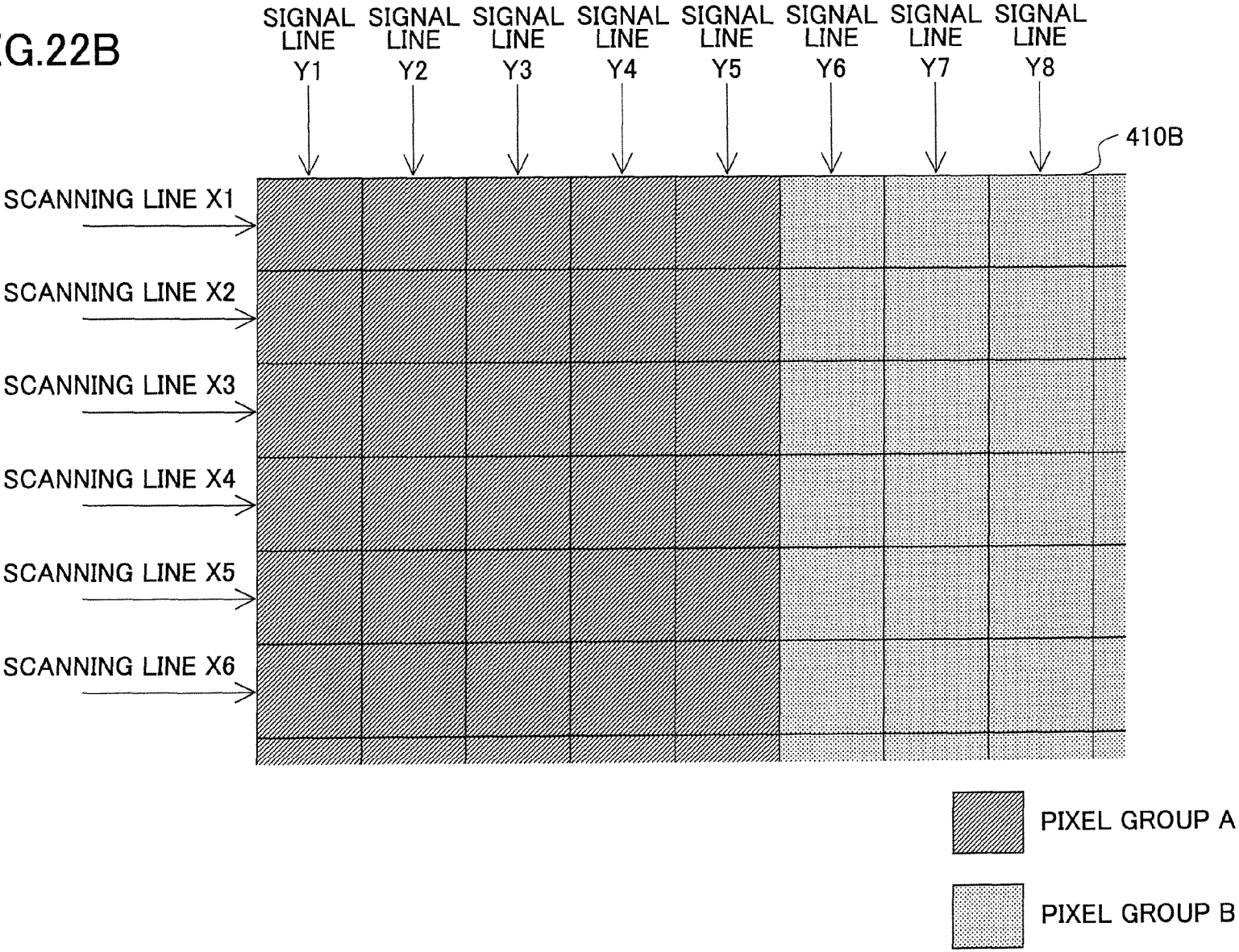

FIGS. 22A and 22B are diagrams illustrating other exemplary ways in which the pixel electrodes 102 may be divided into two pixel groups. In one example as is shown in FIG. 22A, the pixel electrodes 102 of the display unit 410B may be divided so that the pixel electrodes of pixel group A and the pixel electrodes of group B are arranged into a matrix structure. In another example as is shown in FIG. 22B, the pixel electrodes 102 of the display unit 410B may be divided so that pixel electrodes on the left side belong to the pixel group A and pixel electrodes on the right side belong to the pixel group B. It is noted that the manner in which the pixel electrodes 102 are divided may be set by the setting unit 425, for example.

Also, in the display apparatus 400B according to the present embodiment, output timings for outputting display data to be displayed by the pixel electrodes 102 belonging to the different groups may be independently controlled so that the start timings of display operations for displaying two frames may be independently controlled.

For example, operations for displaying a given frame by the pixel group A (as a first pixel group) may be started first after which operations for displaying another frame by the pixel group B (as a second pixel group) may be started before the frame display operations of the pixel group A are completed. In this way, the display switching time required for completing frame display operations for displaying plural frames from the first frame to the last frame may be reduced in the case of successively switching and displaying the plural frames on the display unit 410B.

In the following, the successive display switching process for displaying plural frames on the display unit 410B is described with reference to FIGS. 23-25.

Figure 23:
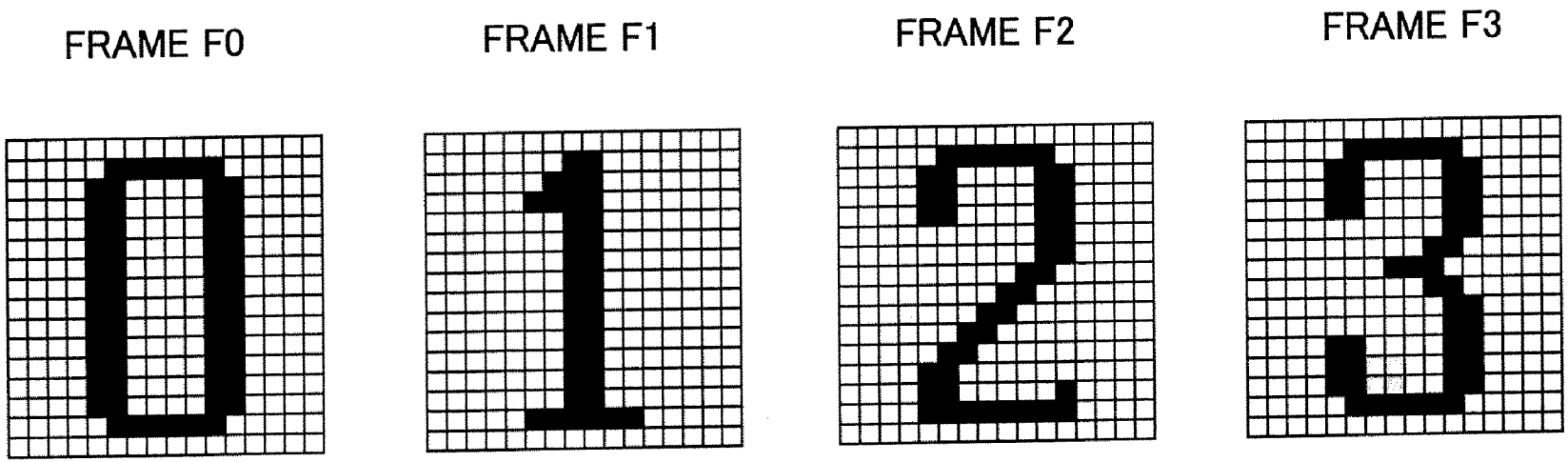
FIG. 23 is a diagram showing exemplary frames that may be displayed by the display apparatus according to the fourth embodiment.

FIG. 23 is a diagram showing exemplary frame patterns to be displayed on the display unit 410B. FIG. 24 is a timing chart illustrating a process of displaying the frame patterns using two pixel groups. FIG. 25 is a diagram illustrating input signals input to the scanning lines and signal lines and the display statuses of the display unit 410B in accordance with the timing chart of FIG. 24.

Figure 24:
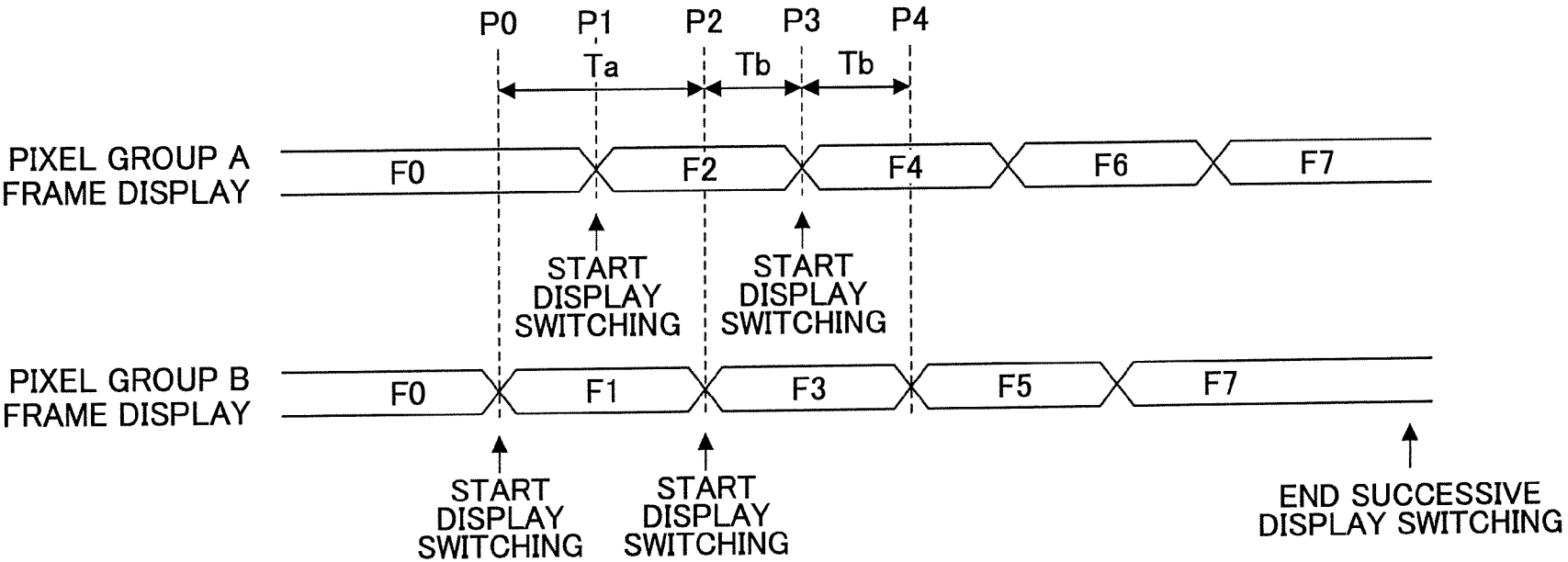
FIG. 24 is a timing chart illustrating display switching operations using two pixel groups that are performed by the display apparatus according to the fourth embodiment.
Figure 25:
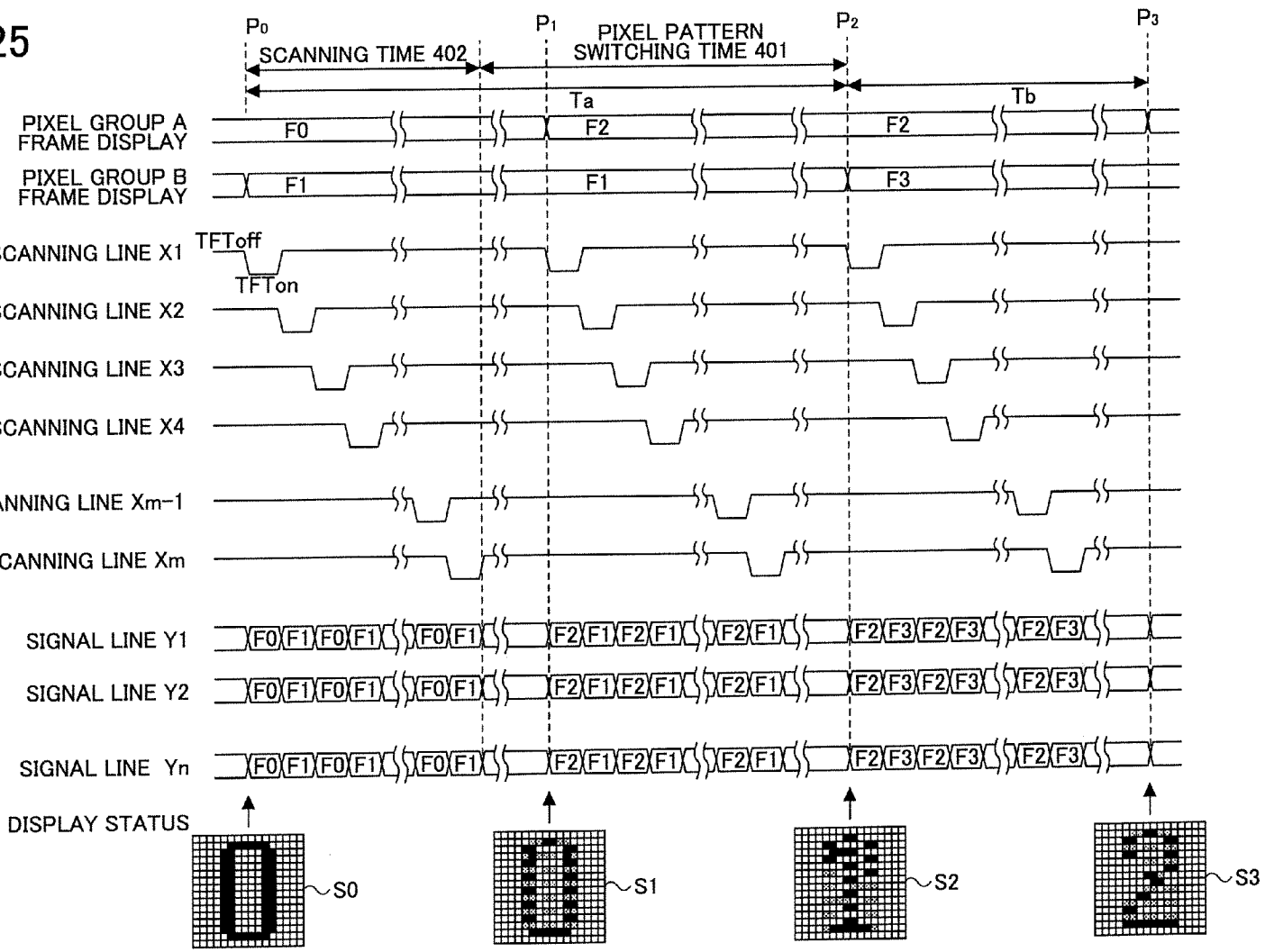
FIG. 25 is a diagram illustrating input signals input to scanning lines and signal lines of the display unit and the display statuses of the display unit corresponding to the timing chart of FIG. 23.

It is noted that in FIGS. 24 and 25, the plural frames to be successively displayed are denoted as Fx where x is a number indicating the order of the plural frames.

Also, it is noted that frame F0 corresponds to an initial frame (first frame) to be displayed on the display unit 410B at an initial stage before the successive display switching process is started and frame F7 corresponds to a target frame (last frame) that is to be displayed at the end of the successive display switching process.

Referring to FIG. 24, when the display apparatus 400B receives a display switching command at time point P0, display switching operations are started for switching the frame displayed on the display unit 410B from frame F0 to frame F1.

In this case, it is assumed that the initial frame F0, the target frame F7, and the even-numbered frames F2, F4, and F6 are to be displayed by the pixel group A; and the initial frame F0, the target frame F7, and the odd-numbered frames F1, F3, and F5 are to be displayed by the pixel group B. In the display unit 410B, the timings at which voltages are applied to the pixel electrodes 102 belonging to the pixel groups are varied based on the scanning timings of the scanning lines 106. When the timings at which voltages are applied to the pixel electrodes 102 vary, the timings at which the white electrophoretic elements and the black electrophoretic elements start moving within the pixel electrodes may vary depending on each pixel electrode. Therefore, the timings at which moving operations of the white electrophoretic elements and the black electrophoretic elements are completed and the timings at which display data display operations are completed may vary depending on each pixel electrode. The display apparatus 400B according to the present embodiment may use such timing variations to have the pixel group A display a frame pattern and the pixel group B display another frame pattern at alternating timings so that the overall display switching time for displaying frames from frame F0 to F7 may be reduced, for example.

As can be appreciated from FIG. 24, when the display apparatus 400B receives a display switching command at time point P0, display switching operations are started by performing scanning operations for a scanning time period 402 as is shown in FIG. 25.

In the following, the display status of the display unit 410B at time point P0 is described.

At time point P0, the initial frame F0 is displayed at the display unit 410B. Such a display status of the display unit 410 is denoted as S0 in FIG. 25. The display unit 410B starts switching operations for switching the frame display from the initial frame F0 to the next frame F1. In this case, since the next frame F1 coming after the initial frame F0 is to be displayed by the pixel group B, only the frame displayed by the pixel group B is switched at time point P0.

Specifically, when display switching operations are started at time point P0, display data for forming the pattern of frame F1 are input to the pixel electrodes 102 belonging to the pixel group B over the scanning time period 402 and display operations for displaying the pattern of frame F1 are started by the pixel group B. It is noted that switching operations for switching the frame displayed by the pixel group A are not yet started during the scanning operations performed over the scanning time period 402. Thus, display data for forming the pattern of the initial frame F0 continues to be input to the pixel group A during the scanning time period 402.

In the following, the display status of the display unit 410B at time point P1 is described.

It is noted that the display status of the display unit 410B at time point P1 is denoted as S1 in FIG. 25. At time point P1, display switching operations for switching the frame display of the pixel group A from the pattern of frame F0 to the pattern of frame F2 are started, and at this point, the pattern of F0 is still displayed by the pixel group A in visually recognizable manner. Also, at time point P1, the pixel group B is in the process of switching its frame display from the pattern of frame F0 to the pattern of frame F1, and at this point neither frame F0 nor frame F1 is displayed by the pixel group B in a visually recognizable manner. Thus, at time point P1, the pattern of frame F0 is displayed on the display unit 410B in a visually recognizable manner.

In the following, the display status of the display unit 410B at time point P2 is described.

It is noted that the display status of the display unit 410B at time point P2 is denoted as S2 in FIG. 25. At time point P2, the pixel group A is in the process of switching its frame display from the pattern of frame F0 to the pattern of frame F2, and neither of the frames is displayed in a visually recognizable manner. Also, at time point P2, the display switching operations for switching the frame display of the pixel group B from the pattern of frame F0 to the pattern of frame F1 are completed so that the pattern of frame F1 is displayed in a visually recognizable manner by the pixel group B.

Thus, at time point P2, the pattern of frame F1 is displayed on the display unit 410B in a visually recognizable manner. In other words, display switching operations for switching the frame display of the display unit 410B from the pattern of the initial frame F0 to the pattern of the next frame F1 are completed at time point P2. It is noted that the display switching time for switching the frame display from the pattern of frame F0 to the pattern of frame F1 is denoted as Ta in FIG. 25. Also, it is noted that at this point, a residual image resulting from the display switching operations of the pixel group A may be displayed in the background of the frame display of the pattern of frame F1 displayed by the pixel group B of the display unit 410B. However, such a residual image may not constitute a substantial factor hampering the visibility of the display of frame F1.

In the following, the display status of the display unit 410B at time point P3 is described.

It is noted that the display status of the display unit 410B at time point P3 is denoted as S3 in FIG. 25. At time point P3, the display switching operations started at time point P1 for switching the frame display of the pixel group A from the pattern of frame F0 to the pattern of frame F2 are completed so that the pattern of frame F2 is displayed by the pixel group A in a visually recognizable manner. Also, at time point P3, the pixel group B is in the process of switching its frame display from the pattern of frame F1 to the pattern of frame F3 which display switching operations are started at time point P2, and at this point, neither frame F1 nor frame F3 is displayed in a visually recognizable manner.

Thus, at time point P3, the pattern of frame F2 is displayed on the display unit 410B in a visually recognizable manner. In other words, the display switching operations for switching the frame display of the display unit 410B from the pattern of frame F1 to the pattern of frame F2 are completed at time point P3. It is noted that the display switching time for switching the frame display from the pattern of frame F1 to the pattern of frame F2 is denoted as Tb in FIG. 25.

In the following, the display status of the display unit 410B at time point P4 is described.

At time point P4, the pixel group A is in the process of switching its frame display from the pattern of frame F2 to the pattern on frame F4 which display switching operations are started at time point P3, and at this point, neither frame F2 nor frame F4 is displayed in a visually recognizable manner. Also, at time point P4, the display switching operations of the pixel group B for switching the frame display from the pattern of frame F1 to the pattern of frame F3 are completed so that the pattern of frame F3 is displayed by the pixel group B in a visually recognizable manner.

Thus, at time point P4, the pattern of frame F3 is displayed on the display unit 410B in a visually recognizable manner. In other words, the display switching operations of the display unit 410B for switching the frame display from the pattern of frame F2 to the pattern of frame F3 are completed at time point P4.

As can be appreciated from FIG. 25, the display switching time Tb is approximately half the length of the display switching time Ta. It is noted that the display switching time Ta is equal to a total of the scanning time and the pixel pattern switching time and corresponds to the display switching time of the display apparatus 100 according to the prior art.

In the display apparatus 400B according to the present embodiment, aside from the case of switching the frame display from the initial frame to the next frame, the display switching time for switching from one frame to the next frame may be reduced to half the length of the display switching time of the display apparatus 100. In this way, the overall display switching time required for successively switching and displaying plural pages to display a target frame in the display apparatus 400B may be substantially reduced compared to the display apparatus 100 of the prior art.

Further, in the display apparatus 400B according to the present embodiment, the successive display switching time may be adjusted to enable display of the target frame in a shorter period of time. In the following, adjustment of the successive display switching time for successively switching and displaying plural frames in the display apparatus 400B according to the present embodiment is described.

Figure 26:
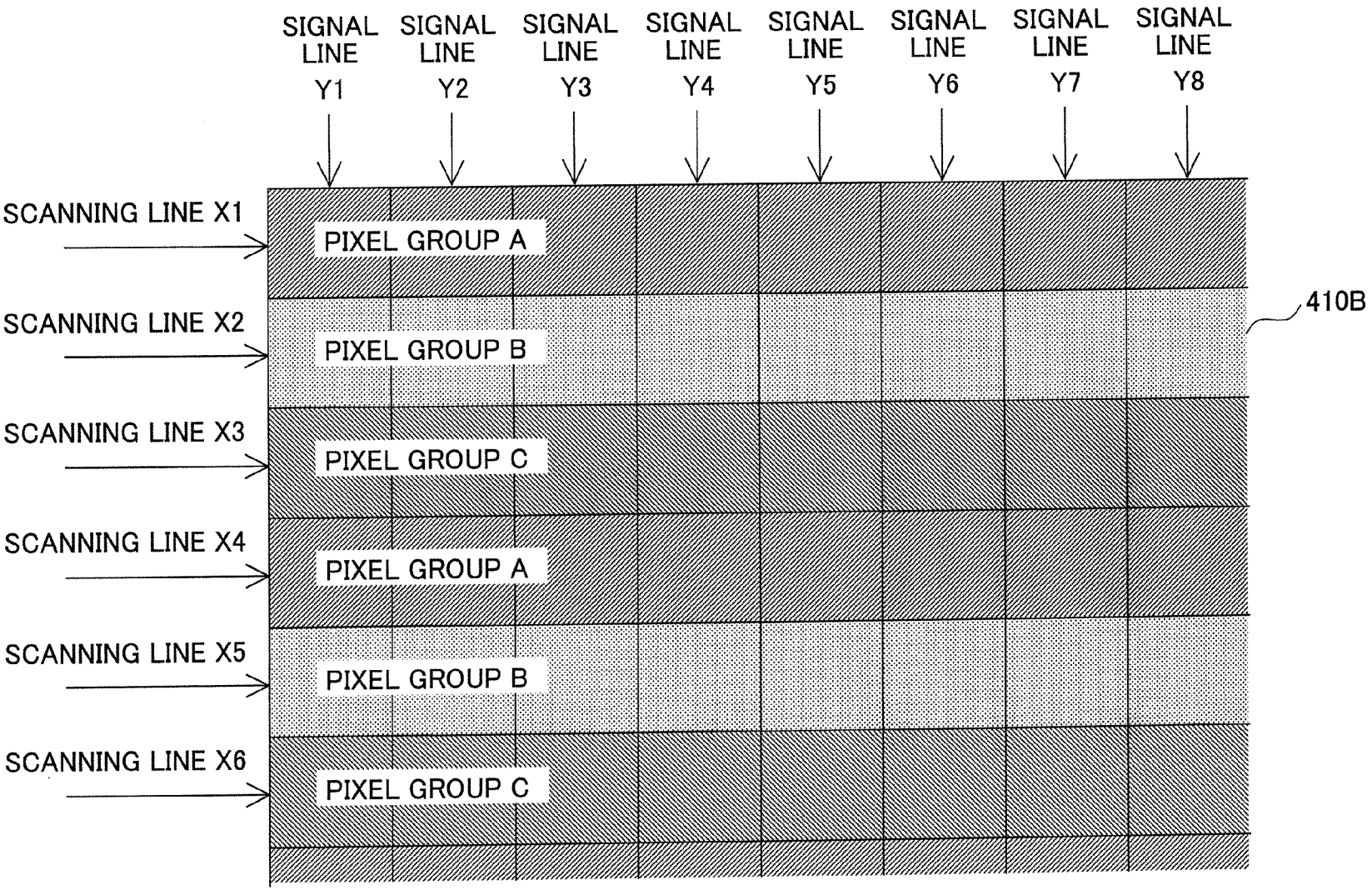
FIG. 26 is a diagram illustrating an exemplary manner in which pixel electrodes are divided into three pixel groups in the display unit of the display apparatus according to the fourth embodiment.

The frame display switching time of the display apparatus 400B according to the present embodiment depends on the number of pixel groups. In the following, an exemplary case where the pixel electrodes 102 of the display apparatus 400B are divided into three groups is described. FIG. 26 shows an example in which the pixel electrodes 102 of the display unit 410B are divided into pixel group A, pixel group B, and pixel group C.

Figure 27:
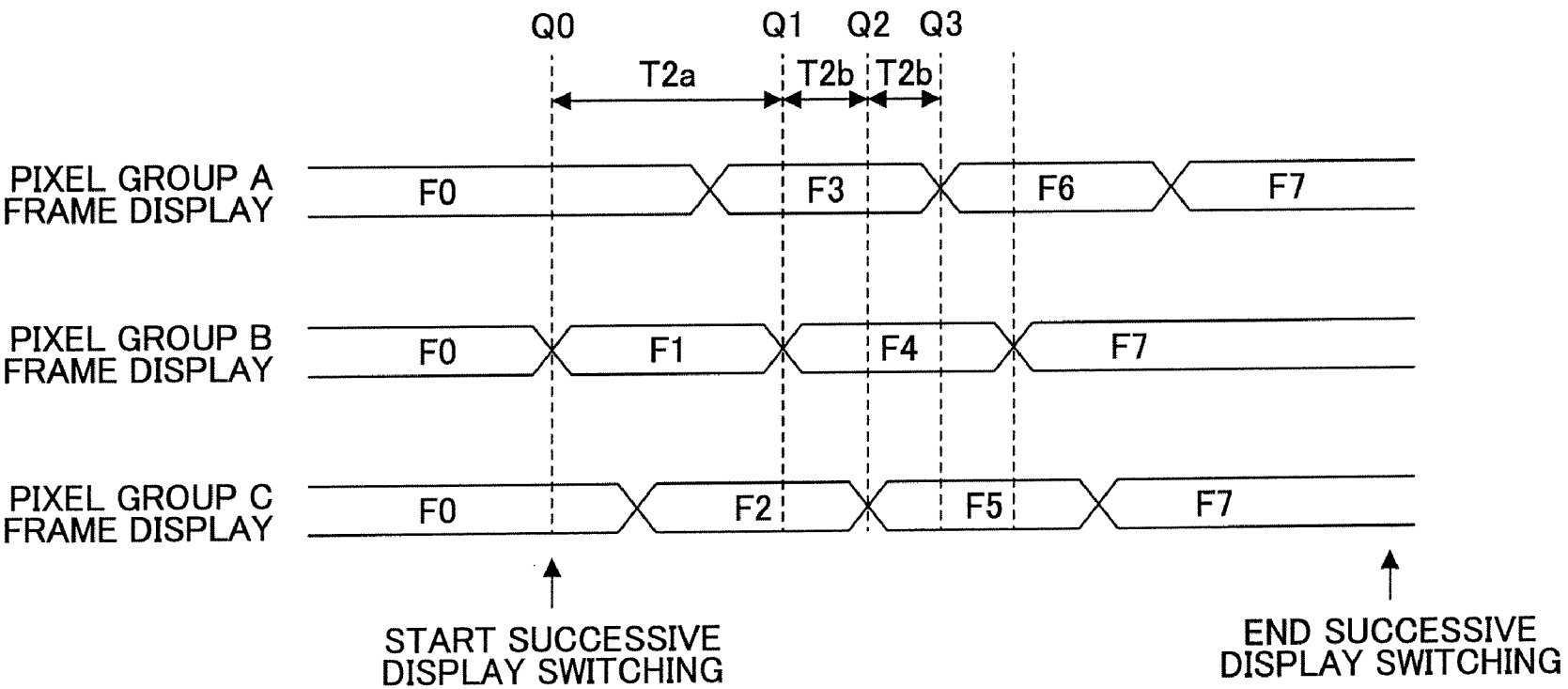
FIG. 27 is a timing chart illustrating display switching operations using three pixel groups that are performed by the display apparatus according to the fourth embodiment.
Figure 28:
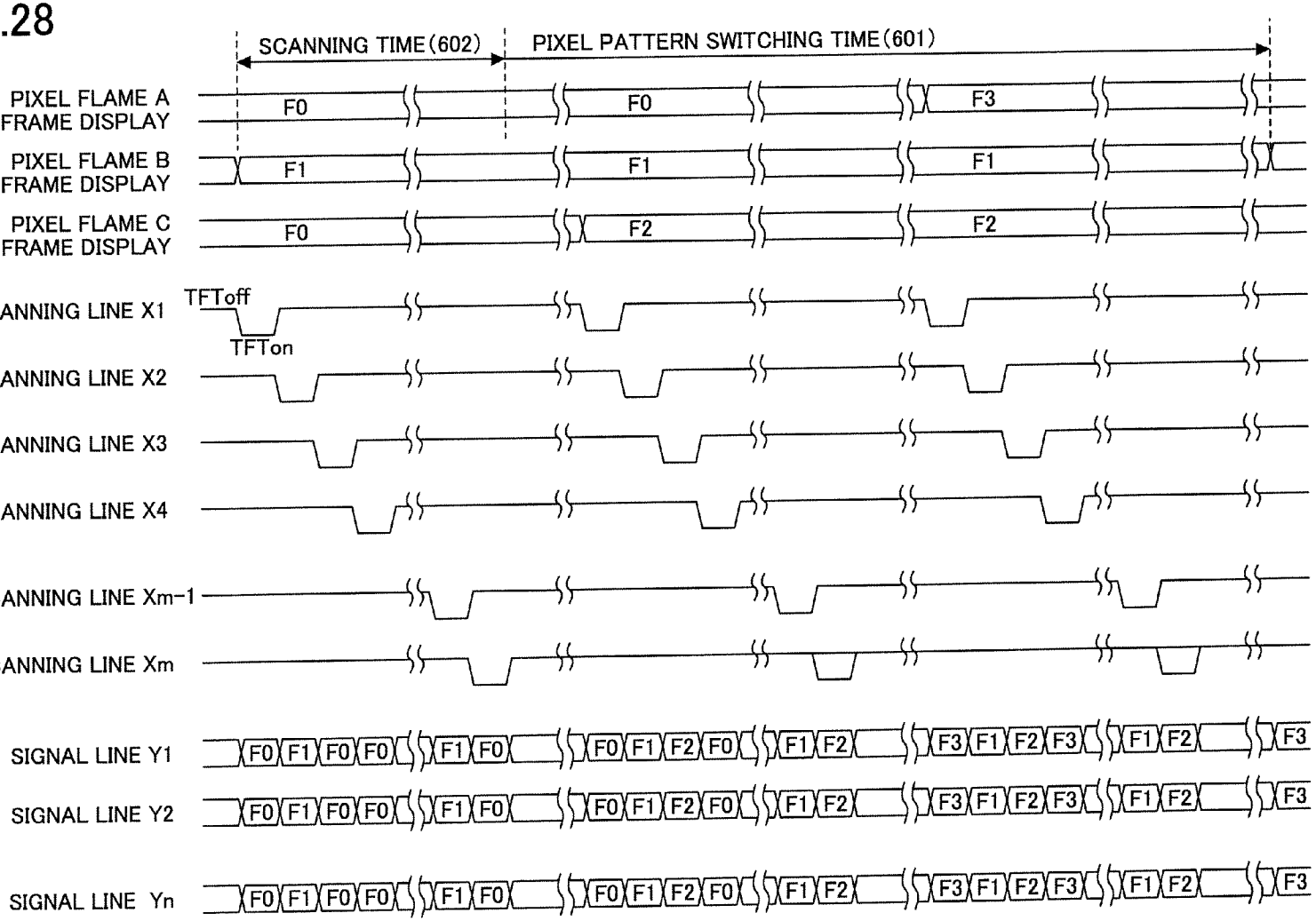
FIG. 28 is a diagram illustrating input signals input to scanning lines and signal lines of the display unit and the display statuses of the display unit corresponding to the timing chart of FIG. 27.

In the following, frame display operations of the display unit 410B when its pixel electrodes 102 are divided into three groups are described with reference to FIGS. 27 and 28. FIG. 27 is a timing chart illustrating successive frame display operations of the display apparatus 400B using the three pixel groups. FIG. 28 is a diagram illustrating input signals input to the scanning lines 106 and the signal lines 107 and the display statuses of the display unit 410B according to the timing chart of FIG. 13.

In the following, the display status of the display unit 410B at time point Q0 is described.

At time point Q0, the initial frame F0 is displayed by the display unit 410B, and the display unit 410B starts display switching operations for switching the frame display from the initial frame F0 to the next frame F1. In the present example, since the next frame F1 coming after the initial frame F0 is to be displayed by the pixel group B, only the pattern of the frame displayed by the pixel group B is switched at time point Q0.

When display switching operations of the pixel group B are started, display data for forming the pattern of frame F1 are input to the pixel electrodes belonging to pixel group B during a scanning time period 602 as is shown in FIG. 28. In this way, display operations for displaying the pattern of frame F1 are started by the pixel electrodes of the pixel group B. It is noted that frame display switching operations for switching the frame display of the pixel groups A and C are not yet started during the scanning time period 602. Thus, display data for forming the pattern of the initial frame F0 continue to be input to the pixel electrodes belonging to pixel groups A and C in the scanning operations performed during the scanning time period 602.

In the following, the display status of the display unit 410B at time point Q1 is described.

At time point Q1, the pixel group A is in the process of switching its frame display from the pattern of frame F0 to the pattern of frame F3. Thus, at this point, neither frame F0 nor frame F3 is displayed by the pixel group A in a visibly recognizable manner. Also, at time point Q1, the pixel group C is in the process of switching its frame display from the pattern of frame F0 to the pattern of frame F2. Thus, neither frame F0 nor frame F2 is displayed by the pixel group C in a visibly recognizable manner.

On the other hand, at time point Q1, display switching operations for switching the frame display of the pixel group B from the pattern of frame F0 to the pattern of frame F1 are completed so that the pattern of frame F1 is displayed by the pixel group B in a visibly recognizable manner.

Thus, at time point Q1, the pattern of frame F1 is displayed on the display unit 410B in a visibly recognizable manner. In other words, the display switching operations for switching the frame display of the display unit 410A from the pattern of the initial frame F0 to the pattern of the next frame F1 are completed at time point Q1. It is noted that the display switching time for switching the frame display from the pattern of frame F0 to the pattern of frame F1 is denoted by T2*a* in FIG. 27. Also, it is noted that a residual image resulting from the display switching operations of the pixel groups A and C may be displayed in the background of the frame display of frame F1 that is displayed by the pixel group B of the display unit 410B; however, such a residual image may not constitute a substantial factor hampering the visibility of the frame display of frame F1.

In the following, the display status of the display unit 410B at time point Q2 is described.

At time point Q2, the pixel group A is in the process of switching its frame display from the pattern of frame F0 to the pattern of frame F3. Thus, at this point, neither frame F0 nor frame F3 is displayed by the pixel group A in a visibly recognizable manner. Also, at time point Q2, the pixel group B is in the process of switching its frame display from the pattern of frame F1 to the pattern of frame F4. Thus, at this point, neither frame F1 nor frame F4 is displayed by the pixel group B in a visibly recognizable manner.

On the other hand, at time point Q2, display switching operations for switching the frame display of the pixel group C from the pattern of frame F0 to the pattern of frame F2 are completed so that the pattern of frame F2 is displayed by the pixel group C in a visibly recognizable manner.

Thus, at time point Q2, the pattern of frame F2 is displayed on the display unit 410B in a visibly recognizable manner. In other words, display switching operations for switching the frame display of the display unit 410B from the pattern of frame F1 to the pattern of frame F2 are completed at time point Q2. It is noted that the display switching time for switching the frame display from frame F1 to frame F2 is denoted by T2*b* in FIG. 27.

In the following, the display status of the display unit 410B at time point Q3 is described.

At time point Q3, the pixel group B is in the process of switching its frame display from the pattern of frame F1 to the pattern of frame F4. Thus, at this point, neither frame F1 nor frame F4 is displayed by the pixel group B in a visibly recognizable manner. Also, at time point Q3, the pixel group C is in the process of switching its frame display from the pattern of frame F2 to the pattern of frame F5. Thus, at this point, neither frame F2 nor frame F5 is displayed by the pixel group C in a visibly recognizable manner.

On the other hand, at time point Q3, display switching operations for switching the frame display of the pixel group A from the pattern of frame F0 to the pattern of frame F3 are completed so that the pattern of frame F3 is displayed by the pixel group A in a visibly recognizable manner.

Thus, at time point Q3, the pattern of frame F3 is displayed on the display unit 410B in a visibly recognizable manner. In other words, the display switching operations for switching the frame display of the display unit 410B from the pattern of frame F2 to the pattern of frame F3 are completed at time point Q3.

In the present example, the display switching time T2*b* is approximately one third of the length of the display switching time T2*a*. The display switching time T2*a* is equal to a total of the scanning time and the pixel pattern switching time and corresponds to the display switching time of the display apparatus 100 according to the prior art.

In the display apparatus 400B according to the present embodiment, by dividing the pixel electrodes 102 into three pixel groups, the display switching time for switching from one frame to the next frame, aside from the case of switching the frame display from the initial frame to the next frame, may be reduced to approximately one third of the length of the display switching time of the display apparatus 100 according to the prior art.

As can be appreciated from the above descriptions, by increasing the number of pixel groups from two to three in the display apparatus 400B according to the present embodiment, the frame display switching time may be reduced further with respect to the display switching time of the display apparatus 100 according to the prior art. In other words, the frame display switching time of the display apparatus 400B according the present embodiment may be adjusted by changing the number of pixel groups into which the pixel electrodes 102 are to be divided. For example, the number of pixel groups may be increased in order to increase the display switching speed and reduce the display switching time of the display apparatus 400B in the case where the process time of a successive display switching process performed in the display apparatus 400B is relatively long.

It is noted that the successive display switching process of the display apparatus 400B may continue for a relatively long period of time when a large number of pages have to be turned (i.e., when a large number of frames have to be switched) before a desired page for a user (i.e., target frame) is displayed on the display unit 410B. Accordingly, in the present embodiment, the display switching speed of the display apparatus 400B is automatically increased to reduce the display switching time in the case where the successive display switching process continues for more than a predetermined time period. In this way, the desired page for the user may be speedily searched and displayed on the display unit 410B.

Specifically, in the display apparatus 400B according to the present embodiment, a predetermined time period that is to elapse from the start time of a successive display switching process before the number of pixel groups is to be changed is stored beforehand. It is noted that the predetermined time may be stored in the memory 422 or some other storage unit (not shown) included in the display apparatus 400B. Also, in the display apparatus 400B of the present embodiment, the controller 421 is configured to keep track of the time elapsed from the start of the successive display switching process using a clock function of the display apparatus 400B. The controller 421 changes the number of pixel groups using the change unit 426 when it does not receive a successive display switching process stop command even after the predetermined time period elapses from the time the successive display switching process is started.

In the following, the change unit 426 is described. The change unit 426 is included in the control unit 421 and realizes the function of changing the number of pixel groups. Specifically, the change unit 426 changes the number of pixel groups from a value currently set to the display unit 410B to a stored value set by the setting unit 425 as the number of pixel groups to be set to the display unit 410B after the current value expires. When the number of pixels is changed by the change unit 426, the controller 421 performs relevant control operations with respect to relevant component units of the display apparatus 400B to change the number of pixel groups. It is noted that the number of pixel groups set by the setting unit 425 as the number of pixel groups into which the current number is to be changed may be stored in the memory 422 or some other storage unit (not shown) included in the display apparatus 400B, for example.

Figure 29:
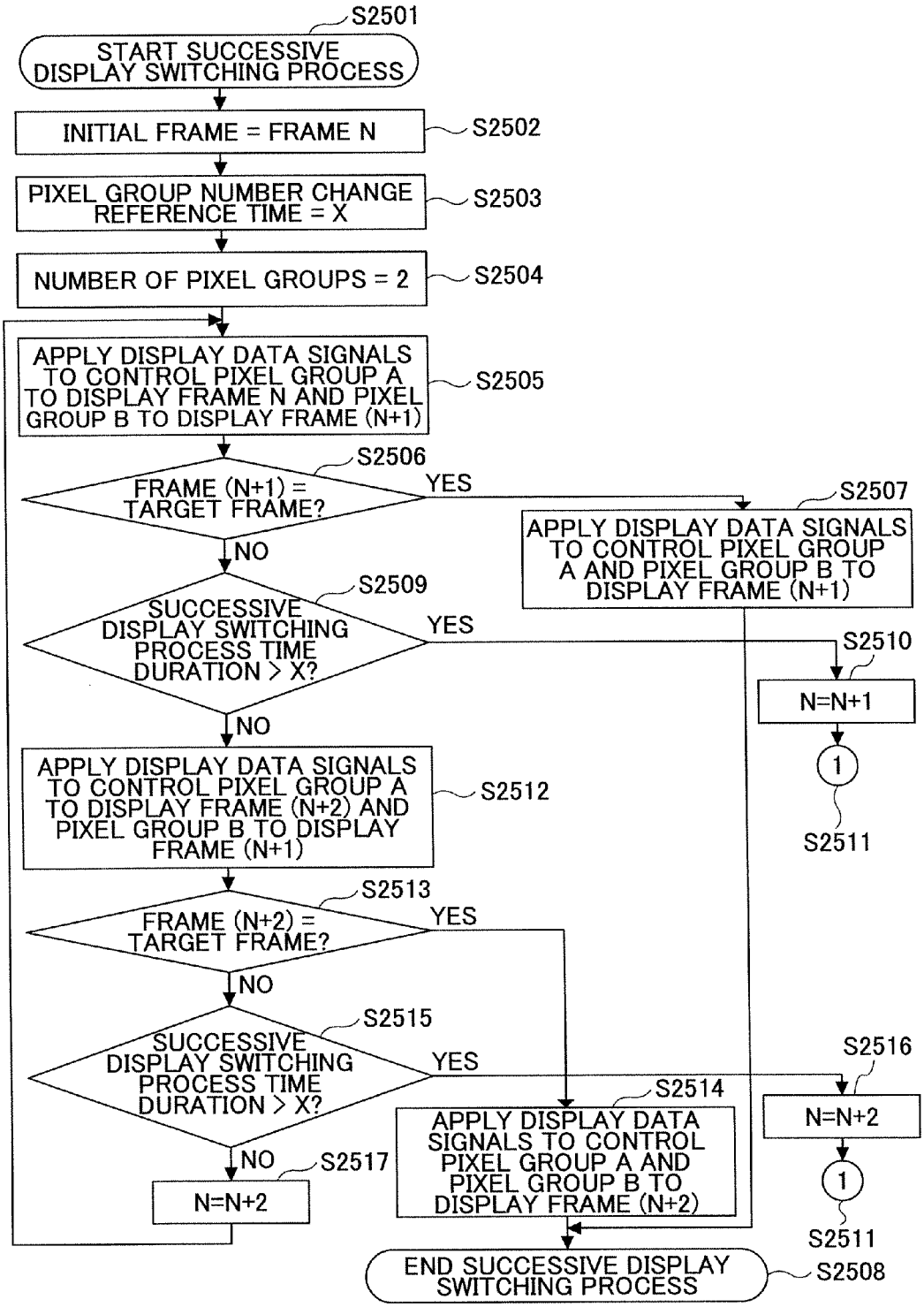
FIG. 29 is a flowchart illustrating operations for changing the number of pixel groups in the display apparatus according to the fourth embodiment.

In the following, operations for changing the number of pixel groups to be used in the display unit 410B of the display apparatus according to the present embodiment are described with reference to FIG. 29. FIG. 29 is a flowchart illustrating operations for changing the number of pixel groups used in the display unit 410 of the display apparatus 400B. In the illustrated example of FIG. 29, it is assumed that the value "2" is initially set to the display unit 410B as the number of pixel groups to be used.

According to FIG. 29, the display apparatus 400B starts a successive display switching process in response to a successive display switching process start command input by a user via the operations unit 427 (step S2501). At this point, the control unit 421 identifies the initial frame displayed on the display unit 410B (i.e., frame displayed before the frame display is switched) as frame N (step S2502), and reads information on this frame N from the memory 422. For example, the frame information read from the memory 422 may be identification information indicating the order of frame N within the frames stored in the memory 422.

Then, the controller 421 reads and sets time information to be used for determining whether the number of pixel groups should be changed (step S2503). In one example, the time information may correspond to a change reference time that is set by the setting unit 425 and stored in a storage unit (not shown) of the display apparatus 400B to be used as a reference for determining whether the controller 421 should change the number of pixel groups. In another example, the time information may be input by the user via the operations unit 427 each time a successive display switching process is started. Then, the controller 421 sets the number of pixel groups to "2" corresponding to the initial number of pixel groups and starts frame switching operations of the successive display switching process (step S2504). In the following descriptions, the two pixel groups are referred to as pixel group A and pixel group B.

The controller 421 applies signals to the scanning lines 106 and the signal lines 107 to control the pixel group A to display the pattern of frame N and the pixel group B to display the pattern of frame (N+1) (step S2505). Specifically, in a case where pixel electrodes 102 positioned on a given scanning line 106 that has its TFTs 105 turned on belongs to the pixel group A, display data signals for displaying frame N are applied to the signal lines 107. In a case where pixel electrodes 102 positioned on a given scanning line 106 that has its TFTs 105 turned on belongs to the pixel group B, display data signals for displaying frame (N+1) are applied to the signal lines 107.

Then, the controller 421 determines whether the frame (N+1) corresponds to a target frame (step S2506). In the present embodiment, the controller 421 determines the target frame by determining the frame that is displayed at the time a successive display switching process execution command signal stops being input. It is noted that such determination operations are performed from the time first scanning operations are ended to the time second scanning operations are started.

If the frame (N+1) is determined to be the target frame in step S2506, the controller 421 applies signals to the scanning lines 106 and the signal lines 107 to control the pixel groups A and B to display the pattern of frame (N+1) (step S2507). Then, the controller 421 ends the successive display switching process (step 2508).

On the other hand, if it is determined in step S2506 that the frame (N+1) does not correspond to the target frame, the controller 421 compares the time elapsed from when the successive display switching process is started to the time the determination step 2506 is performed (i.e., time duration of the successive display switching process) with the change reference time set in step S2503 (step S2509). Upon determining that the time duration of the successive display switching process is longer than the reference time, the controller 421 resets the initial frame N to N=N+1 (step S2510) and controls the change unit 426 to change the number of pixel groups (step S2511). In the present example, it is assumed that the number of pixel groups is changed from "2" to "3" as is described in detail below.

Upon determining in step S2509 that the time duration of the successive display switching process is shorter than the change reference time, the controller 421 applies signals to the scanning lines 106 and the signal lines 107 to control the pixel group A to display the pattern of frame (N+2) and the pixel group B to display the pattern of frame (N+1) (step S2512).

Then, the controller 421 determines whether the frame (N+2) corresponds to the target frame (step S2513). If it is determined in step S2513 that the frame (N+2) corresponds to the target frame, the controller 421 applies signals to the scanning lines 106 and the signal lines 107 to control the pixel groups A and B to display the pattern of frame (N+2) (step S2514), and ends the successive display switching process (step S2508).

If it is determined in step S2513 that the frame (N+2) does not correspond to the target frame, the controller 421 compares the time elapsed from when the successive display switching process is started to the time the determination step 2512 is performed (i.e., time duration of the successive display switching process) with the change reference time set in step S2503 (step S2515).

When the duration time of the successive display switching process is longer than the change reference time, the controller 421 resets the initial frame N to N=N+2 (step S2516) and changes the number of pixel groups using the change unit 426 (step S2511).

Also, when it is determined in step S2515 that the duration time of the successive display switching process is shorter than the change reference time, the controller 421 resets the initial frame N to N=N+2 (step S2517) and goes back to step S2505 to apply signals to the scanning lines 106 and the signal lines 107 to control the pixel group A to display the pattern of frame (N=N+2), and the pixel group B to display the pattern of frame (N+1=N+3). It is noted that the controller 421 repeats the process steps of S2505-S2517 until it is determined that the target frame has been reached or the duration time of the successive display switching process is longer than the change reference time.

Figure 30:
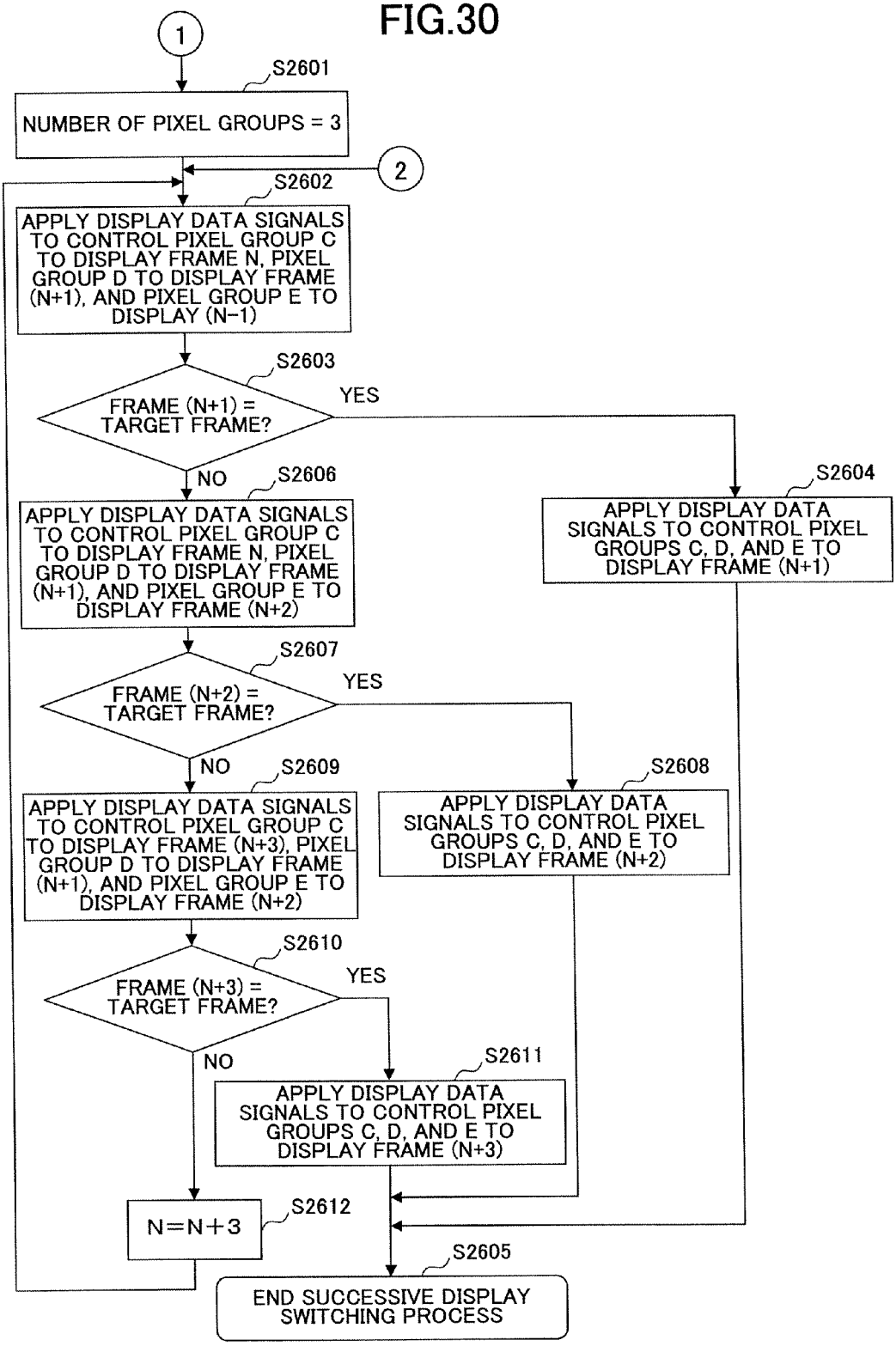
FIG. 30 is a flowchart illustrating operations after the number of pixel groups is changed in the display apparatus according to the fourth embodiment.

In the following, operations of the display apparatus 400B when the number of pixel groups is changed to "3" are described with reference to FIG. 30. FIG. 30 is a flowchart illustrating operations of the display apparatus 400B after the number of pixel groups is changed from "2" to "3". In the illustrated example of FIG. 30, the three pixel groups are denoted as pixel group C, pixel group D, and pixel group E.

When the number of pixel groups is changed to "3" in the display apparatus 400B (S2601), the controller 421 applies signals to the scanning lines 106 and the signal lines 107 to control the pixel group C to display the pattern of frame N, the pixel group D to display the pattern of frame (N+1), and the pixel group E to display the pattern of frame (N−1) (step S2602). Specifically, in a case where pixel electrodes 102 positioned on a given scanning line 106 that has its TFTs 105 turned on belongs to the pixel group C, display data signals for displaying frame N are applied to the signal lines 107. In a case where pixel electrodes 102 positioned on a given scanning line 106 that has its TFTs 105 turned on belongs to the pixel group D, display data signals for displaying frame (N+1) are applied to the signal lines 107. In a case where pixel electrodes 102 positioned on a given scanning line 106 that has its TFTs 105 turned on belongs to the pixel group E, display data signals for displaying frame (N+2) are applied to the signal lines 107.

Then, the controller 421 determines whether the frame (N+1) corresponds to a target frame (step S2603). If the frame (N+1) is determined to be the target frame in step S2603, the controller 421 applies signals to the scanning lines 106 and the signal lines 107 to control the pixel groups C, D, and E to display the pattern of frame (N+1) (step S2604). Then, the controller 421 displays the frame (N+1) on the display unit 410B, and ends the successive display switching process (step S2605).

If it is determined in step S2603 that the frame (N+1) does not correspond to the target frame, the controller 421 applies signals to the scanning lines 106 and the signal lines 107 to control the pixel group C to display the pattern of frame N, the pixel group D to display the pattern of frame (N+1), and the pixel group E to display the pattern of frame (N+2) (step S2606).

Then, the controller 421 determines whether the frame (N+2) corresponds to the target frame (step S2607). If it is determined in step S2607 that the frame (N+2) corresponds to the target frame, the controller 421 applies signals to the scanning lines 106 and the signal lines 107 to control the pixel groups C, D, and E to display the pattern of frame (N+2) (step S2608). Then, the controller 421 controls the display unit 410B to display the pattern of frame (N+2) and ends the successive display switching process (step S2605).

If it is determined in step S2607 that the frame (N+2) does not correspond to the target frame, the controller 421 applies signals to the scanning lines 106 and the signal lines 107 to control the pixel group C to display the pattern of frame (N+3), the pixel group D to display the pattern of frame (N+1), and the pixel group E to display the pattern of frame (N+2) (step S2609).

Then, the controller 421 determines whether the frame (N+3) corresponds to the target frame (step S2610). If it is determined in step S2610 that the frame (N+3) corresponds to the target frame, the controller 421 applies signals to the scanning lines 106 and the signal lines 107 to control the pixel groups C, D, and E to display the pattern of frame (N+3) (step S2608). Then, the controller 421 controls the display unit 410B to display the pattern of frame (N+3) and ends the successive display switching process (step S2605).

If it is determined in step S2610 that the frame (N+3) does not correspond to the target frame, the controller 421 applies signals to the scanning lines 106 and the signal lines 107 to control the pixel group C to display the pattern of frame (N+3), the pixel group D to display the pattern of frame (N+4), and the pixel group E to display the pattern of frame (N+2) (step S2612).

It is noted that the controller 421 repeats the process steps of S2602-S2612 until the target frame is displayed on the display unit 410B.

As can be appreciated from the above descriptions, in the display apparatus 400B according to the present embodiment, the number of pixel groups is changed after a predetermined time period (i.e., change reference time) elapses from the time a successive display switching process is started. In one example, the number of pixel groups may be increased in order to increase the frame display switching speed of the display unit 410B. In this way, the number of pixel groups used in the display apparatus 400B may be changed to reduce the time it takes to have a desired frame (page) displayed on the display unit 410B so that the desired frame (target frame) may be promptly displayed.

In another example, the number of pixel groups used in the display apparatus 400B may be decreased in order to decrease the frame display switching speed of the display unit 410B. In this way, the number of pixel groups may be changed to adjust the frame display switching speed of the display unit 410B according to usage preferences of a user so that operability of the display apparatus 400B may be improved.

It is noted that in the above-described embodiment, predetermined time information is set as a reference for determining whether to change the number of pixel groups in step S2503. However, the present invention is not limited to such an example, and in another example, a predetermined number of frames may be used as the reference for determining whether to change the number of pixel groups. In this case, the display apparatus 400B preferably has a counter function for counting the number of frames displayed by the display unit 410B. In one example, such a counter function may be realized by the controller 421.

In the following, an example is described in which a predetermined number of frames is used as a reference for determining whether to change the number of pixel groups. In the case where a predetermined number of frames is used as the reference for changing the number of pixel groups, the controller 421 sets a change reference frame number as reference information for changing the number of pixel groups in step S2503 of FIG. 29.

Then, the controller 421 determines whether the number of frames displayed on the display unit 410B after the successive display switching process has started is greater than or equal to the reference change reference frame number. If the number of frames displayed by the display unit 410B after the successive display switching process has started is greater than or equal to the change reference frame number, operations may move on to changing the number of pixel groups.

It is noted that advantages similar to the case of using predetermined time information as the reference for changing the number of pixel groups may be obtained in the above example using a predetermined number of frames as the reference for changing the number of pixel groups.

Fifth Embodiment

In the following, a fifth embodiment of the present invention is described with reference to the accompanying drawings.

A display apparatus according to the fifth embodiment differs from that of the fourth embodiment in that it is configured to change the ratio of the number of frames to be displayed by each of the pixel groups to the total number of frames to be displayed by the display unit rather than changing the number of pixel groups. In the following, features of the fifth embodiment that are different from those of the fourth embodiment are described whereas descriptions of features identical to the fourth embodiment are omitted. Also, component elements of the display apparatus according to the fifth embodiment that are identical to those of the fourth embodiment are given the same reference numerals.

The display apparatus according to the fifth embodiment changes the ratio of the number of frames to be displayed by each of the pixel groups to the total number of frames to be displayed by the display unit using the change unit 426 of the controller 421 in order to adjust the frame display switching speed of the display unit 410B. It is noted that the ratio of the number of frames to be displayed by each of the pixel groups to the total number of frames to be displayed by the display unit may simply be referred to as "ratio" hereinafter.

In the following, the frame display switching speed in accordance with the ratio of the display apparatus according to the fifth embodiment is described.

For example, in the case where the pixel electrodes 102 are divided into three pixel groups and the pixel groups are each configured to display differing frames as is described above in relation to the fourth embodiment, the frame display switching time of the display apparatus may be reduced to one third (⅓) of the display switching time of the display apparatus 100 according to the prior art. In this case, when the total number of frames to be displayed by the display unit 410B is thirty (30) frames, the number of frames displayed by each of the pixel groups is ten (10) frames. Therefore, the ratio of the number of frames to be displayed by each of the pixel groups to the total number of frames to be displayed by the display unit 410B is equal to ⅓.

In the present embodiment, another scheme is interchangeably used in which the pixel electrodes 102 are divided into three groups and two of the three pixel groups are arranged to display the same frame at the same time. In this case, if the total number of frames to be displayed by the display unit 410B is thirty (30) frames, the number of frames to be displayed by each of the pixel groups is twenty (20) frames so that the ratio is equal to ⅔. In the following, the display switching speed of the display apparatus according to the fifth embodiment when the ratio is equal to ⅔ is described.

Figure 31:
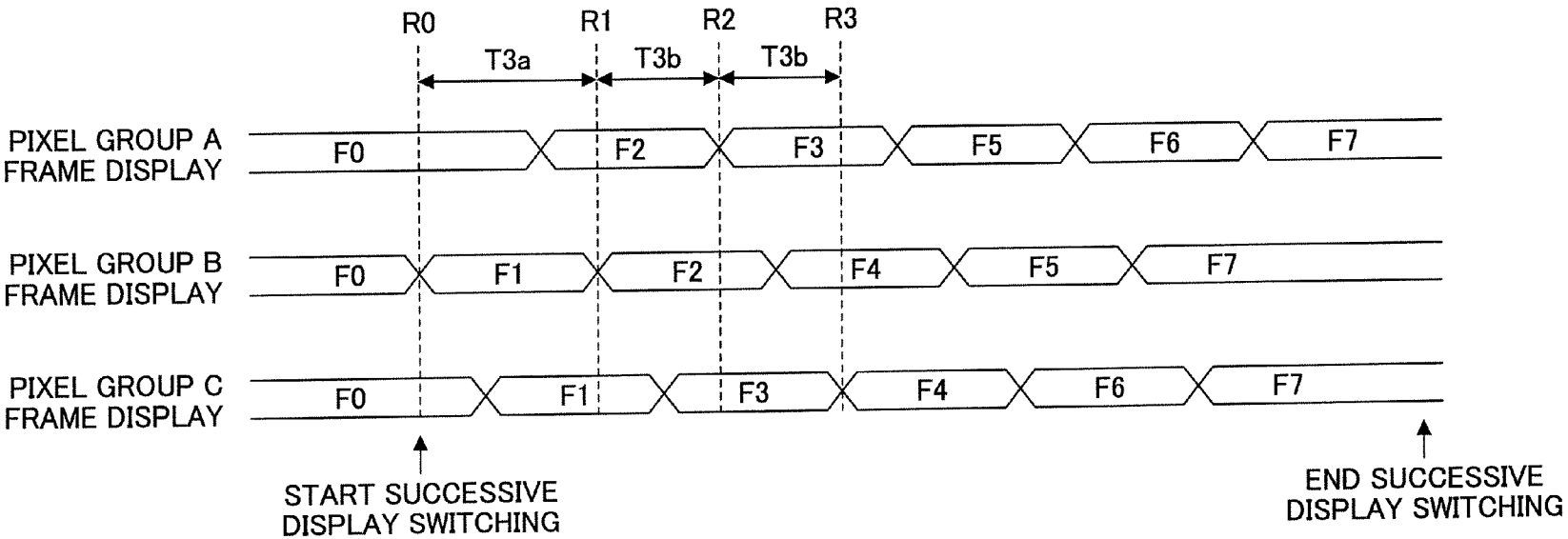
FIG. 31 is a timing chart illustrating display switching operations of a display apparatus according to a fifth embodiment of the present invention in a case where a ratio of the number of frames to be displayed by each pixel group to the total number of frames to be displayed by the display unit is set to 2/3.

FIG. 31 is a timing chart illustrating the display switching speed of the display apparatus according to the fifth embodiment when the ratio is set to 2/3.

In the following, the display status of the display unit 410B at time point R0 is described.

At time point R0 of FIG. 31, an initial frame F0 is displayed by the display unit 410B, and the display unit 410B starts display switching operations for switching its frame display from the initial frame F0 to a next frame F1. Since the next frame F1 coming after the initial frame F0 is to be displayed by the pixel group B, only the frame pattern to be displayed by the pixel group B is switched at time point R0.

In the following, the display status of the display unit 410B at time point R1 is described.

At time point R1, the pixel group A is in the process of switching its frame display from the pattern of frame F0 to the pattern of frame F2. Thus, at this point neither frame F0 nor frame F2 is displayed by the pixel group A in a visibly recognizable manner. Also, at time point R1, the pixel group C is in the process of switching its frame display from the pattern of frame F0 to the pattern of frame F1.

On the other hand, at time point R1, display switching operations for switching the frame display of the pixel group B from the pattern of frame F0 to the pattern of frame F1 are completed so that the pattern of frame F1 is displayed by the pixel group B in a visibly recognizable manner. Thus, at time point R1, the pattern of frame F1 is displayed on the display unit 410B in a visibly recognizable manner. In other words, the display switching operations for switching the frame display of the display unit 410B from the pattern of the initial frame F0 to the pattern of the next frame F1 are completed at time point R1.

According to the present embodiment, at time point R1, the pattern of frame F1 is displayed by the pixel group B, and the pattern of frame F1 is about to be displayed by the pixel group C. Thus, the number of pixel electrodes displaying the pattern of frame F1 on the display unit 410B at time point R1 according to the present embodiment is greater than the number of pixel electrodes displaying the pattern of frame F1 on the display unit 410B at time point Q1 of FIG. 27 where the three different pixel groups are each arranged to display differing frame patterns.

Accordingly, the visibility of the pattern of frame F1 displayed by the display unit 410B at time point R1 according to the present embodiment may be improved with respect to the visibility of the pattern of frame F1 displayed by the display unit 410B at time point Q1 of FIG. 27.

It is noted that the display switching time for switching the frame display from the pattern of frame F0 to the pattern of frame F1 is denoted by T3*a* in FIG. 31. Also, it is noted that a residual image resulting from the display switching operations of the pixel group A may be displayed in the background of the frame display of frame F1 displayed by the pixel group B of the display unit 410B; however, such a residual image may not constitute a substantial factor hampering the visibility of the frame display of frame F1.

In the following, the display status of the display unit 410B at time point R2 is described.

At time point R2, the pixel group B is in the process of switching its frame display from the pattern of frame F1 to the pattern of frame F2. Thus, at this point, neither frame F1 nor frame F2 is displayed by the pixel group B in a visibly recognizable manner. Also, at time point R2, the pixel group C is in the process of switching its frame display from the pattern of frame F1 to the pattern of frame F3. Thus, at this point neither frame F1 nor frame F3 is displayed by the pixel group C in a visibly recognizable manner.

On the other hand, at time point R2, display switching operations for switching the frame display of the pixel group A from the pattern of frame F0 to the pattern of frame F2 are completed so that the pattern of frame F2 is displayed by the pixel group A in a visibly recognizable manner.

According to the present embodiment, at time point R2, the pattern of frame F2 is displayed by the pixel group A, and the pattern of frame F2 is about to be displayed by the pixel group B. Thus, as with the display status of the display unit 410B at time point R1, the number of pixel electrodes displaying the pattern of frame F2 on the display unit 410B at time point R2 is greater than the number of pixel electrodes displaying the pattern of frame F2 on the display unit 410B at time point Q2 of FIG. 27 where the three different pixel groups are each arranged to display differing frame patterns.

Accordingly, the visibility of the pattern of frame F2 displayed by the display unit 410B at time point R2 may be improved with respect to the visibility of the pattern of frame F2 displayed by the display unit 410B at time point Q2 of FIG. 27. It is noted that the display switching time for switching the frame display from the pattern of frame F1 to the pattern of frame F2 is denoted by T3*b* in FIG. 31.

In the following, the display status of the display unit 410B at time point R3 is described.

At time point R3, the pixel group A is in the process of switching its frame display from the pattern of frame F2 to the pattern of frame F3. Thus, at this point, neither frame F2 nor frame F3 is displayed by the pixel group A in a visibly recognizable manner. Also, at time point R3, the pixel group B is in the process of switching its frame display from the pattern of frame F2 to the pattern of frame F4. Thus, at this point, neither frame F2 nor frame F4 is displayed by the pixel group B in a visibly recognizable manner.

On the other hand, at time point R3, display switching operations for switching the frame display of the pixel group C from the pattern of frame F1 to the pattern of frame F3 are completed so that the pattern of frame F3 is displayed by the pixel group C in a visibly recognizable manner.

Thus, at time point R3, the pattern of frame F3 is displayed by the pixel group C, and the pattern of frame F3 is about to be displayed by the pixel group A. In other words, as with the display status of the display unit 410B at time point R1, the number of pixel electrodes displaying the pattern of frame F3 on the display unit 410B at time point R3 is greater than the number of pixel electrodes displaying the pattern of frame F3 on the display unit 410B at time point Q3 of FIG. 27 in which the three different pixel groups are each arranged to display differing frame patterns.

Accordingly, the visibility of the pattern of frame F3 displayed by the display unit 410B at time point R3 may be improved with respect to the visibility of the pattern of frame F3 displayed by the display unit 410B at time point Q3 in the example of FIG. 27. It is noted that the display switching time for switching the frame display from the pattern of frame F2 to the pattern of frame F3 is also denoted by T3*b* in FIG. 31.

In the example of FIG. 31, the length of the display switching time T3*b* is approximately two thirds of the length of the display switching time T3*a*. The display switching time T3*a* is equal to a total of the scanning time and the pixel pattern switching time and corresponds to the display switching time of the display apparatus 100 according to the prior art.

As can be appreciated from the above descriptions, in the present embodiment, the display switching time for switching from one frame to the next frame aside from the case of switching from the initial frame to the next frame may be reduced to approximately two thirds of the length of the display switching time of the display apparatus 100 according to the prior art. It is noted that although the display switching time in the example is longer than that in the example of FIG. 27, the visibility of the frame pattern being displayed by the display unit 410B may be improved.

According to the present embodiment, the ratio of the number of frames to be displayed by each of the pixel groups to the total number of frames to be displayed by the display unit 410B may be changed to adjust the display switching speed of the display apparatus according to the present embodiment.

In the following, a process of changing the ratio in the display apparatus according to the fifth embodiment is described with reference to FIG. 32. FIG. 32 is a flowchart illustrating operations for changing the ratio of the number of frames to be displayed by each of the pixel groups to the total number of frames to be displayed by the display unit 410B in the display apparatus according to the present embodiment. In the illustrated example of FIG. 32, it is assumed that the pixel electrodes 102 of the display unit 410B are divided into three pixel groups and the ratio is set to 2/3. Also, in this example, the three pixel groups are referred to as pixel group A, pixel group B, and pixel group C.

According to FIG. 32, the display apparatus of the present embodiment starts a successive display switching process in response to a successive display switching process start command input by a user via the operations unit 427 (step S2801). At this point, the control unit 421 identifies the initial frame displayed on the display unit 410B (i.e., frame displayed before the frame display switching is started) as frame N (step S2802), and reads information on this frame N from the memory 422. For example, the frame information read from the memory 422 may be identification information indicating the order of frame N within the frames stored in the memory 422.

Then, the controller 421 reads and sets time information to be used for determining whether to change the ratio (step S2803). In one example, the time information may represent a change reference time that may be set by the setting unit 425 and stored in a storage unit (not shown) of the display apparatus to be used as a reference for determining whether the controller 421 should change the ratio of the display apparatus. Then, the controller 421 sets the ratio to "2/3" corresponding to the initial ratio that is determined beforehand and starts frame switching operations of the successive display switching process (step S2804).

The controller 421 applies signals to the scanning lines 106 and the signal lines 107 to control the pixel group A to display the pattern of frame N and the pixel groups B and C to display the pattern of frame (N+1) (step S2805). Specifically, in a case where pixel electrodes 102 positioned on a given scanning line 106 that has its TFTs 105 turned on belongs to the pixel group A, display data signals for displaying frame N are applied to the signal lines 107. In a case where pixel electrodes 102 positioned on a given scanning line 106 that has its TFTs 105 turned on belongs to the pixel group B or C, display data signals for displaying frame (N+1) are applied to the signal lines 107.

Then, the controller 421 determines whether the frame (N+1) corresponds to a target frame (step S2806). If the frame (N+1) is determined to be the target frame in step S2806, the controller 421 applies signals to the scanning lines 106 and the signal lines 107 to control the pixel groups A, B, and C to display the pattern of frame (N+1) (step S2807). Then, the controller 421 controls the display unit 410B to display the pattern of frame (N+1) and ends the successive display switching process (step S2808).

On the other hand, if it is determined in step S2806 that the frame (N+1) does not correspond to the target frame, the controller 421 compares the time elapsed from the time the successive display switching process has been started (i.e., time duration of the successive display switching process) with the change reference time used as a reference for changing the ratio that is set in step S2803 (step S2809). Upon determining that the time duration of the successive display switching process is longer than the reference time, the controller 421 resets the initial frame N to N=N+1 (step S2810) and controls the change unit 426 to change the ratio (step S2811). In the present example, it is assumed that the ratio is changed from "2/3" to "1/3" as is described in detail below.

Upon determining in step S2809 that the time duration of the successive display switching process is shorter than the change reference time, the controller 421 applies signals to the scanning lines 106 and the signal lines 107 to control the pixel groups A and B to display the pattern of frame (N+2) and the pixel group C to display the pattern of frame (N+1) (step S2812).

Then, the controller 421 determines whether the frame (N+2) corresponds to the target frame (step S2813). If it is determined in step S2813 that the frame (N+2) corresponds to the target frame, the controller 421 applies signals to the scanning lines 106 and the signal lines 107 to control the pixel groups A, B, and C to display the pattern of frame (N+2) (step S2814). Then the controller 421 controls the display unit 410B to display the pattern of frame (N+2) and ends the successive display switching process (step S2808).

If it is determined in step S2813 that the frame (N+2) does not correspond to the target frame, the controller 421 compares the time elapsed from the time the successive display switching process has been started (i.e., time duration of the successive display switching process) with the change reference time set in step S2803 (step S2815). When the duration time of the successive display switching process is longer than the change reference time, the controller 421 resets the initial frame N to N=N+2 (step S2516) and changes the ratio of the display apparatus using the change unit 426 (step S2811).

Also, when it is determined in step S2815 that the duration time of the successive display switching process is shorter than the change reference time, the controller 421 applies signals to the scanning lines 106 and the signal lines 107 to control the pixel groups A and C to display the pattern of frame (N+3), and the pixel group B to display the pattern of frame (N+2) (step S2817).

Then, the controller 421 determines whether the frame (N+3) corresponds to the target frame (step S2818). If it is determined in step S2818 that the frame (N+3) corresponds to the target frame, the controller 421 applies signals to the scanning lines 106 and the signal lines 107 to control the pixel groups A, B, and C to display the pattern of frame (N+3) (step S2819). Then, the controller 421 controls the display unit 410B to display the pattern of frame (N+3) and ends the successive display switching process (step S2808).

If it is determined in step S2818 that the frame (N+2) does not correspond to the target frame, the controller 421 compares the time elapsed from the time the successive display switching process has been started (i.e., time duration of the successive display switching process) with the change reference time used as a reference for changing the ratio that is set in step S2803 (step S2820). When the duration time of the successive display switching process is longer than the change reference time, the controller 421 resets the initial frame N to N=N+3 (step S2521) and changes the ratio of the display apparatus using the change unit 426 (step S2811).

When it is determined in step S2820 that the duration time of the successive display switching process is shorter than the change reference time, the controller 421 resets the initial frame N to N=N+3 (step S2822) and goes back to step S2805 to apply signals to the scanning lines 106 and the signal lines 107 to control the pixel group A to display the pattern of frame (N=N+3) and the pixel groups B and C to display the pattern of frame (N+1=N+4).

It is noted that the controller 421 repeats the process steps of S2805-S2822 until the target frame is displayed on the display unit 410B.

In the following, the process step S2811 for changing the ratio using the change unit 426 is described.

When the ratio is changed from ⅔ to ⅓ in the display apparatus according to the present embodiment, the pixel groups A, B, and C are each arranged to display differing frames.

In this case, operations of the display apparatus of the present embodiment after the ratio is changed to ⅓ may be identical to the operations of the display apparatus 400B of the fourth embodiment from step S2602 onward as illustrated in FIG. 30. Accordingly, descriptions of the operations of the display apparatus according to the fifth embodiment when the ratio is changed to ⅓ are omitted. It is noted that the pixel group A used in the present embodiment may correspond to the pixel group C of FIG. 30, the pixel group B used in the present embodiment may correspond to the pixel group D of FIG. 30, and the pixel group C used in the present embodiment may correspond to the pixel group E of FIG. 30.

When the ratio is changed to ⅓ in the display apparatus according to the present embodiment, the display switching speed of the display apparatus may be reduced to approximately one third (⅓) of the display switching speed of the display apparatus 100 of the prior art. On the other hand, the display switching speed of the display apparatus of the present embodiment before the ratio is changed is approximately two thirds (⅔) of the display switching speed of the display apparatus 100 according to the prior art. In this way, the display switching speed of the display apparatus according to the present embodiment may be adjusted by changing the ratio.

In one example, the ratio may be changed to a value that is less than the initial ratio value so that the display switching speed of the display apparatus may be increased. In this way, the required process time for having a desired frame (page) displayed by the display unit 410B may be reduced so that the desired frame may be promptly displayed.

In another example, the ratio may be changed to a value that is greater than the initial ratio value so that the display switching speed of the display apparatus may be reduced. In this way, the frame display switching speed of the display apparatus may be adjusted according to usage preferences of a user so that operability of the display apparatus may be improved.

It is noted that in the above-described embodiment, time information is set in step S2803 of FIG. 32 as a reference for determining whether to change the ratio. However, the present invention is not limited to such an embodiment, and in an alternative embodiment, a predetermined number of displayed frames may be used as such a reference. In this case, the display apparatus preferably has a counter function for counting the number of frames displayed by the display unit 410B. Such a counter function may be realized by the controller 421, for example.

In the following, an embodiment in which a predetermined number of frames are used as a reference for determining whether to change the ratio is described. In the case of using a predetermined number of frames as a reference for determining whether to change the ratio, the controller 421 sets a change reference frame number in step S2803 of FIG. 32 instead of setting the change reference time.

Then, the controller 421 determines in step S2809 whether the number of frames displayed by the display unit 410B since the successive display switching process has been started is greater than or equal to the change reference frame number. If the number of frames displayed by the display unit 410B is greater than or equal to the change reference frame number, the controller 421 moves on to perform operations for changing the ratio.

It is noted that the above embodiment may realize advantages similar to those realized in the embodiment using the change reference time as a reference for determining whether to change the ratio.

Sixth Embodiment

In the following, a sixth embodiment of the present invention is described with reference to the accompanying drawings.

In the display apparatus according to the sixth embodiment, operations performed upon receiving a successive display switching process end command signal differs from those of the fourth embodiment. In the following, only the features of the sixth embodiment that differ from those of the fourth embodiment are described, and elements of the sixth embodiment that are identical to those of the fourth embodiment are given the same numerical references.

Figure 33:
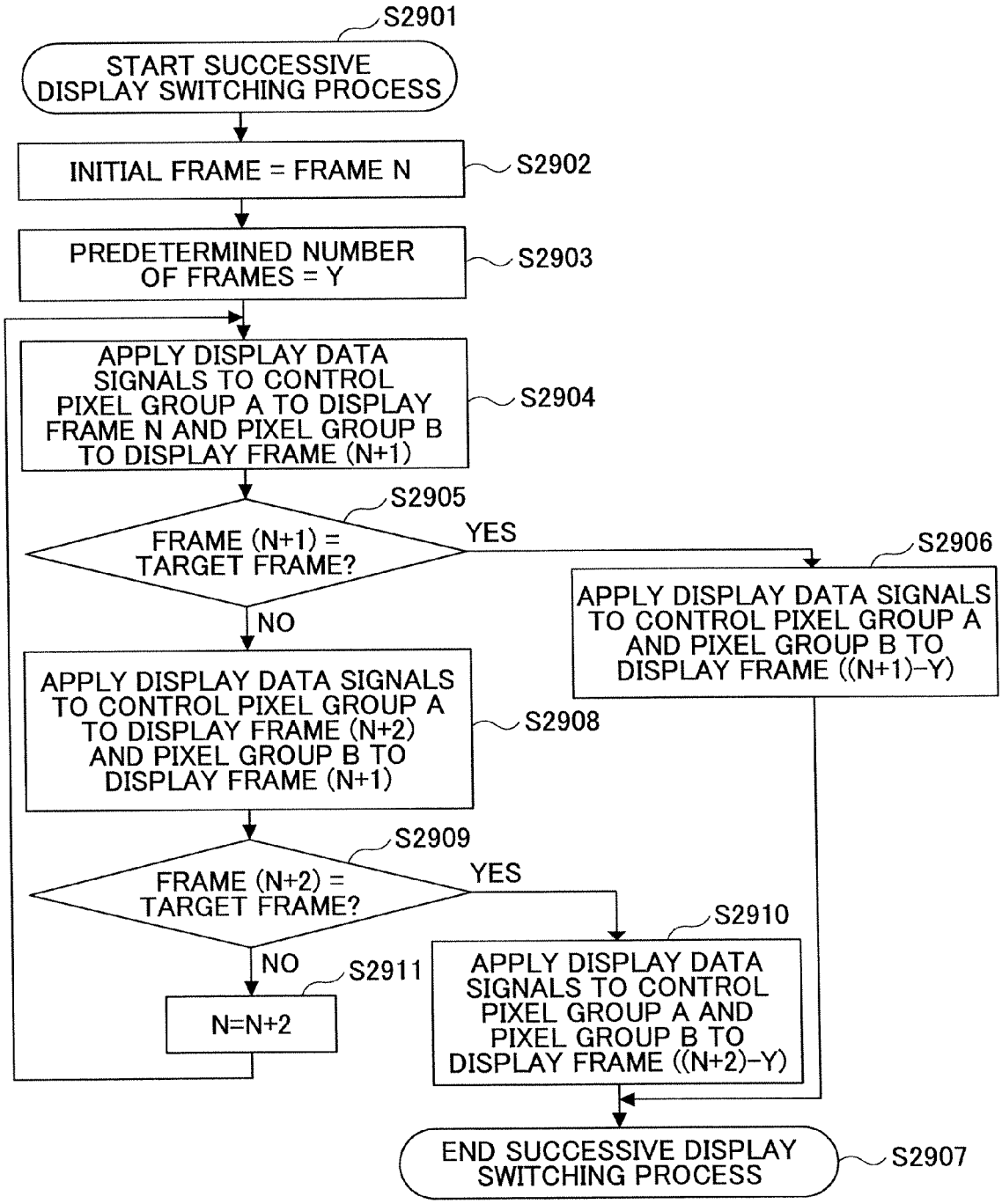
FIG. 33 is a flowchart illustrating operations of a display apparatus according to a sixth embodiment of the present invention in the case of receiving a display switching process end command signal.

It is noted that the structure of the display apparatus according to the sixth embodiment may be identical to that of the display apparatus 400B according to the fourth embodiment. In the following, operations of the display apparatus 400B according to the sixth embodiment are described with reference to FIG. 33. FIG. 33 is a flowchart illustrating operations performed in the display apparatus according to the sixth embodiment upon receiving a successive display switching process end command signal.

In the display apparatus according to the sixth embodiment, when a successive display switching process end command signal is received, the display unit 410B is controlled to go back a predetermined number of frames from the frame that is currently displayed by the display unit 410B (at the time the end command signal is received) and display the corresponding frame as the target frame. It is noted that the operations illustrated in FIG. 33 may be implemented in combination with the process of changing the number of pixel groups as is described above in relation to the fourth embodiment or the process of changing the ratio as is described above in relation to the fifth embodiment, for example. Also, in the illustrated example of FIG. 33, it is assumed that the pixel electrodes 102 of the display unit 410B are divided into two pixel groups, referred to as pixel group A and pixel group B.

According to FIG. 33, in the display apparatus of the present embodiment, the controller 421 starts a successive display switching process in response to a successive display switching process start command input via the operations unit 427 (step S2901). At this point, the control unit 421 identifies the initial frame displayed on the display unit 410B (i.e., frame displayed before frame display switching operations are started) as frame N (step S2902), and reads frame information related to this frame N from the memory 422.

Then, the controller 421 sets information on a predetermined number of frames to be tracked back from a currently displayed frame upon receiving a successive display switching process end command signal (step S2903). In one example, such information on the predetermined number of frames may be set beforehand using the setting unit 425 and stored in the memory 422 or some other storage unit (not shown) of the display apparatus. In another example, the information on the predetermined number of frames may be input by the user via the operations unit 427 when the successive display switching process is started. In such cases, the controller 421 may read the information from the relevant storage location and set the information on the predetermined number of frames in step S2903 based on the read information.

Then, the controller 421 applies signals to the scanning lines 106 and the signal lines 107 to control the pixel group A to display the pattern of frame N and the pixel group B to display the pattern of frame (N+1) (step S2904). Then, the controller 421 determines whether the frame (N+1) corresponds to the target frame (step S2905). It is noted that in the present example, the control unit 421 of the display apparatus determines that a target frame has been displayed on the display unit 410B when a successive display switching process end command signal is input via the operations unit 427. Such a determination may be made during the time from when first scanning operations are ended until the time next scanning operations are started.

If the frame (N+1) is determined to be the target frame in step S2905, the controller 421 applies signals to the scanning lines 106 and the signal lines 107 to control the pixel groups A and B to display the pattern of a previously displayed frame that is tracked back a predetermined number of frames from frame (N+1) according to the information set in step S2903 (step S2906). Then, the controller 421 ends the successive display switching process (step S2907). In one embodiment, upon ending the successive display switching process after determining that the target frame has been displayed by the display unit 410B, the controller 421 may store information in the memory 422 pertaining to the frame that has been determined as the target frame out of the plural frames stored in the memory 422.

If it is determined in step S2905 that the frame (N+1) does not correspond to the target frame, the controller 421 applies signals to the scanning lines 106 and the signal lines 107 to control the pixel group A to display the pattern of frame (N+2) and the pixel group B to display the pattern of frame (N+1) (step S2908).

Then, the controller 421 determines whether the frame (N+2) corresponds to the target frame (step S2909). If it is determined in step S2909 that the frame (N+2) corresponds to the target frame, the controller 421 applies signals to the scanning lines 106 and the signal lines 107 to control the pixel groups A and B to display the pattern of a previously displayed frame that is tracked back a predetermined number of frames from frame (N+2) according to the information set in step S2503 (step S2910). Then, the controller 421 ends the successive display switching process (step S2907).

If it is determined in step S2909 that the frame (N+2) does not correspond to the target frame, the controller the controller 421 resets the initial frame N to N=N+1 (step S2911) and goes back to step S2904 to apply signals to the scanning lines 106 and the signal lines 107 to control the pixel group A to display the pattern of frame (N=N+1), and the pixel group B to display the pattern of frame (N+1=N+2).

It is noted that the controller 421 repeats the process steps of S2904-S2911 until a target frame is displayed on the display unit 410B.

As can be appreciated from the above descriptions, in the display apparatus according to the present embodiment, when a successive display switching process end command signal is input, the display unit 410B may be arranged to go back a predetermined number of frames from the frame currently displayed by the display unit 410B to display a previously displayed frame as the target frame. Accordingly, even when there is a time difference between the point at which a user recognizes a desired framed displayed on the display unit 410B and the point at which the user operates the operations unit 427 to stop the successive display switching process, a frame closer to the frame desired by the user may be displayed by the display unit 410B so that the desired frame (page) may be promptly displayed.

In the following, the process step of S2903 for setting information on the predetermined number of frames is described in detail.

In the display apparatus according to the present embodiment, the transition of frames displayed on the display unit 410B may be faster as the frame display switching speed is increased, and the transition of the frames displayed by the display unit 410B may be slower as the frame display switching speed is decreased. Therefore, the predetermined number of frames set in step S2903 of FIG. 33 is preferably adjusted according to the frame display switching speed of the display apparatus. For example, a relatively large value is preferably set as the predetermined number of frames to be tracked back from the currently displayed frame when the frame display switching speed of the display apparatus is relatively fast, and a relatively small value may preferably be set as the predetermined number of frames when the frame display switching speed of the display apparatus is relatively slow.

Accordingly, in certain preferred embodiments, the predetermined number of frames to be tracked back from the currently displayed frame may be set to different values depending on the number of pixel groups and/or the ratio set in the display apparatus.

For example, provided that Ya denotes the predetermined number of frames in the case where the pixel electrodes are divided into three pixel groups and the ratio is set to 1/3, Yb denotes the predetermined number of frames in the case where the pixel electrodes are divided into two pixel groups and the ratio is set to 1/2, and Yc denotes the predetermined number of frames in the case where the pixel electrodes are divided into three groups and the ratio is set to 2/3, the values of Ya, Yb, and Yc preferably satisfy the following relationship:

$$Ya>Yb>Yc$$

It is noted that such a relationship is preferably realized in view of the fact that with respect to the above three cases, the frame display switching speed may be the fastest when the pixel electrodes are divided into three pixel groups and the ratio is set to 1/3, and the frame display switching speed may be the slowest when the pixel electrodes are divided into three groups and the ratio is set to 2/3.

Figure 34:
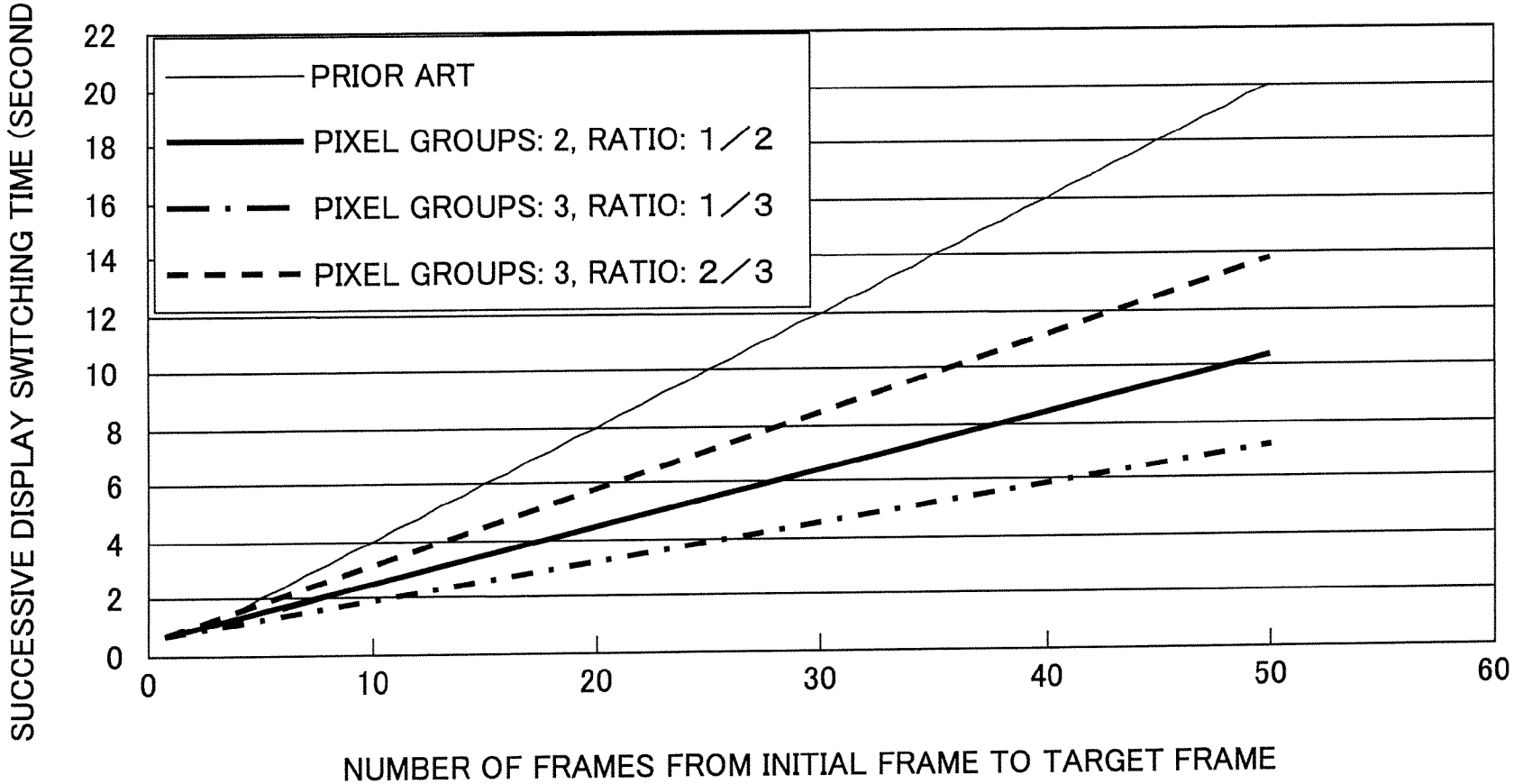
FIG. 34 is a graph illustrating display switching speeds realized by various display schemes according to the number of pixel groups and the ratio.

In the following, the frame display switching speed in relation to the number of pixel groups and the ratio is described. FIG. 34 is a graph illustrating successive display switching times realized by various successive frame display schemes.

As can be appreciated from FIG. 34, by employing the successive frame display schemes according to embodiments of the present invention that involves dividing pixel electrodes into plural pixel groups, the display switching time may be reduced compared to that of the prior art. It is noted that in the illustrated example of FIG. 34, the process time for switching the frame display from one frame to another frame (e.g., Ta, T2*a*, and T3*a*) is assumed to be 0.4 seconds. Also, it is noted that in the illustrated example of FIG. 34, the scanning time is not taken into account in calculating the display switching time since the scanning time is substantially shorter than the pixel pattern switching time.

According to one embodiment of the present invention, a predetermined number of frames to be tracked back from a currently displayed frame may be set according to the frame display switching speed. In this way, a frame close to the frame desired by a user may be displayed as the target frame even when there is a time lag between the point at which the user recognizes the desired frame and the point at which the user operates the operations unit 427 to end the successive display switching process.

In one preferred embodiment, a specific pixel group that is to display the starting frame from which the process of going back a predetermined number of frames to display the target frame is performed may be set beforehand. In the following, the starting frame for performing the process of going back a predetermined number of frames is described in the case where the pixel electrodes are divided into three pixel groups and the ratio is set to 1/3.

In the case where the pixel electrodes are divided into three pixel groups and the ratio is set to ⅓ in a display apparatus according to an embodiment of the present invention, three different frames displayed by the three pixel groups may be superposed and displayed on a display unit. In this case, three different frames may be displayed by the three different pixel groups of the display unit at the time a successive display switching process end command signal is input. Accordingly, in one preferred embodiment, a specific pixel group that is to display the starting frame may be set beforehand.

For example, if the frame displayed by pixel group A is set to be the starting frame, the controller 421 may use the frame displayed by the pixel group A at the time a successive display switching process end command signal is input as the starting frame. Then, the controller 421 may go back a predetermined number of frames from the frame displayed by the pixel group A to display the target frame. It is noted that such a setting may be made by the setting unit 425 beforehand and stored in the memory 422 or some other storage unit (not shown) of the display apparatus. In another example, such a setting may be input by a user via the operations unit 427 when the successive display switching process is started.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

The present application is based on and claims the benefit of the earlier filing date of Japanese Patent Application No. 2006-226523 filed on Aug. 23, 2006 and Japanese Patent Application No. 2006-352517 filed on Dec. 27, 2006, the entire contents of which are hereby incorporated by reference.

What is claimed is:

1. A display apparatus comprising:

two opposing substrates;

an electrophoretic element arranged between the substrates;

a plurality of pixel electrodes that are arranged on one of the substrates and are divided into a plurality of pixel groups including at least a first pixel group and a second pixel group;

a common electrode that is arranged on the other one of the substrates;

a control unit that controls frame display operations of the pixel groups, wherein the control unit controls the first pixel group to start frame display operations for displaying a frame and then controls the second pixel group to start frame display operations for displaying another frame before the frame display operations of the first pixel group are completed; and a change unit that changes a number of the pixel groups into which the pixel electrodes are divided when a predetermined condition is satisfied during the frame display operations.

2. The display apparatus as claimed in claim 1, further comprising:

a setting unit that sets information for controlling the frame display operations of the pixel groups, wherein the control unit controls display data of a predetermined frame to be output to the pixel electrodes based on the information set by the setting unit.

3. The display apparatus as claimed in claim 1, wherein the setting unit sets a ratio of a number of frames to be displayed by each of the pixel groups to a total number of frames to be displayed, and wherein the control unit controls the frame display operations of the pixel groups based on the ratio set by the setting unit.

4. The display apparatus as claimed in claim 1, wherein the predetermined condition is related to an elapsed time from a time the frame display operations are started by the control unit.

5. The display apparatus as claimed in claim 1, wherein the predetermined condition is related to a number of frames displayed from a time the frame display operations are started by the control unit.

6. A display apparatus comprising:

two opposing substrates;

an electrophoretic element arranged between the substrates;

a plurality of pixel electrodes that are arranged on one of the substrates and are divided into a plurality of pixel groups including at least a first pixel group and a second pixel group;

a common electrode that is arranged on the other one of the substrates;

a control unit that controls frame display operations of the pixel groups, wherein the control unit controls the first pixel group to start frame display operations for displaying a frame and then controls the second pixel group to start frame display operations for displaying another frame before the frame display operations of the first pixel group are completed;

a ratio setting unit that sets a ratio of a number of frames to be displayed by each of the pixel groups to a total number of frames to be displayed; and a ratio change unit that changes the ratio of the number of frames to be displayed by each of the pixel groups to the total number of frames to be displayed when a predetermined condition is satisfied during the frame display operations.

7. The display apparatus as claimed in claim 6, wherein the predetermined condition is related to an elapsed time from a time the frame display operations are started by the control unit.

8. The display apparatus as claimed in claim 6, wherein the predetermined condition is related to a number of frames displayed from a time the frame display operations are started by the control unit.

9. The display apparatus as claimed in claim 6, further comprising:

a setting unit that sets information for controlling the frame display operations of the pixel groups, wherein the control unit controls display data of a predetermined frame to be output to the pixel electrodes based on the information set by the setting unit.

10. The display apparatus as claimed in claim 6, wherein the setting unit sets a ratio of a number of frames to be displayed by each of the pixel groups to a total number of frames to be displayed, and wherein the control unit controls the frame display operations of the pixel groups based on the ratio set by the setting unit.

11. A display apparatus comprising:

two opposing substrates;

an electrophoretic element arranged between the substrates;

a plurality of pixel electrodes that are arranged on one of the substrates and are divided into a plurality of pixel groups including at least a first pixel group and a second pixel group;

a common electrode that is arranged on the other one of the substrates;

a control unit that controls frame display operations of the pixel groups, wherein the control unit controls the first pixel group to start frame display operations for displaying a frame and then controls the second pixel group to start frame display operations for displaying another frame before the frame display operations of the first pixel group are completed; and an operations unit that is operated to input an operations command signal, wherein the pixel groups are initially controlled to display a first frame and the control unit controls the first pixel group to switch from displaying the first frame to displaying a second frame, and then controls the second pixel group to switch from displaying the first frame to displaying a third frame before the frame display operations of the first pixel group for displaying the second frame are completed, and wherein when a frame display switching end command signal is input via the operations unit, the control unit controls the pixel groups to display a previously displayed frame that is displayed before a current frame displayed at the time said display switching end command signal is input.

12. The display apparatus as claimed in claim 11, wherein the control unit determines a number of frames to be tracked back from the current frame to display the previously displayed frame based on a number of the pixel groups into which the pixel electrodes are divided.

13. The display apparatus as claimed in claim 11, wherein the control unit determines a number of frames to be tracked back from the current frame to display the previously displayed frame based on a ratio of a number of frames to be displayed by each of the pixel groups to a total number of frames to be displayed.

14. The display apparatus as claimed in claim 11, further comprising:

a setting unit that sets information for controlling the frame display operations of the pixel groups, wherein the control unit controls display data of a predetermined frame to be output to the pixel electrodes based on the information set by the setting unit.

15. The display apparatus as claimed in claim 11, wherein the setting unit sets a ratio of a number of frames to be displayed by each of the pixel groups to a total number of frames to be displayed, and wherein the control unit controls the frame display operations of the pixel groups based on the ratio set by the setting unit.

* * * * *